US010124970B2

(12) United States Patent
Ishikawa et al.

(10) Patent No.: US 10,124,970 B2
(45) Date of Patent: Nov. 13, 2018

(54) SHEET FEEDER AND IMAGE FORMING APPARATUS INCORPORATING SAME

(71) Applicants: Yoshikuni Ishikawa, Tokyo (JP); Tetsutaro Yasuda, Kanagawa (JP); Manabu Nonaka, Kanagawa (JP)

(72) Inventors: Yoshikuni Ishikawa, Tokyo (JP); Tetsutaro Yasuda, Kanagawa (JP); Manabu Nonaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/053,452

(22) Filed: Feb. 25, 2016

(65) Prior Publication Data

US 2016/0194166 A1 Jul. 7, 2016

Related U.S. Application Data

(63) Continuation of application No. 14/258,343, filed on Apr. 22, 2014, now Pat. No. 9,302,868.

(30) Foreign Application Priority Data

| | | |
|---|---|---|
| Apr. 22, 2013 | (JP) | 2013-089706 |
| Jul. 24, 2013 | (JP) | 2013-153810 |
| Dec. 9, 2013 | (JP) | 2013-253900 |

(51) Int. Cl.

| | |
|---|---|
| ***B65H 3/18*** | (2006.01) |
| ***B65H 1/14*** | (2006.01) |
| ***B65H 3/54*** | (2006.01) |

(52) U.S. Cl.
CPC ..... *B65H 3/18* (2013.01); *B65H 1/14* (2013.01); *B65H 3/54* (2013.01); *B65H 2403/41* (2013.01);
(Continued)

(58) Field of Classification Search
CPC . B65H 3/04; B65H 3/047; B65H 3/18; B65H 2301/44322; B65H 2301/4473;
(Continued)

(56) References Cited

U.S. PATENT DOCUMENTS

| | | | | |
|---|---|---|---|---|
| 3,749,395 | A | 7/1973 | Bazzarone et al. | |
| 4,074,902 | A * | 2/1978 | Bradbury | B65H 3/047 271/125 |

(Continued)

FOREIGN PATENT DOCUMENTS

| | | | |
|---|---|---|---|
| JP | 2003-237958 | A | 8/2003 |
| JP | 2012-056711 | A | 3/2012 |

*Primary Examiner* — Thomas A Morrison
(74) *Attorney, Agent, or Firm* — Harness, Dickey & Pierce, P.L.C.

(57) ABSTRACT

A sheet feeder, which is incorporated in an image forming apparatus, includes an endless attraction belt that is rotatably disposed facing a top surface of a sheet stack, a belt charger to attract an uppermost sheet of the sheet stack, and a sheet separator to press the attraction belt against the sheet stack, bend a contact region to which the uppermost sheet is attracted and contacted to the attraction belt, and separate the uppermost sheet from a subsequent sheet or other sheet of the sheet stack. In this configuration, a curvature of a contact surface of the sheet separator with respect to the attraction belt is changeable.

15 Claims, 38 Drawing Sheets

(52) U.S. Cl.
CPC .. *B65H 2403/533* (2013.01); *B65H 2404/255* (2013.01); *B65H 2404/2693* (2013.01); *B65H 2511/214* (2013.01); *B65H 2515/81* (2013.01)

(58) Field of Classification Search
CPC ..... B65H 2404/232; B65H 2404/2321; B65H 2404/254; B65H 2404/2614; B65H 2404/2615; B65H 1/14; B65H 3/54
USPC ..... 271/18.1, 18.2, 114, 117, 118, 275, 3.21, 271/34, 94, 95, 10.06
See application file for complete search history.

(56) References Cited

U.S. PATENT DOCUMENTS 4,435,114 A 3/1984 Fardin
4,787,618 A * 11/1988 Martin ..... B65H 3/128 271/105
5,048,817 A 9/1991 Roller
5,106,077 A 4/1992 Kawaguchi et al.
8,177,217 B2 5/2012 Takahashi et al.
2010/0109227 A1 5/2010 Higaki et al.
2011/0204557 A1 8/2011 Ishikawa et al.
2011/0204558 A1 8/2011 Takahashi et al.
2011/0227275 A1 9/2011 Poh et al.
2012/0061903 A1 3/2012 Eguchi et al.
2012/0061904 A1 3/2012 Higaki et al.
2012/0170960 A1 7/2012 Nishida et al.
2012/0193861 A1* 8/2012 Takahashi ..... B65H 3/18 271/10.06
2012/0228817 A1 9/2012 Kobayashi et al.
2012/0230745 A1 9/2012 Kobayashi et al.
2012/0235346 A1* 9/2012 Ikeda ..... B65H 3/042 271/18.1
2012/0306146 A1 12/2012 Higaki et al.
2013/0300052 A1 11/2013 Nishida et al.
2014/0001699 A1* 1/2014 Ishikawa ..... B65H 3/18 271/18.1

* cited by examiner

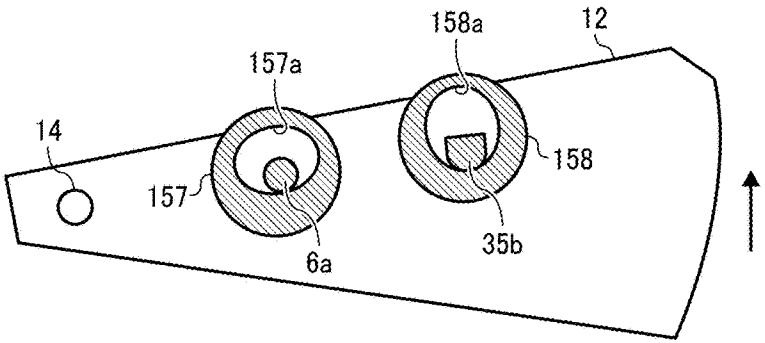
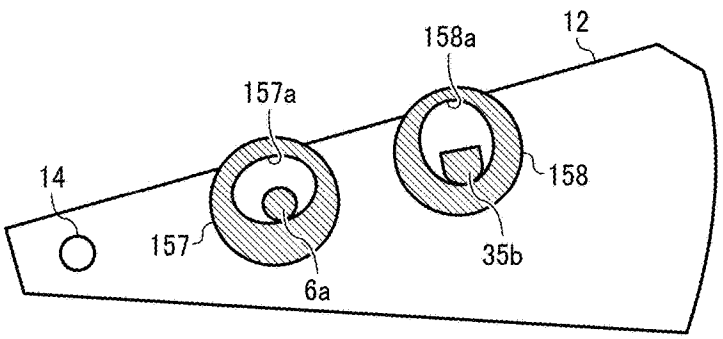
FIG. 39C
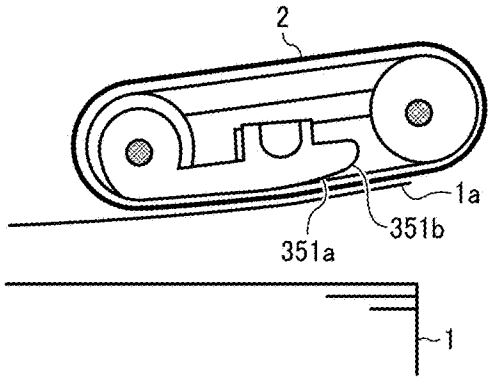
FIG. 39D
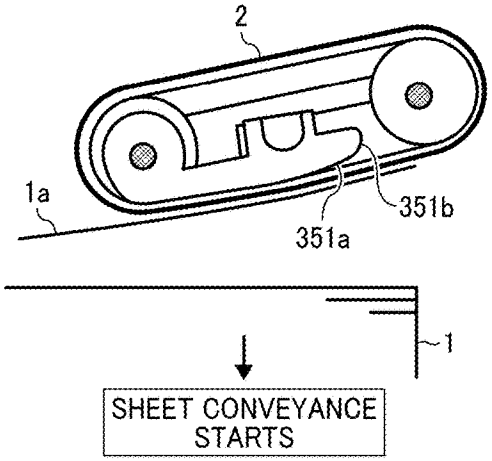

SHEET FEEDER AND IMAGE FORMING APPARATUS INCORPORATING SAME

CROSS-REFERENCE TO RELATED APPLICATIONS

This application is a continuation application of and claims priority under 35 U.S.C. § 120/121 to U.S. application Ser. No. 14/258,343 filed Apr. 22, 2014, which claims priority pursuant to 35 U.S.C. § 119 to Japanese Patent Application Nos. 2013-089706, filed on Apr. 22, 2013, 2013-153810, filed on Jul. 24, 2013, and 2013-253900, filed on Dec. 9, 2013 in the Japan Patent Office, the entire disclosures of which are hereby incorporated by reference herein.

BACKGROUND

Technical Field

Example embodiments relate to a sheet feeder and an image forming apparatus incorporating the sheet feeder.

Related Art

As an example of a sheet feeder that can be incorporated in the image forming apparatus, an electrostatic attraction/separation system has been proposed as a method of separating and conveying a sheet such as an original document and a recording medium loaded on a sheet tray. The electrostatic attraction/separation system generates an electric field on an attraction belt so that the sheet contacts the attraction belt and then separates from the attraction belt.

Japanese Patent Application Publication No. JP 2012-056711-A discloses a sheet feeder having the electrostatic attraction/separation system. The sheet feeder includes an attraction/separation unit including a dielectric attraction belt that is wound about two rollers, an electric charge applying unit that serves as an attraction unit to apply an alternating electric charge to the attraction belt, and a holder that holds the dielectric attraction belt and the electric charge applying unit. The holder rotatably supports the two rollers and is fixed to a rotary shaft that is disposed upstream from the two rollers in a sheet feeding direction. Further, the sheet feeder includes a swing unit to swing the attraction/separation unit about the rotary shaft so that the attraction belt reciprocally moves between a sheet contact position and a sheet separation position. The sheet contact position is a position at which the attraction belt contacts and attracts an uppermost sheet of a sheet stack loaded on a bottom plate of a sheet tray. The sheet separation position is a position away from the sheet contact position and where the uppermost sheet attracted to the attraction belt separates from the sheet stack to be conveyed for a subsequent image forming operation.

The two rollers are an upstream roller and a downstream roller.

The upstream roller is disposed upstream from the downstream roller in the sheet feeding direction and supported by the holder. Specifically, when the attraction/separation unit is moved from the sheet contact position to the sheet separation position, the upstream roller is supported by the holder rotatably within a given range such that the upstream roller continues to contact the upper surface of the sheet stack until the attraction/separation unit swings by a given angle and separates from the sheet stack together with the holder when the attraction/separation unit swings by a greater angle than the given angle of inclination.

By contrast, the downstream roller is disposed downstream from the upstream roller in the sheet feeding direction. Specifically, when the attraction/separation unit is moved from the sheet contact position to the sheet separation position, the downstream roller is supported by the holder so as to separate from the sheet stack together with the holder from the start of movement of the attraction/separation unit.

Prior to a sheet feeding operation, the attraction belt that is supported by the holder via the upstream roller and the downstream roller remains separated from the sheet stack. When the uppermost sheet is separated from the sheet stack to convey, the attraction belt is rotated before being applied with an alternating electric charge. The alternating electric charge is uniformly applied to the attraction belt, rotation of the attraction belt is stopped. Thereafter, the swing unit is driven to swing the attraction/separation unit toward the sheet stack. Then, the attraction belt contacts the uppermost sheet of the sheet stack, so that the uppermost sheet of the sheet stack is attracted to the attraction belt. At this time, the upstream roller is released from the holder and placed on the upper surface of the sheet stack.

When the uppermost sheet of the sheet stack is attracted to the surface of the attraction belt placed on the upper surface of the sheet stack, the swing unit is driven to swing the attraction/separation unit from the sheet contact position to the sheet separation position. When swing of the attraction/separation unit from the sheet contact position to the sheet separation position starts, the downstream roller moves in a direction to separate from the sheet stack together with the holder. By contrast, the upstream roller remains under its own gravity on the upper surface of the sheet stack with the attraction belt interposed therebetween. Accordingly, a downstream surface of the attraction belt downstream from the upstream roller in the sheet feeding direction is inclined with respect to the upper surface of the sheet stack. Therefore, a part of the uppermost sheet attracted to the surface of the attraction belt is lifted while being bent about a nip portion on the uppermost sheet pressed by the upstream roller with the attraction belt therebetween serving as a pivot. Thereafter, the upstream roller is lifted by the holder and moves together with the holder to separate from the upper surface of the sheet stack and move to the sheet separation position. When the attraction/separation unit reaches the sheet separation position, the attraction belt is rotated to convey the uppermost sheet that is attracted to the attraction belt.

By bending the uppermost sheet about the nip portion pressed by the upstream roller while sandwiching the attraction belt, a subsequent sheet attached to the uppermost sheet due to an adhesion force separates by the force of gravity from the uppermost sheet. When separating from the upper surface of the sheet stack, an angle of inclination of the downstream surface of the attraction belt and the upper surface of the sheet stack is different according to rigidity of sheet. A sheet having a high rigidity separates with a relatively small angle of inclination of the attraction belt while a sheet having a low rigidity separates with a relatively large angle of inclination of the attraction belt. If the large angle of inclination of the attraction belt for separating the low-rigidity sheet is employed for separating the high-rigidity sheet, even the uppermost sheet separates under its own rigidity from the attraction belt.

To address the inconvenience, the sheet feeder disclosed in JP 2012-056711-A provides different angles of inclination of the attraction belt with respect to the upper surface of the sheet stack according to sheet rigidity when the upstream roller separates from the sheet stack. Specifically, the sheet feeder disclosed in JP 2012-056711-A includes a unit to change a range of movement of the upstream roller with respect to the holder according to sheet rigidity. With this unit, as the rigidity of a sheet to be conveyed increases, the range of movement of the upstream roller with respect to the holder decreases. Therefore, as the rigidity of sheet to be conveyed increases, the upstream roller can be lifted by the holder with a small angle of inclination of the attraction belt. Accordingly, when handling a sheet having a large rigidity, separation of the uppermost sheet from the attraction belt can be prevented.

As described above, by changing the angle of inclination of the attraction belt according to sheet rigidity when separating the upstream roller from the sheet stack, the sheet feeder disclosed in JP 2012-056711-A can obtain a good separation performance regardless of various sheet rigidities.

However, when the sheet feeder disclosed in JP 2012-056711-A feeds a thin paper having a low rigidity, the uppermost sheet occasionally does not separate from a subsequent sheet of the sheet stack. After the research and study of the problem, it was found that sheet separation is significantly affected by a curvature of a curved part of the sheet than an angle of inclination of the attraction belt. Specifically, by increasing the curvature of the curved part of the sheet and bending the sheet more tightly as rigidity of the sheet decreases, the uppermost sheet can separate from the subsequent sheet reliably. Since the sheet feeder disclosed in JP 2012-056711-A bends the sheet due to the curvature of the upstream roller, when a thin paper having a low rigidity is used, the subsequent sheet cannot be separated from the uppermost sheet.

To increase the curvature of a curved part of the sheet, a diameter of the upstream roller can be decreased. However, even a thick paper having a large rigidity is bent tight by the upstream roller having the smaller diameter. Accordingly, it is likely that the uppermost sheet also separates from the attraction belt due to the rigidity of the uppermost sheet.

SUMMARY

At least one example embodiment provides a sheet feeder including an endless attraction belt that is rotatably disposed facing a top surface of a sheet stack, a belt charger to attract an uppermost sheet of the sheet stack, and a sheet separator to press the attraction belt against the sheet stack, bend a contact region to which the uppermost sheet is attracted and contacted to the attraction belt, and separate the uppermost sheet from a subsequent sheet of the sheet stack. A curvature of a contact surface of the sheet separator with respect to the attraction belt is changeable.

Further, at least one example embodiment provides an image forming apparatus including an image forming unit and the above-described sheet feeder.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein:

FIGS. 39A through 39D are diagrams illustrating a series of sheet separating operations of a thick paper in the configuration of FIG. 34;

DETAILED DESCRIPTION

Figure 1:
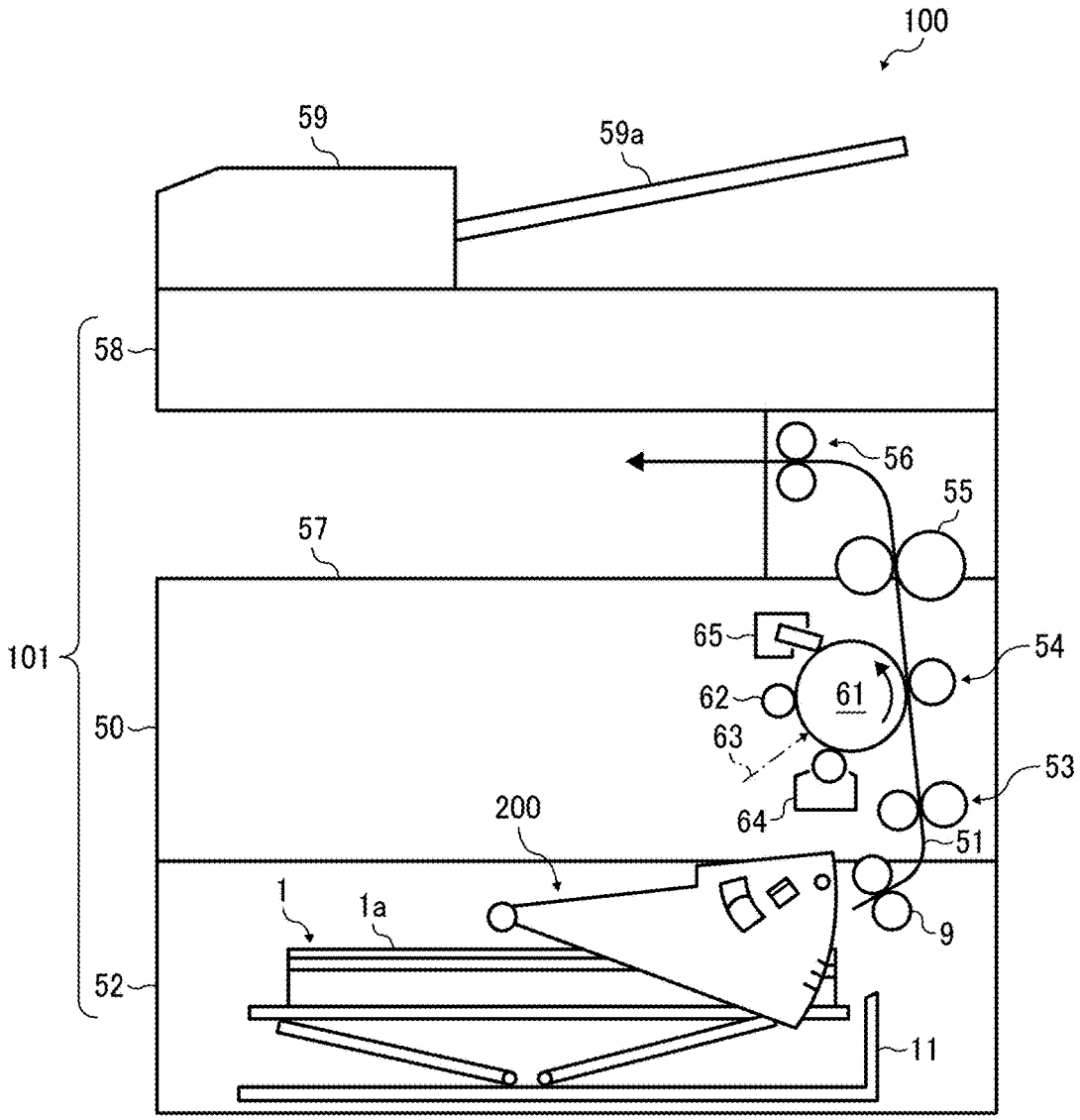
FIG. 1 is a schematic diagram illustrating a configuration of an image forming apparatus according to an example embodiment.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the present invention. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the present invention.

Example embodiments are applicable to any image forming apparatus, and are implemented in the most effective manner in an electrophotographic image forming apparatus.

In describing preferred example embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred example embodiments are described.

Specifically, a description is given of an image forming apparatus 100 according to an example embodiment with reference to the drawings.

The image forming apparatus 100 may be a copier, a facsimile machine, a printer, a plotter, a multifunction peripheral or a multifunction printer (MFP) having at least one of copying, printing, scanning, facsimile, and plotter functions, or the like. The image forming apparatus 100 may form an image by an electrophotographic method, an inkjet method, or any other suitable method. According to the present embodiment, the image forming apparatus 100 is an electrophotographic printer that forms toner images on a recording medium or recording media by electrophotography.

Further, it is to be noted in the following embodiments that the term "sheet" is not limited to indicate a paper material but also includes OHP (overhead projector) transparencies, OHP film sheets, coated sheet, thick paper such as post card, thread, fiber, fabric, leather, metal, plastic, glass, wood, and/or ceramic by attracting developer or ink thereto, and is used as a general term of a recorded medium, recording medium, recording sheet, and recording material to which the developer or ink is attracted.

A description is given of a configuration of the image forming apparatus 100 according to an embodiment, with reference to FIG. 1.

In FIG. 1, the image forming apparatus 100 includes an automatic document feeder (ADF) 59, a document reader 58, a sheet supplying device 52, and an image forming device 50. The document reader 58, the sheet supplying device 52, and the image forming device 50 are accommodated in an apparatus body 101.

The ADF 59 is mounted on the document reader 58. The ADF 59 includes a document sheet tray 59*a* to hold a document stack thereon. The ADF 59 separates each document one by one from the document stack placed on the document sheet tray 59*a* to automatically feed the separated document onto an exposure glass mounted on the document reader 58.

The document reader 58 reads image data of the document fed from the ADF 59 on the exposure glass.

The image forming device 50 forms an image on a sheet functioning as a recording medium supplied by the sheet supplying device 52 according to the image data of the document read in the document reader 58.

The sheet supplying device 52 is disposed below the image forming device 50. The sheet supplying device 52 accommodates a sheet stack 1 or recording media therein to supply an uppermost sheet 1*a* that is picked up from the sheet stack 1, to the image forming device 50.

The image forming device 50 includes a photoconductor 61 that functions as an image carrier, and image forming components disposed around the photoconductor 61. The image forming components are, for example, a photoconductor charger 62, a development unit 64, a transfer unit 54, and a photoconductor cleaning unit 65. The image forming device 50 further includes an optical writing unit to emit laser light 63 to the photoconductor 61 and a fixing unit 55 to fix a toner image to a sheet that serves as a recording medium.

The image forming device 50 performs the following image forming operations. As the photoconductor 61 rotates, the photoconductor charger 62 uniformly charges a surface of the photoconductor 61. The optical writing unit emits the laser light 63 to the surface of the photoconductor 61. By so doing, the surface of the photoconductor 61 is irradiated by the laser light 63 based on image data inputted from a personal computer or a word processor or image data of an original document read by the document reader 58, so that an electrostatic latent image is formed on the surface of the photoconductor 61. Thereafter, the development unit 64 supplies toner to the electrostatic latent image to develop the electrostatic latent image into a toner image formed on the surface of the photoconductor 61.

The sheet supplying device 52 separates sheets one by one and conveys a sheet toward a registration roller pair 53. The sheet abuts against the registration roller pair 53 to stop there. In synchronization with timing of image formation in the image forming device 50, the sheet abutted and stopped at the registration roller pair 53 is conveyed to a transfer area where the photoconductor 61 and the transfer unit 54 are disposed facing each other. The toner image formed on the surface of the photoconductor 61 is transferred onto the sheet in the transfer area. The fixing unit 55 fixes the toner image transferred onto the sheet to the sheet, and the sheet is conveyed by a sheet discharging roller pair 56 to a sheet discharging tray 57. After transfer of the toner image onto the sheet, the photoconductor cleaning unit 65 cleans the surface of the photoconductor 61 by removing residual toner remaining on the surface of the photoconductor 61 to be ready for a subsequent image forming operation. The sheet supplying device includes a sheet tray 11 and a sheet feeder 200, which will be described below. A sheet conveying path 51 is where the sheet is conveyed from the sheet supplying device 52 to the sheet discharging tray 57. The sheet conveying path 51 is basically defined by the rollers from a sheet conveying roller pair 9 to the sheet discharging roller pair 56.

Figure 2:
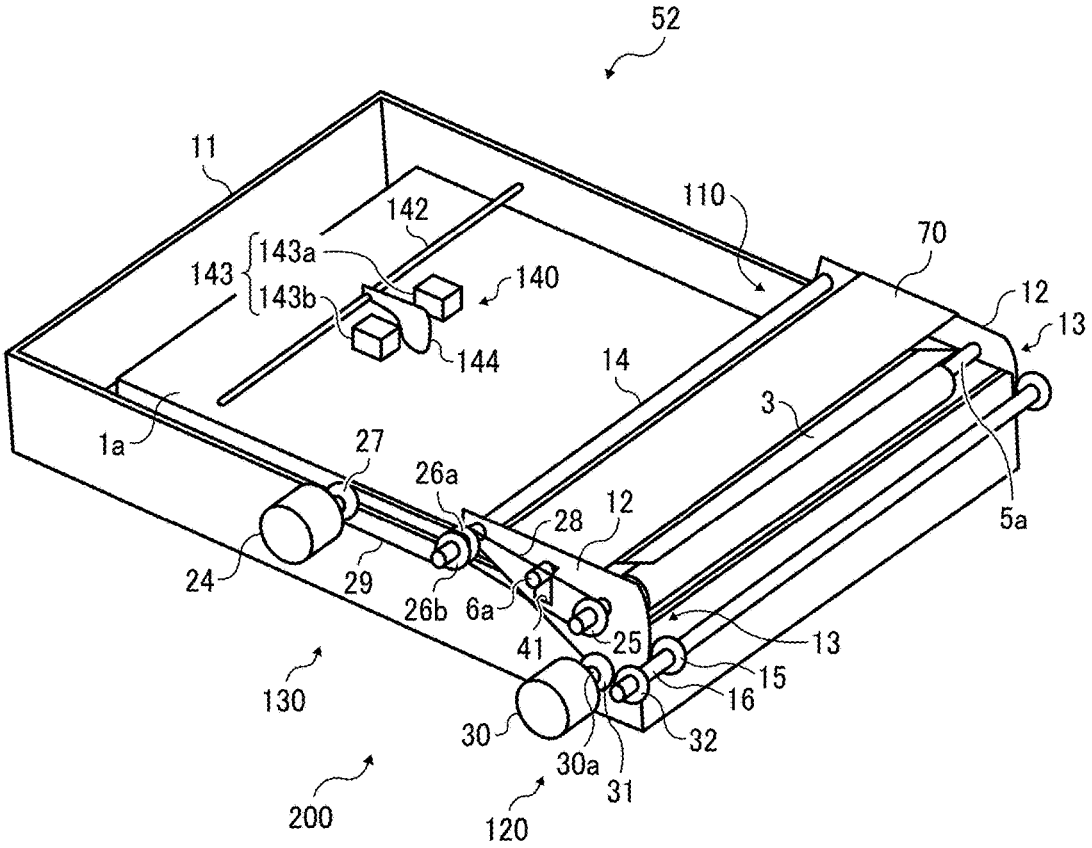
FIG. 2 is a perspective view of a sheet supplying device incorporated in the image forming apparatus.
Figure 3:
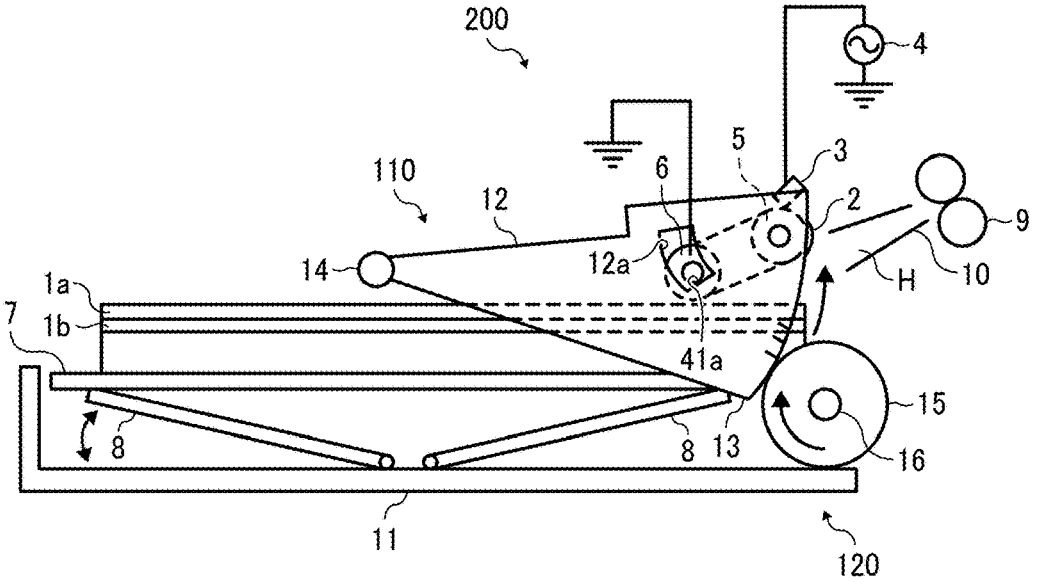
FIG. 3 is a diagram illustrating a configuration of the sheet supplying device.

FIG. 2 is a perspective view illustrating a schematic configuration of the sheet supplying device 52. FIG. 3 is a side view illustrating the sheet supplying device 52. FIG. 4 is a diagram illustrating a detailed configuration of the sheet attraction/separation unit 110.

As previously described, the sheet supplying device 52 includes the sheet tray 11 and the sheet feeder 200. The sheet tray 11 functions as a sheet container to accommodate a sheet stack 1 of multiple sheets. The sheet feeder 200 separates and conveys the uppermost sheet 1*a* placed on top of the sheet stack 1 on the sheet tray 11.

As illustrated in FIG. 3, the sheet tray 11 includes a bottom plate 7 on which the sheet stack 1 is loaded. Plate supporting members 8 are rotatably provided between a bottom surface of the sheet tray 11 and the bottom plate 7 to support the bottom plate 7. Further, as illustrated in FIG. 2, the sheet supplying device 52 includes a sheet detector 140 to detect that the uppermost sheet 1*a* of the sheet stack 1 has reached a given position.

The sheet detector 140 includes a shaft 142, a thru-beam optical sensor 143, and a feeler 144. The feeler 144 is rotatably supported by the shaft 142 attached to the apparatus body 101. The thru-beam optical sensor 143 includes a light receiving element 143*a* and a light emitting element 143*b*.

As a drive motor drives the plate supporting member 8 to lift the bottom plate 7, the sheet stack 1 loaded on the bottom plate 7 is elevated so that the uppermost sheet 1*a* contacts the feeler 144. At this time, the light receiving element 143*a* of the thru-beam optical sensor 143 receives light emitted by the light emitting element 143*b*.

As the bottom plate 7 is further lifted, the feeler 144 blocks the light from the light emitting element 143*b*, by which the light receiving element 143*a* is prevented from receiving the light. Consequently, the sheet detector 140 detects that the uppermost sheet 1*a* of the sheet stack 1 has reached the given position, and movement of the plate supporting member 8 is stopped.

Figure 4A:
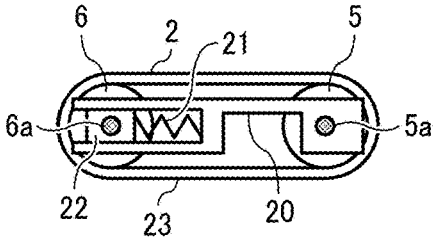
FIG. 4A is a diagram illustrating a schematic configuration of an attraction/separation unit.

The sheet feeder 200 includes the sheet attraction/separation unit 110, a swing unit 120, and a belt drive unit 130. The swing unit 120 that functions as a movable unit to swing the sheet attraction/separation unit 110. The belt drive unit 130 rotates the attraction belt 2 as an endless loop. As illustrated in FIG. 4A, the sheet attraction/separation unit 110 includes the attraction belt 2 that is stretched about a downstream tension roller 5 and an upstream tension roller 6.

The attraction belt 2 has a multilayer construction that includes a front surface layer and a back surface layer. The front surface layer of the attraction belt 2 is a polyethylene terephthalate film having a thickness of about 50 μm and has a resistivity of $10^8$ Ω·cm minimum. The back surface layer of the attraction belt 2 is made of aluminum-deposited dielectric material having a resistivity of $10^6$ Ω·cm maximum.

With the above-described multilayer construction of the attraction belt 2, the back layer of the attraction belt 2 can be used as a grounded opposite electrode, and a belt charger 3 and an attraction member to apply electrical charge to the attraction belt 2 can be disposed at any position that contacts the front surface layer of the attraction belt 2. Further, ribs 23 (refer to FIG. 4A) are provided within both edges in a belt width direction of the attraction belt 2 preventing meandering of the attraction belt 2. The ribs 23 are engaged with the downstream tension roller 5 and the upstream tension roller 6 to prevent meandering of the attraction belt 2.

The downstream tension roller 5 has a conductive rubber layer as a front surface layer having a resistivity of about $10^6$ Ω·cm. The upstream tension roller 6 is a metallic roller. The downstream tension roller 5 and the upstream tension roller 6 are electrically grounded.

The downstream tension roller 5 has a small diameter suitable for separating the sheet from the attraction belt 2 due to the curvature. That is, the diameter of the downstream tension roller 5 is formed relatively small to make the curvature relatively large, and thus the sheet attracted and conveyed by the attraction belt 2 can be separated from the downstream tension roller 5 and conveyed into a path H defined by a guide member 10 disposed downstream from the downstream tension roller 5 in the sheet conveyance direction.

Figure 4B:
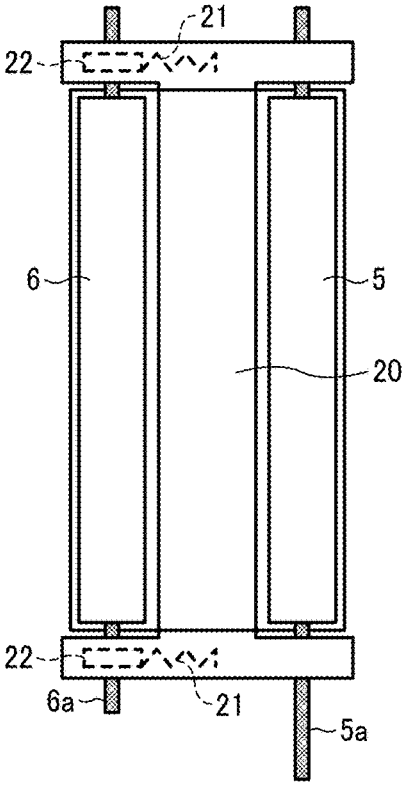
FIG. 4B is a top view illustrating a schematic configuration of the attraction/separation unit.

As illustrated in FIGS. 4A and 4B, the downstream tension roller 5 has a shaft 5*a* and the upstream tension roller 6 has a shaft 6*a*. The shaft 5*a* of the downstream tension roller 5 is rotatably supported by a housing 20. The shaft 6*a* of the upstream tension roller 6 is rotatably supported by a bearing 22 that is slidably held in the sheet feeding direction with respect to a housing body 20*a* of the housing 20. The bearing 22 is biased by a spring 21 toward an upstream side in the sheet feeding direction. Consequently, the upstream tension roller 6 is biased toward the upstream side in the sheet feeding direction to apply tension to the attraction belt 2.

Figure 5:
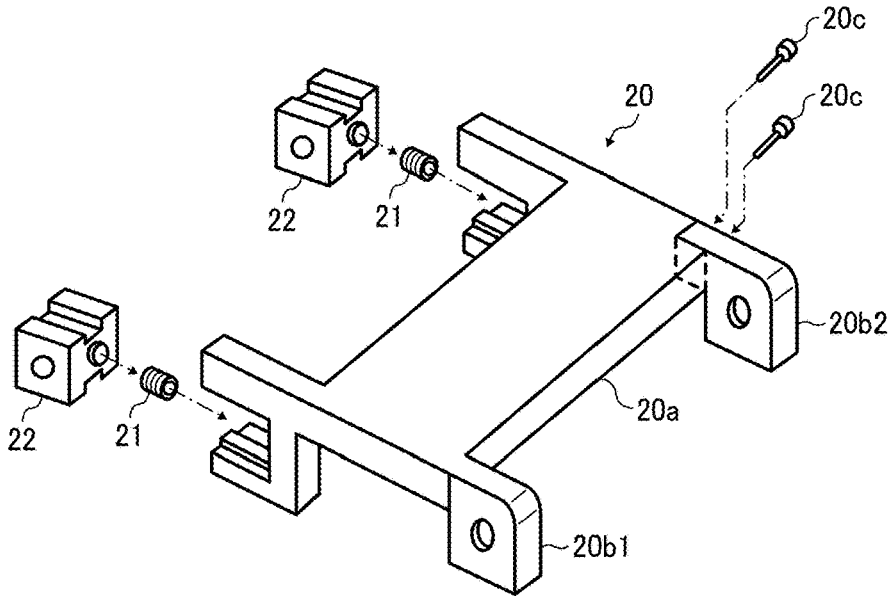
FIG. 5 is an exploded view illustrating a housing of the attraction/separation unit.

FIG. 5 is an exploded view illustrating the housing 20 on which the downstream tension roller 5 and the upstream tension roller 6 are mounted.

As shown in FIG. 5, the housing 20 includes a housing body 20*a* and two shaft holes 20*b*1 and 20*b*2. The shaft holes 20*b*1 and 20*b*2 support the shaft 5*a* of the downstream tension roller 5 by passing the shaft 5*a* therethrough. The shaft hole 20*b*2 is provided on a separable body that is detachably attached to the housing body 20*a*. The shaft hole 20*b*2 formed on the separable body is attached with fixing screws 20*c* to the housing body 20*a* on which the shaft hole 20*b*1 is formed.

When assembling the shaft 5*a* of the downstream tension roller 5 to the housing 20, after the separable body having the shaft hole 20*b*2 thereon is detached from the housing body 20*a*, the shaft 5*a* of the downstream tension roller 5 is inserted into the shaft hole 20*b*1 on the housing body 20*a* so that the shaft 5*a* of the downstream tension roller 5 is rotatably supported. Then, while the shaft 5*a* of the downstream tension roller 5 is being inserted into the shaft hole 20*b*2 of the separable body that is detached from the housing body 20*a*, the shaft hole 20*b*2 is fixed to the housing body 20*a* with the fixing screws 20*c*.

As illustrated in FIGS. 2 and 3, the sheet attraction/separation unit 110 includes brackets 12 at both ends in the belt width direction of the attraction belt 2 to rotatably hold the attraction belt 2. Each bracket 12 is rotatably supported by a supporting shaft 14 that is disposed upstream from the upstream tension roller 6 in the sheet feeding direction. With this configuration, the sheet attraction/separation unit 110 is driven by a swing unit 120, which is described below, to pivot on the supporting shaft 14 between a sheet contact position and a sheet separation position.

The sheet contact position is a position at which the attraction belt 2 contacts and attracts the uppermost sheet 1*a* of the sheet stack 1. The sheet separation position is a position away from the sheet contact position and where the uppermost sheet 1*a* attracted to the attraction belt 2 separates from the sheet stack 1 to be conveyed for a subsequent image forming operation.

A slot 12*a* is formed on each bracket 12. The shaft 6*a* of the upstream tension roller 6 is inserted into the slot 12*a*, by which the shaft 6*a* is rotatably supported by the bracket 12 to move along the slot 12*a*. By contrast, the shaft 5*a* of the downstream tension roller 5 is inserted into a different slot formed on each bracket 12, by which the shaft 5*a* is fixedly held by the bracket 12. As illustrated in FIG. 3, when the sheet attraction/separation unit 110 is at the sheet separation position, the shaft 6*a* of the upstream tension roller 6 remains abutted against a lower end surface 41*a* of the slot 12*a*.

To prevent variation of the distance between the center of rotation of the upstream tension roller 6 and the center of rotation of the downstream tension roller 5, the respective slots 12*a* on the brackets 12 are formed in a shape of an arc, the center of which corresponds to the center of rotation of the downstream tension roller 5. As a result, even if the upstream tension roller 6 moves along the slots 12*a*, the distance between the center of rotation of the upstream tension roller 6 and the center of rotation of the downstream tension roller 5 can remain same and the tension of the attraction belt 2 can also remain.

Generally, when the attraction belt 2 has a tension of 5 N or smaller, the attraction belt 2 rotates without slipping on the downstream tension roller 5 and the upstream tension roller 6, so that the uppermost sheet 1*a* attracted to the attraction belt 2 can be conveyed.

By contrast, when conveying special sheets such as sheets having a high adhesion, it is likely that the attraction belt 2 slips on the downstream tension roller 5 and the upstream tension roller 6. To address the inconvenience, it is preferable to increase respective coefficients of friction on the surface of the upstream tension roller 6 and the surface of the downstream tension roller 5 to prevent slippage of the attraction belt 2 with respect to the downstream tension roller 5 and the upstream tension roller 6.

Figure 6:
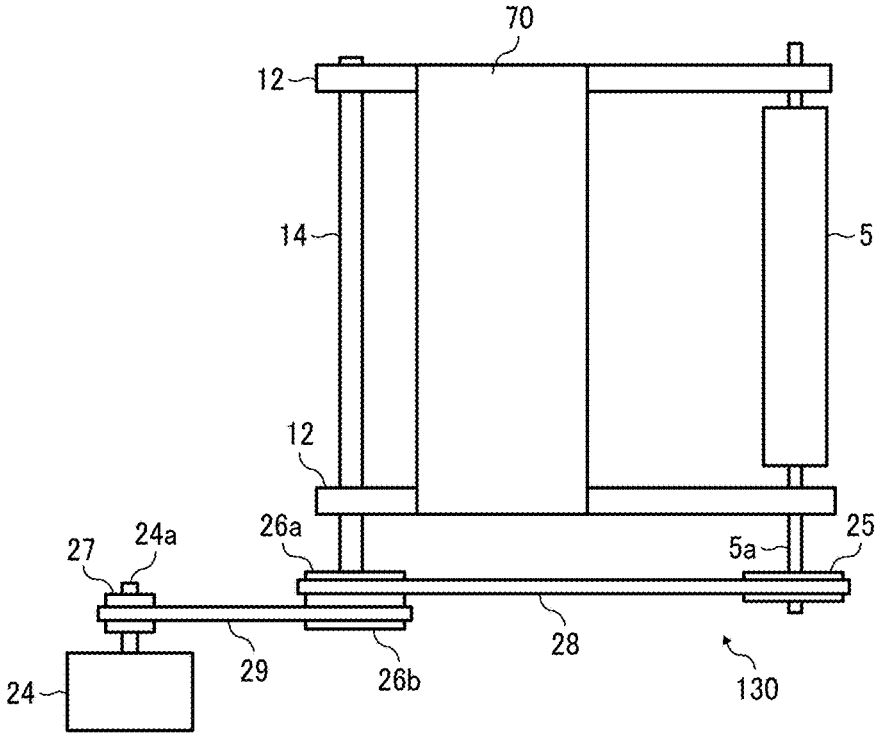
FIG. 6 is a schematic diagram illustrating a drive unit that rotates an attraction belt incorporated in the attraction/separation unit.

FIG. 6 is a schematic diagram of the belt drive unit 130 that rotates the attraction belt 2.

As illustrated in FIG. 6, a first driven pulley 26*a* and a second drive pulley 26*b* are attached to one end of the supporting shaft 14 that rotatably supports each bracket 12. A second driven pulley 25 is attached to one end of the downstream tension roller 5. A driven timing belt 28 is wound around the first driven pulley 26*a* and the second driven pulley 25.

A drive motor 24 is disposed upstream from the supporting shaft 14 in the sheet feeding direction. A first drive pulley 27 is attached to a motor shaft 24*a* of the drive motor 24. A drive timing belt 29 is wound around the first drive pulley 27 and the second drive pulley 26*b*.

As the drive motor 24 drives, the downstream tension roller 5 rotates via the drive timing belt 29 and the driven timing belt 28. Rotation of the downstream tension roller 5 rotates the attraction belt 2, by which the upstream tension roller 6 is rotated due to friction along with an inner circumferential surface of the attraction belt 2.

Further, in the present embodiment, a driving force of the drive motor 24 is transmitted to the downstream tension roller 5 via the supporting shaft 14 that supports the brackets 12. With this configuration, the sheet attraction/separation unit 110 pivots on the supporting shaft 14. Therefore, even if the sheet attraction/separation unit 110 swings, the distance between the downstream tension roller 5 and the supporting shaft 14 remains unchanged. Accordingly, the tension of the driven timing belt 28 can be maintained and the driving force can be well transmitted to the downstream tension roller 5.

It is to be noted that the configuration of the belt drive unit 130 is not limited thereto but can transmit the driving force from the drive motor 24 to the upstream tension roller 6 and employ the upstream tension roller 6 as a drive roller that rotates the attraction belt 2.

Further, as illustrated in FIGS. 2 and 3, the swing unit 120 that swings the brackets 12 is disposed downstream from the sheet supplying device 52 in the sheet feeding direction. The swing unit 120 includes a rack gear 13 and a pinion gear 15. The rack gear 13 functions as a first drive transmitter disposed at one downstream end of each bracket 12 in the sheet feeding direction. The pinion gear 15 functions as a second drive transmitter that is fixed to the rotary shaft 16 and meshes with the rack gear 13. The swing unit 120 further includes a swing motor 30. A driven gear 32 is disposed at one end of the rotary shaft 16. The driven gear 32 meshes with a motor gear 31 that is attached to a motor shaft 30*a* of the swing motor 30.

The pinion gears 15 provided corresponding to the respective brackets 12 are attached to the rotary shaft 16 that rotates coaxially with the pinion gears 15. With this configuration, rotation of the rotary shaft 16 by the swing motor 30 rotates the pinion gears 15. By so doing, a single unit of the swing motor 30 can rotate these two pinion gears 15 disposed at both ends in the belt width direction of the attraction belt 2. Therefore, the number of components of the image forming apparatus 100 can be decreased, which can reduce the cost of the image forming apparatus 100. In addition, driving of the rack and pinion mechanism disposed at both ends in the belt width direction of the attraction belt 2 can be synchronized with a simple configuration as described above.

The rack gear 13 is an R-shaped gear rotating about the supporting shaft 14. The rack gears 13 arranged on the respective brackets 12 pivots on the supporting shaft 14 when the sheet attraction/separation unit 110 swings. Therefore, the R-shaped rack gears 13 that rotate about the supporting shaft 14 can keep the rack gear 13 and the pinion gear 15 meshed when the sheet attraction/separation unit 110 swings. Further, by arranging the rack gear at the downstream end of the bracket 12 in the sheet feeding direction, the number of components can be decreased and a simpler configuration can be achieved when compared with a configuration in which a rack gear separate from the bracket 12 is attached to the bracket 12. Furthermore, since the pinion gears 15 of the rack and pinion mechanism of the swing unit 120 are provided to the apparatus body 101 of the image forming apparatus 100, a simpler configuration for transmit a driving force to the pinion gears 15 can be achieved when compared with a configuration in which the pinion gears 15 are provided to the sheet attraction/separation unit 110.

By driving the swing motor 30 in the swing unit 120 having this configuration, the pinion gear 15 rotates to cause the rack gear 13 to move in a direction to separate from the sheet stack 1. This movement of the rack gear 13 rotates the pinion gear 15 to move away from the sheet stack 1. Accordingly, the bracket 12 pivots on the supporting shaft 14.

The brackets 12 are fixed and connected to each other by a reinforcement member 70. By fixing the brackets 12 via the reinforcement member 70, one bracket 12 can swing together with the other bracket 12 integrally. This configuration can reduce twist of the attraction belt 2 held by the brackets 12 and can prevent the uppermost sheet 1*a* attracted to the attraction belt 2 form separating from the attraction belt 2.

Figure 7:
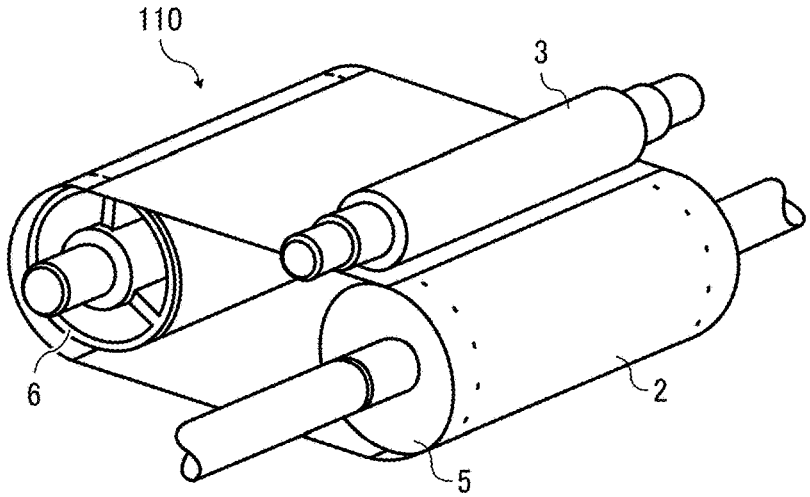
FIG. 7 is a perspective view illustrating a detailed configuration of the attraction/separation unit.

As illustrated in FIG. 7, the roller-shaped belt charger 3 that functions as a belt charger to uniformly charge the surface of the attraction belt 2 contacts the surface of the attraction belt 2. The charging member 3 is rotatably attached to the sheet attraction/separation unit 110. A position of the charging member 3 is determined uniquely with respect to the attraction belt 2. Further, the charging member 3 is connected to a power supply 4 that generates alternating current.

Figure 8:
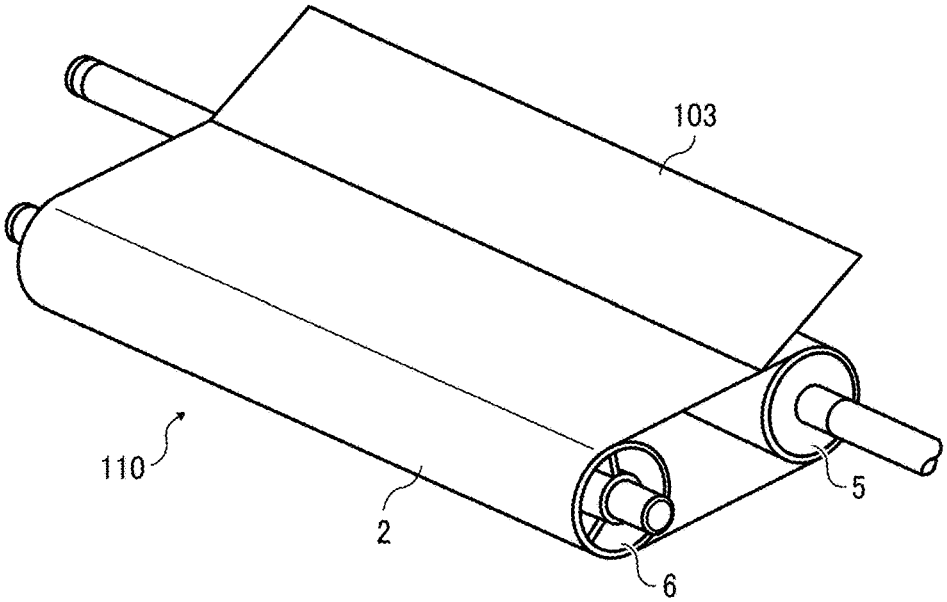
FIG. 8 is a perspective view illustrating a variation of the configuration of the attraction/separation unit.

Alternative to the roller-shaped charging member 3 used in the present embodiment, a blade-shaped electrode 103 can be used as illustrated in FIG. 8. With the blade-shaped electrode 103, charge patterns having narrow pitches can be formed, when compared with the roller-shaped charging member 3. Accordingly, a fast increase in attraction force with respect to the uppermost sheet 1*a* of the sheet stack 1 loaded on the sheet tray 11*a* and a fast decrease in attraction force with respect to the subsequent sheet can be obtained. Consequently, a period of a sheet separation operation can be shorter. Further, the pitches of the alternating charged pattern on the surface of the attraction belt 2, and therefore, even when there are fine waves or unevenness on the attraction belt 2, the surface of the attraction belt 2 can be charged stably.

Next, a description is given of basic sheet conveying operations performed by the sheet feeder 200 according to the present embodiment, with reference to FIGS. 9A through 9E.

Figure 9A:
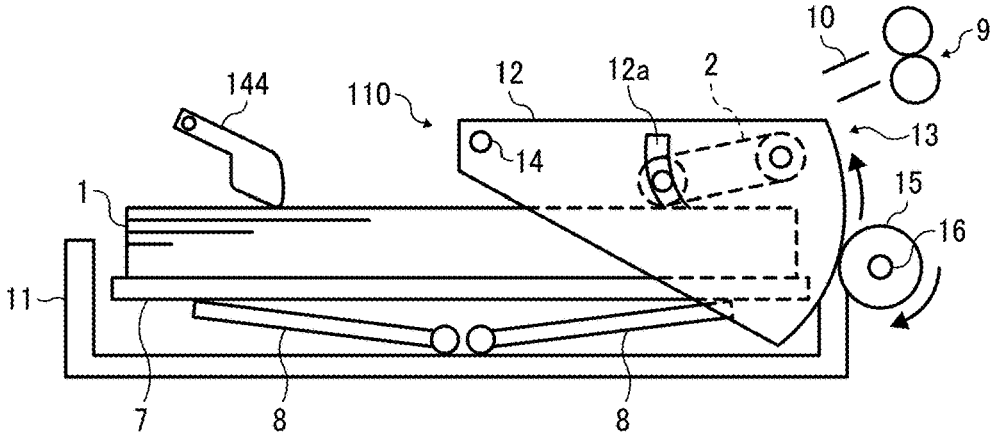
FIGS. 9A through 9E are diagrams illustrating a series of a sheet feeding operation performed by a sheet feeder.

As illustrated in FIG. 9A, the bottom plate 7 is located at the lower position and the sheet attraction/separation unit 110 stands by at the sheet contact position. Upon receipt of the sheet feeding signal, the swing motor 30 (refer to FIG. 2) is driven to rotate the pinion gear 15 clockwise in FIG. 9A. Then, the sheet attraction/separation unit 110 pivots on the supporting shaft 14 counterclockwise in FIG. 9A or in a direction to separate from the sheet stack 1. When the sheet attraction/separation unit 110 reaches the sheet separation position, driving of the swing motor 30 is stopped.

Figure 9B:
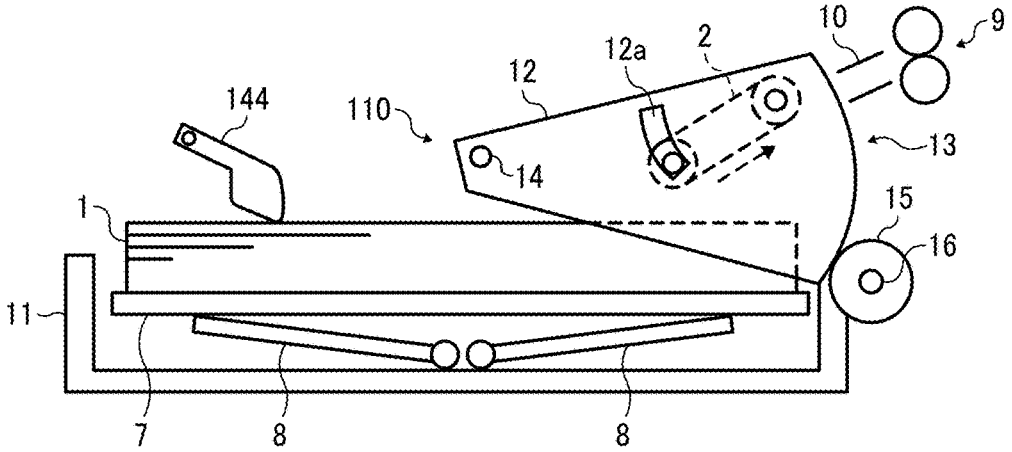

As illustrated in FIG. 9B, at the stop of the sheet attraction/separation unit 110 at the sheet separation position, the drive motor 24 is driven to move the attraction belt 2 endlessly. Then, the attraction belt 2 is supplied with an alternating voltage by the power supply 4 via the charging member 3. An outer circumferential surface of the attraction belt 2 is formed with charge patterns that alternate with a pitch according to the frequency of the alternating-current power supply and the rotation speed of the attraction belt 2. Preferably, the pitch is set from approximately 5 mm to approximately 15 mm. As well as the alternating-current voltage, the alternating-current power supply 4 may also provide a direct-current voltage alternated between high and low potentials. In this embodiment, the outer circumferential surface of the attraction belt 2 is applied with a sine wave and a rectangular-wave voltage having an amplitude of approximately 4 kV (kilovolts).

Figure 9C:
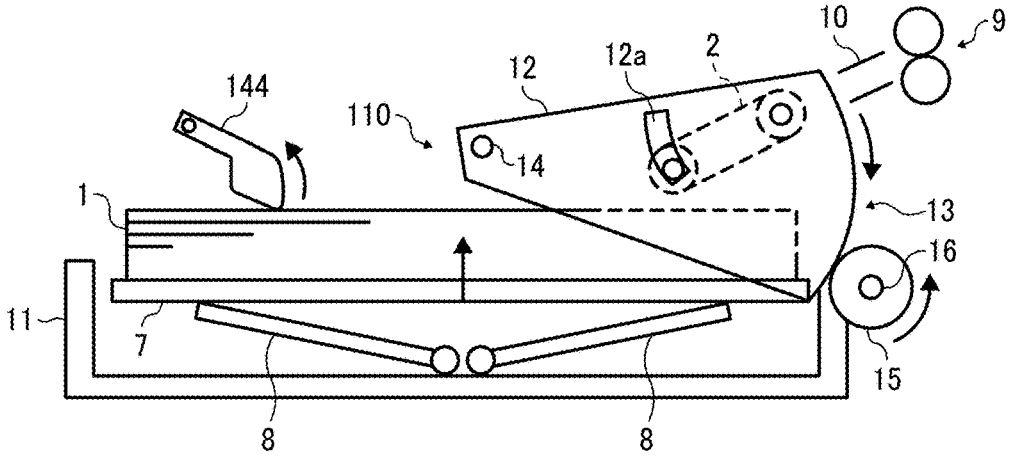

After completion of charging the attraction belt 2, rotation of the attraction belt 2 is stopped and elevation of the bottom plate 7 that stands by at a lower position is started, as illustrated in FIG. 9C. Almost simultaneously, the swing motor 30 is reversely driven to rotate the pinion gear 15 counterclockwise in FIG. 9C. With this action, the sheet attraction/separation unit 110 pivots on the supporting shaft 14 clockwise or in a direction to approach the sheet stack 1 in FIG. 9C.

As the bottom plate 7 ascends and the sheet attraction/separation unit 110 descends, the uppermost sheet 1*a* of the sheet stack 1 contacts the upstream tension roller 6 via the attraction belt 2. As the bottom plate 7 further ascends and the sheet attraction/separation unit 110 further descends, the upstream tension roller 6 is pushed up by the sheet stack 1. Accordingly, the upstream tension roller 6 remaining in contact with the lower end surface 41*a* of the slot 12*a* moves upwardly along the slot 12*a*. Further, along with elevation of the bottom plate 7, the feeler 144 rotates counterclockwise in FIG. 9C. When the uppermost sheet 1*a* of the sheet stack 1 reaches the given position, the feeler 144 blocks the light emitted by the light emitting element 143*b* of the thru-beam optical sensor 143. With this action, the thru-beam optical sensor 143 of the sheet detector 140 detects that the uppermost sheet 1*a* of the sheet stack 1 has reached the given position, and elevation of the bottom plate 7 stops.

Further, when the sheet attraction/separation unit 110 reaches the sheet contact position, the swing motor 30 stops rotating. In a case in which the swing motor 30 is a stepping motor, the swing motor 30 is controlled based on the angle of rotation (the number of pulses). By so doing, the sheet attraction/separation unit 110 can stop at the sheet contact position with accuracy. In a case in which the swing motor 30 is a DC motor, the swing motor 30 is controlled based on the driving period, so that the sheet attraction/separation unit 110 can stop at the sheet contact position with accuracy.

Figure 9D:
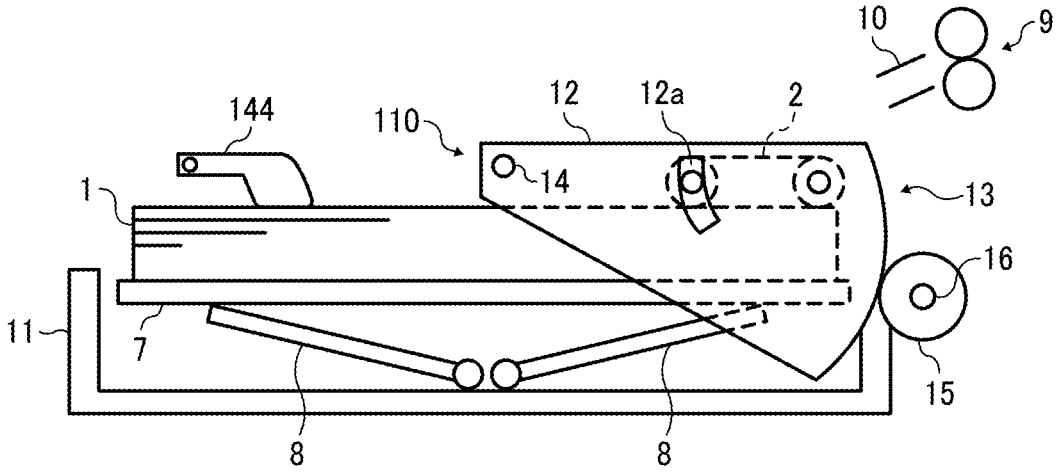

As illustrated in FIG. 9D, elevation of the bottom plate 7 stops, and descending (swinging) of the sheet attraction/separation unit 110 then stops. In this state, a portion of the attraction belt 2 facing the upper surface of the sheet stack 1 contacts the uppermost sheet 1*a* of the sheet stack 1.

As the attraction belt 2 thus comes into contact with the uppermost sheet 1*a*, Maxwell stress acts on the uppermost sheet 1*a*, which is a dielectric material, due to the electrical field generated by the charge patterns formed on the outer circumferential surface of the attraction belt 2. As a result, the uppermost sheet 1*a* of the sheet stack 1 is attracted to the attraction belt 2.

After the sheet attraction/separation unit 110 stands by for a predetermined time in the state illustrated in FIG. 9D and the uppermost sheet 1*a* is attracted to the attraction belt 2, the swing motor 30 is driven to rotate the pinion gear 15 clockwise so as to rotate the sheet attraction/separation unit 110 on the supporting shaft 14 counterclockwise in FIG. 9D. Then, the downstream tension roller 5 moves together with the bracket 12 in a direction to separate from the sheet stack 1.

By contrast, the upstream tension roller 6 does not move from the upper surface of the sheet stack 1 due to the weight thereof, and moves away from the bracket 12 and toward the sheet stack 1. With this configuration, the surface of the attraction belt 2 separates from the upper surface of the sheet stack 1 so that the surface of the attraction belt 2 in contact with the upper surface of the sheet stack 1 is slanted with respect to the upper surface of the sheet stack 1. Consequently, the sheet attached to the attraction belt 2 is bent and a part of the uppermost sheet 1*a* attracted to the surface of the attraction belt 2 is turned from the upper surface of the sheet stack 1 together with swing of the attraction belt 2. As a result, the restorative force acts on the sheet attracted to the attraction belt 2. Accordingly, only the uppermost sheet 1*a* is attracted to the attraction belt 2, and a subsequent sheet 1*b* is separated from the attraction belt 2 by the restorative force of the sheet.

When the sheet attraction/separation unit 110 is further rotated about the supporting shaft 14 counterclockwise in FIG. 9D, the shaft 6*a* of the upstream tension roller 6 abuts against the lower end surface 41*a* of the slot 12*a* formed on the bracket 12. When the sheet attraction/separation unit 110 is further rotated in the sheet contact state of the upstream tension roller 6 contacting the lower end surface 41*a* of the slot 12*a*, the upstream tension roller 6 moves together with the bracket 12 to separate from the upper surface of the sheet stack 1.

Figure 9E:
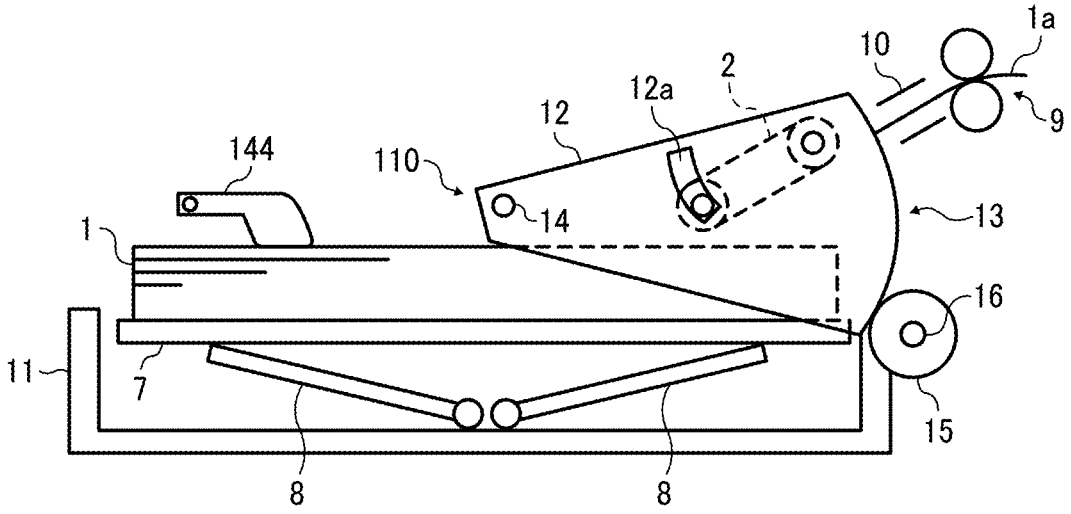

Then, as illustrated in FIG. 9E, when the sheet attraction/separation unit 110 reaches the sheet separation position to convey the sheet further, the driving of the swing motor 30 is stopped. After the swing motor 30 is stopped, the drive motor 24 is turned on to move the attraction belt 2 endlessly, so as to convey the uppermost sheet 1*a* attracted to the attraction belt 2 toward the sheet conveying roller pair 9. As the leading edge of the uppermost sheet 1*a* electrostatically attracted to the attraction belt 2 reaches a corner where the inner circumferential surface of the attraction belt 2 contacting the downstream tension roller 5, the uppermost sheet 1*a* separates from the attraction belt 2 due to curvature separation, and moves toward the sheet conveying roller pair 9 while being guided by a guide member 10 (refer to FIG. 9E).

The sheet conveying roller pair 9 and the attraction belt 2 are controlled to have the same linear velocity. Therefore, when the sheet conveying roller pair 9 is intermittently driven to adjust the timing, the drive motor 24 is also controlled to drive the attraction belt 2 intermittently. Further, it is also acceptable that the belt drive unit 130 can include an electromagnetic clutch to control the driving of the attraction belt 2.

Further, the attraction belt 2 may be charged only over the length from the sheet separation position of the attraction belt 2 to the sheet conveying roller pair 9, and the attraction belt 2 may be thereafter electrically discharged by the charging member 3. With this configuration, the uppermost sheet 1*a* conveyed to the sheet conveying roller pair 9 is then conveyed solely by the conveying force of the sheet conveying roller pair 9 with no influence from the attraction belt 2. Further, with discharge of the attraction belt 2, the subsequent sheet 1*b* separated from the attraction belt 2 can be prevented from being electrostatically attracted back to the attraction belt 2.

Further, the present embodiment employs the slot 12*a* formed on the bracket 12 by which the shaft 6*a* of the upstream tension roller 6 is held. However, any other configuration in which the upstream tension roller 6 is held to be swingable about the downstream tension roller 5 with respect to the bracket 12. Further, when the sheet attraction/separation unit 110 is at the sheet separation position, the upstream tension roller 6 is supported so that the attraction belt 2 has a given angle of inclination with respect to the upper surface of the sheet stack 1. As long as these features are provided, the configuration according to the present embodiment can be operable.

An adhesion by the charge patterns affects to the uppermost sheet 1*a* and does not affect the subsequent sheet 1*b* and any other subsequent sheet after the subsequent sheet 1*b*. In the present embodiment, a friction force applied between the pickup device and the sheet are used, a contact pressure between the attraction belt 2 and the sheet stack 1 can be substantially small. Accordingly, a multi-feed error in which multiple sheet are fed at one time can be prevented.

The attraction belt 2 is controlled that the uppermost sheet 1*a* is separated from the sheet stack 1 and the subsequent sheet 1*b* is not attracted to the attraction belt 2 before the trailing edge of the uppermost sheet 1*a* reaches a position facing the upstream tension roller 6.

In the present embodiment, gear meshing of the pinion gear 15 and the rack gear 13 swings the sheet attraction/separation unit 110. Therefore, both the swing from the sheet contact position to the sheet separation position and the swing from the sheet separation position to the sheet contact position can be performed by the driving force exerted by the swing motor 30. By so doing, the sheet attraction/separation unit 110 can be lowered to the sheet contact position faster than the speed of free fall of the sheet attraction/separation unit 110. Accordingly, the sheet attraction operation for the subsequent sheet can be started immediately after transfer of the uppermost sheet 1*a* or a first sheet, which can reduce the intervals of the conveyance of sheet. As a result, the sheet feeder 200 can enhance productivity of the image forming apparatus 100.

Further, the swing unit 120 according to the present embodiment is disposed downstream in the sheet feeding direction from the supporting shaft 14 on which the sheet attraction/separation unit 110 pivots. Therefore, the gear meshing of the pinion gear 15 and the rack gear 13 supports a downstream side from the sheet attraction/separation unit 110 in the sheet feeding direction. As a result, the sheet attraction/separation unit 110 is supported at both ends thereof by the supporting shaft 14 and the swing unit 120, when compared with the sheet attraction/separation unit 110 supported in a cantilever manner, and vibration of the sheet attraction/separation unit 110 can be reduced. Accordingly, due to vibration of the sheet attraction/separation unit 110, the uppermost sheet 1*a* attracted to the attraction belt 2 is prevented from being separated from the attraction belt 2. Further, the driving force is transmitted to the sheet attraction/separation unit 110 at the downstream end in the sheet feeding direction, which is a distal end from the supporting shaft 14 on which the sheet attraction/separation unit 110 pivots, so as to swing the sheet attraction/separation unit 110. Accordingly, a portion to which a driving force is transmitted is separated from the supporting shaft 14. By so doing, when compared with a case in which the driving force is transmitted at the shaft side (the upstream side of the sheet attraction/separation unit 110 in the sheet feeding direction) using the principle of leverage, the sheet attraction/separation unit 110 can swing with a smaller load. As a result, an increase in size of the swing motor 30 can be prevented and an increase in size of the image forming apparatus 100 can be reduced. Further, wear of the meshed part of the pinion gear 15 and the rack gear 13 can be reduced.

Figure 10:
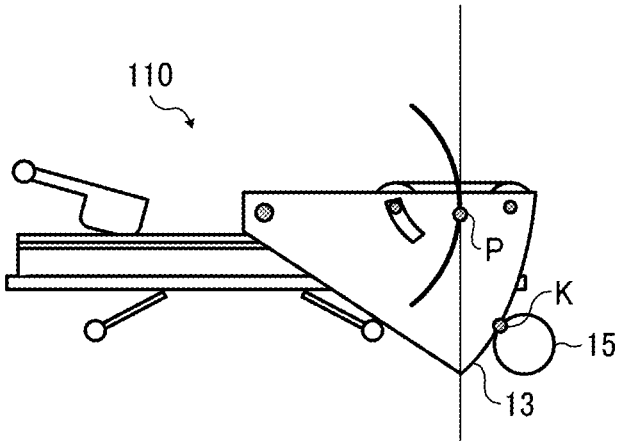
FIG. 10 is a diagram illustrating a relation of the center of gravity of the attraction/separation unit and a gear meshing position of a swing unit.
Figure 11:
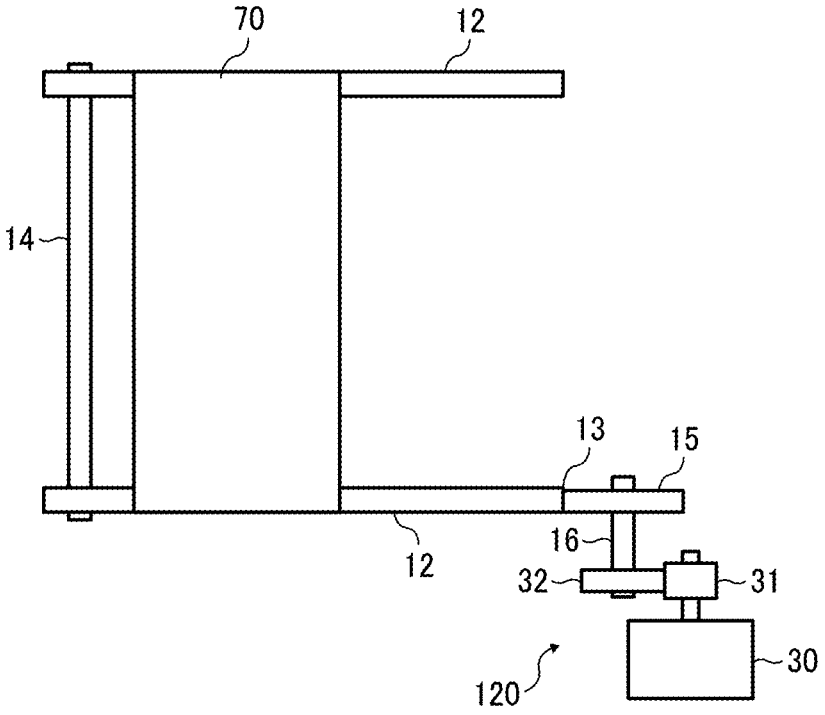
FIG. 11 is a diagram illustrating a rack and pinion mechanism provided at one end in a belt width direction of the attraction belt.

Further, as illustrated in FIG. 10, by providing the pinion gear 15 and the rack gear 13 at the downstream end of the sheet attraction/separation unit 110 in the sheet feeding direction, a meshed part K of the pinion gear 15 and the rack gear 13 can be disposed downstream from the center of gravity P of the sheet attraction/separation unit 110 in the sheet feeding direction. In a case in which the meshed part K is disposed upstream from the center of gravity P of the sheet attraction/separation unit 110 in the sheet feeding direction, the center of gravity P of the sheet attraction/separation unit 110 is disposed at a free end side that is not supported by the meshing of the supporting shaft 14 and the swing unit 30 (a downstream side from the meshed part K in the sheet feeding direction) due to meshing of the supporting shaft 14 and the swing unit 30. As a result, when the sheet attraction/separation unit 110 swings, a free end that is a downstream end of the sheet attraction/separation unit 110 in the sheet feeding direction elastically vibrates according to a distance from the meshed part K to the center of gravity P due to inertia of the sheet attraction/separation unit 110 itself. Further, since the center of gravity P is on the free end side, amplitude of elastic vibration of the sheet attraction/separation unit 110 increases, and therefore convergence of vibration may delay.

However, by arranging the meshed part K downstream from the center of gravity P of the sheet attraction/separation unit 110 in the sheet feeding direction as described in the present embodiment, elastic vibration of the sheet attraction/separation unit 110 can decrease because the sheet attraction/separation unit 110 is held at both ends, and therefore the amplitude of vibration can be reduced, and the period to converge the vibration can be reduced.

Further, meshing of the pinion gear 15 and the rack gear 13 retains the position of the sheet attraction/separation unit 110. Therefore, accurate control of the swing motor 30 can control the position of the sheet attraction/separation unit 110 with accuracy. Specifically, in the present embodiment, the swing unit 120 is disposed downstream and away from the supporting shaft 14 that functions as a pivot of swing of the sheet attraction/separation unit 110 in the sheet feeding direction. Therefore, compared with a configuration in which the swing unit is disposed upstream of the supporting shaft 14 in the sheet feeding direction, an amount of movement of the sheet attraction/separation unit 110 per pitch can be reduced. Therefore, a greater level of positional control of the sheet attraction/separation unit 110 can be performed.

Consequently, the sheet attraction/separation unit 110 can be located at a target sheet separation position accurately, and therefore the uppermost sheet 1*a* can be conveyed to the nip area of the sheet conveying roller pair 9 smoothly. Accordingly, separation of the uppermost sheet 1*a* from the attraction belt 2 due to vibration caused when the leading edge of the uppermost sheet 1*a* abuts against the sheet conveying roller pair 9 can be prevented.

Further, the rack gear 13 and the pinion gear 15 are provided at both ends in the belt width direction of the attraction belt 2. Therefore, both ends in the belt width direction of the sheet attraction/separation unit 110 can be supported by the meshing of the rack gear 13 and the pinion gear 15. Accordingly, twist of the sheet attraction/separation unit 110 can be prevented. Further, as illustrated in FIG. 1, the rack and pinion mechanism can be provided at one end in the belt width direction of the sheet attraction/separation unit 110.

Figure 12:
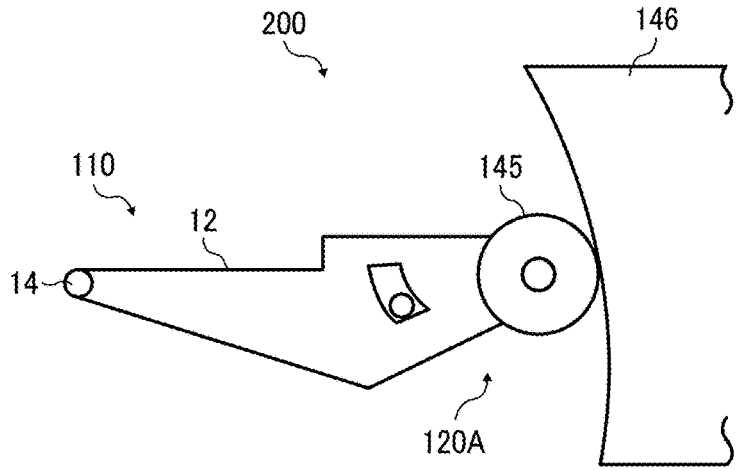
FIG. 12 is a diagram illustrating a pinion gear attached to a bracket and a rack gear attached to an apparatus body.
Figure 13:
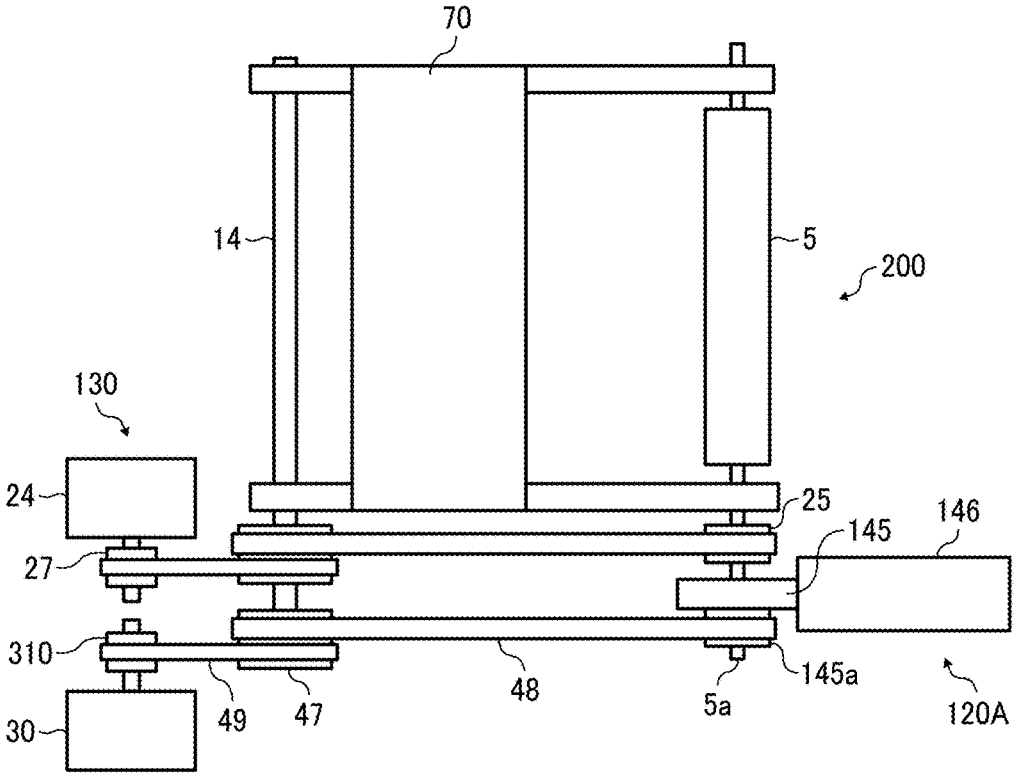
FIG. 13 is a schematic diagram illustrating a drive mechanism of the sheet feeder of FIG. 12 and the swing unit.

Another example of the configuration of the swing unit to swing the sheet attraction/separation unit 110 is illustrated in FIGS. 12 and 13. In FIG. 3, the attraction belt 2 is omitted.

A swing unit 120A of the sheet feeder 200 illustrated in FIGS. 12 and 13 has a rack and pinion mechanism including a pinion gear 145 and a rack gear 146. The pinion gear 145 is attached to the bracket 12 and the rack gear 146 is attached to the apparatus body 101. As illustrated in FIG. 13, the pinion gear 145 is rotatably supported by the shaft 5*a* of the downstream tension roller 5. The pinion gear 145 includes a pulley 145*a*. A driven pulley 47 is mounted to the supporting shaft 14. A first timing belt 48 is wound around the pulley 145*a* and the driven pulley 47. A drive pulley 310 is mounted to a motor shaft of the swing motor 30. A second timing belt 49 is wound around the driven pulley 47 and the drive pulley 310. With this configuration, a driving force exerted by the swing motor 30 is transmitted to the pinion gear 145 via the supporting shaft 14. Accordingly, similar to the belt drive unit 130, swing of the sheet attraction/separation unit 110 can prevent the first timing belt 48 from being loosened, and therefore the driving force exerted by the swing motor 30 can be well transmitted to the pinion gear 145.

The configuration of the pinion gear 145 attached to the sheet attraction/separation unit 110 is preferable when an amount of swing of the sheet attraction/separation unit 120A is large. While the size of the rack gear 146 is adjusted according to the amount of swing of the sheet attraction/separation unit 110, the size of the pinion gear 145 can be fixed regardless of the amount of swing of the sheet attraction/separation unit 110. Therefore, an increase in size of the sheet attraction/separation unit 110 can be prevented, and therefore an increase in load of the sheet attraction/separation unit 110 can be reduced even if the weight of the sheet attraction/separation unit 110 increases. Accordingly, by employing the swing unit 120A illustrated in FIGS. 12 and 13 when the amount of swing of the sheet attraction/separation unit 110 is large, the sheet attraction/separation unit 110 can increases in speed of swing, and therefore can enhance productivity.

Figure 14:
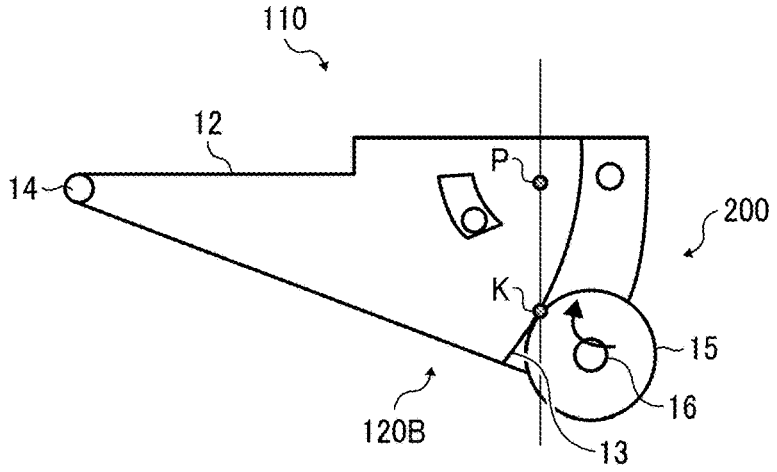
FIG. 14 is a modification of the swing unit.
Figure 15:
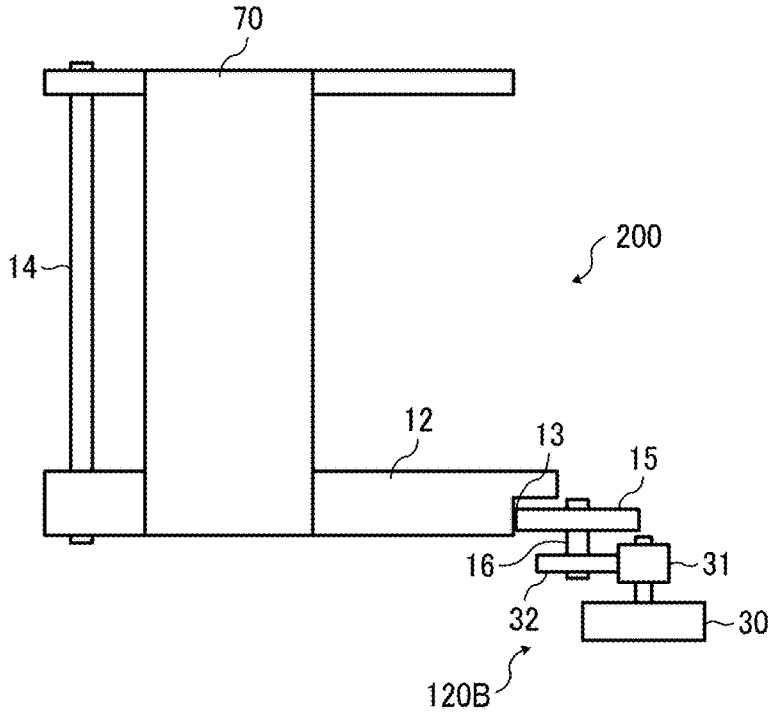
FIG. 15 is a schematic diagram illustrating the sheet feeder including the swing unit of FIG. 14.

Yet another example of the configuration of the swing unit to swing the sheet attraction/separation unit 110 is illustrated in FIGS. 14 and 15.

A swing unit 120B of the sheet feeder 200 illustrated in FIGS. 14 and 15 has a configuration in which the center of gravity P of the sheet attraction/separation unit 110 in the sheet feeding direction and the meshed part K of the rack gear 13 and the pinion gear 15 of the swing unit 120 come at the same position when the sheet attraction/separation unit 110 is at the sheet separation position. To provide this configuration, a step portion is provided at a downstream end of the bracket 12 in the sheet feeding direction as illustrated in FIG. 15 and the rack gear 13 is disposed at the step portion.

When the sheet attraction/separation unit 110 stops at the sheet separation position, elastic vibration occurs due to inertia of the sheet attraction/separation unit 110. Especially when the sheet attraction/separation unit 110 is swung at high speed to enhance productivity, influence of the inertia of the sheet attraction/separation unit 110 increases, and therefore elastic vibration is likely to be greater. When the sheet attraction/separation unit 110 elastically vibrates at the sheet separation position, it is likely that the uppermost sheet 1*a* attracted to the attraction belt 2 separates from the attraction belt 2.

By contrast, in the configuration illustrated in FIGS. 14 and 15, when the sheet attraction/separation unit 110 is at the sheet separation position, the center of gravity P of the sheet attraction/separation unit 110 and the meshed part K of the rack gear 13 and the pinion gear 15 of the swing unit 120 are located at the same position. Accordingly, elastic vibration caused when the sheet attraction/separation unit 110 stops at the sheet separation position can be prevented most effectively, and separation of the uppermost sheet 1*a* from the attraction belt 2 can be prevented.

Yet another example of the configuration of the swing unit to swing the sheet attraction/separation unit 110 is illustrated in FIGS. 14 and 15.

Figure 16:
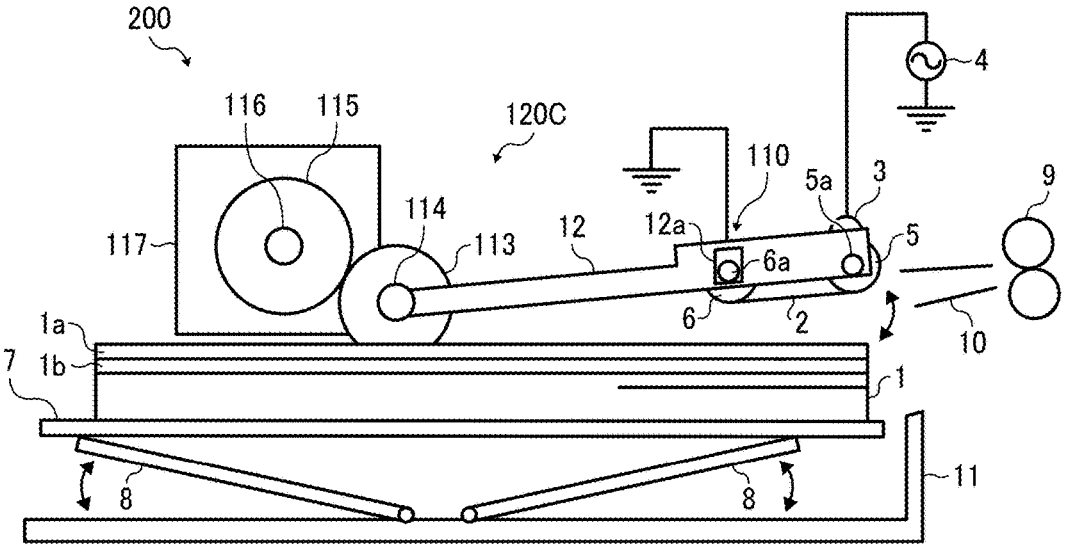
FIG. 16 is a diagram illustrating another modification of the swing unit together with the sheet supplying device.
Figure 17:
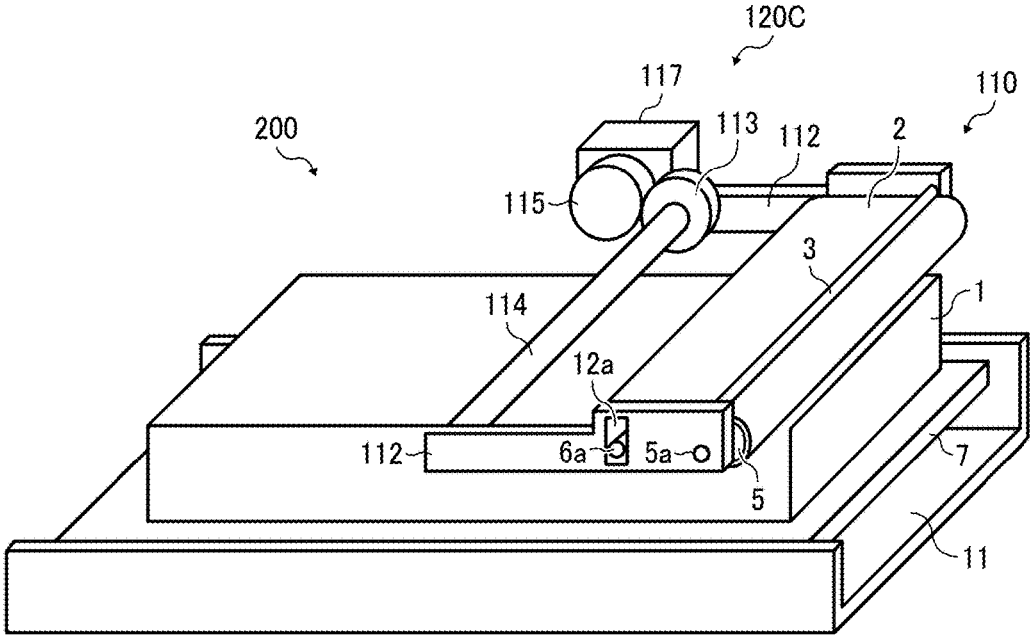
FIG. 17 is a perspective view illustrating the swing unit and the sheet supplying device of FIG. 16.

A swing unit 120C of the sheet feeder 200 illustrated in FIGS. 16 and 17 includes brackets 112, a rotary gear 113, a rotary shaft 114, a rotary gear 115, and a rotary motor 117.

The rotary shaft 114 is disposed parallel to the shaft 5*a* of the downstream tension roller 5 and the shaft 6*a* of the upstream tension roller 6 at a position opposite to or upstream from the downstream tension roller 5 and the upstream tension roller 6 in the sheet feeding direction. The brackets 112 rotatably support both ends of the downstream tension roller 5 and the upstream tension roller 6. With the brackets 112, the sheet attraction/separation unit 110 swings vertically. The rotary motor 117 has a motor shaft 116. The rotary gear 115 is mounted to the motor shaft 116 of the rotary motor 117. The rotary gear 113 is mounted to one end in an axial direction of the rotary shaft 114. The rotary gear 113 meshes with the rotary gear 115. The brackets 112 rotates vertically according to a rotation direction of the rotary motor 117.

It is to be noted that a configuration of the swing unit is not limited to those of the swing units 120, 120A, 120B, and 120C. For example, the swing unit 120 can include a wire and a wire take-up unit. The wire is engaged to a downstream end of at least one of the brackets 112. The wire take-up unit takes up the wire.

Figure 18:
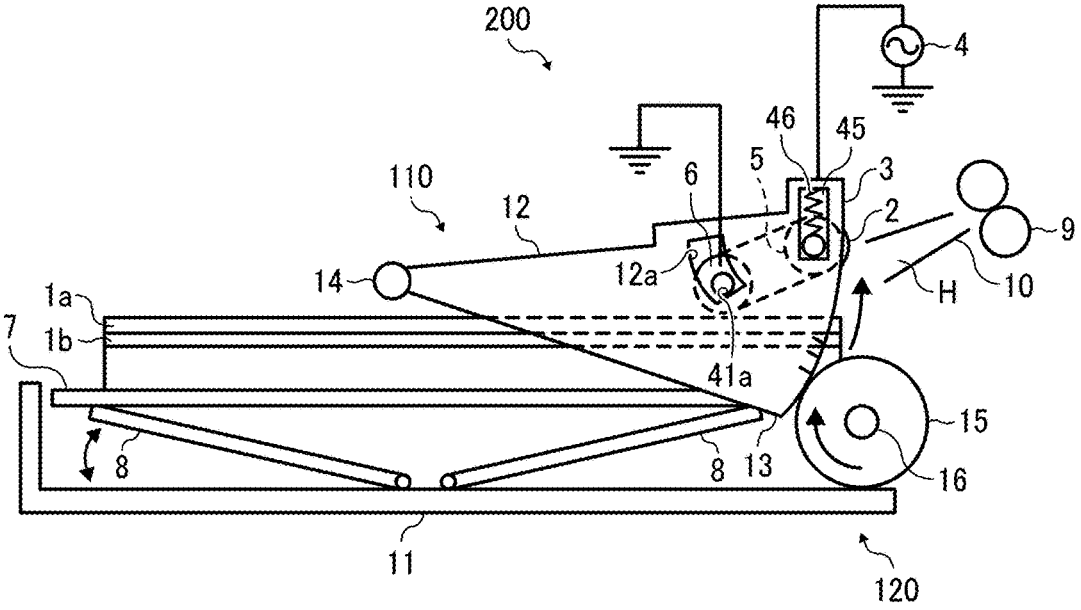
FIG. 18 is a diagram illustrating an upstream tension roller and a downstream tension roller held by each bracket to be vertically movable with respect to an upper surface of the sheet stack.

Further, as illustrated in FIG. 18, the upstream tension roller 6 and the downstream tension roller 5 are movably supported to each bracket 12 in a vertical direction with respect to the upper surface of the sheet stack 1. Specifically, each bracket 12 is provided with an upstream slot 12*a* and a downstream slot 45 as illustrated in FIG. 18. The shaft 6*a* of the upstream tension roller 6 passes through the upstream slot 12*a* and the shaft 5*a* of the downstream tension roller 5 passes through the downstream slot 45. The downstream tension roller 5 is biased toward the sheet stack 1 by a spring 46. As illustrated in FIG. 18, when the sheet attraction/separation unit 110 is at the sheet separation position, the shaft 6*a* of the upstream tension roller 6 contacts the lower end surface 41*a* of the upstream slot 12*a* and the shaft 5*a* of the downstream tension roller 5 contacts a lower end surface of the downstream slot 45. Further, the lower end surface 41*a* of the upstream slot 12*a* in contact with the upstream tension roller 6 is disposed closer to the sheet stack 1 than the lower end surface of the downstream slot 45 in contact with the downstream tension roller 5 is.

Now, a description is given of a series of sheet conveying operations of the sheet feeder 200 of FIG. 18, with reference to FIGS. 19A through 19E.

Figure 19A:
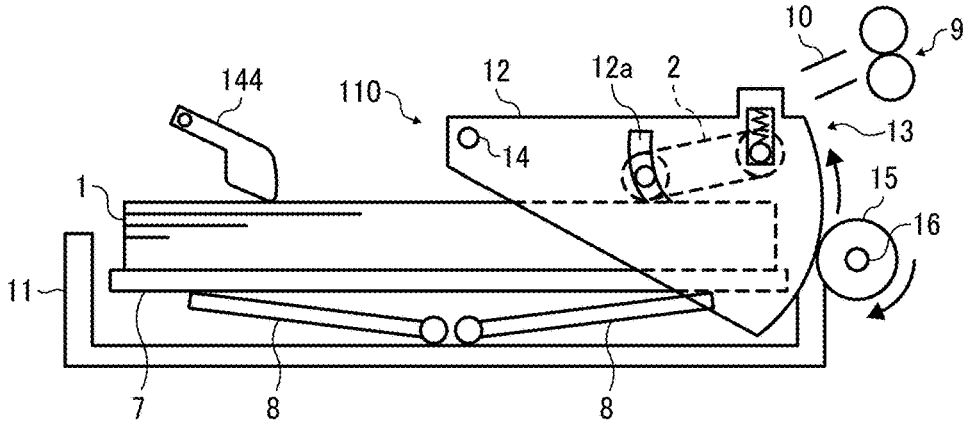
FIGS. 19A through 19E are diagrams illustrating a series of a sheet feeding operation performed by the sheet feeder of FIG. 18.

Generally before starting the series of sheet feeding operations, the bottom plate 7 stands by at a lower position and the sheet attraction/separation unit 110 is at the sheet contact position as illustrated in FIG. 19A. Upon receiving a sheet feeding signal, the swing motor 30 is driven to rotate the pinion gear 15 clockwise in FIG. 19A, so that the sheet attraction/separation unit 110 swings to the sheet separation position.

Figure 19B:
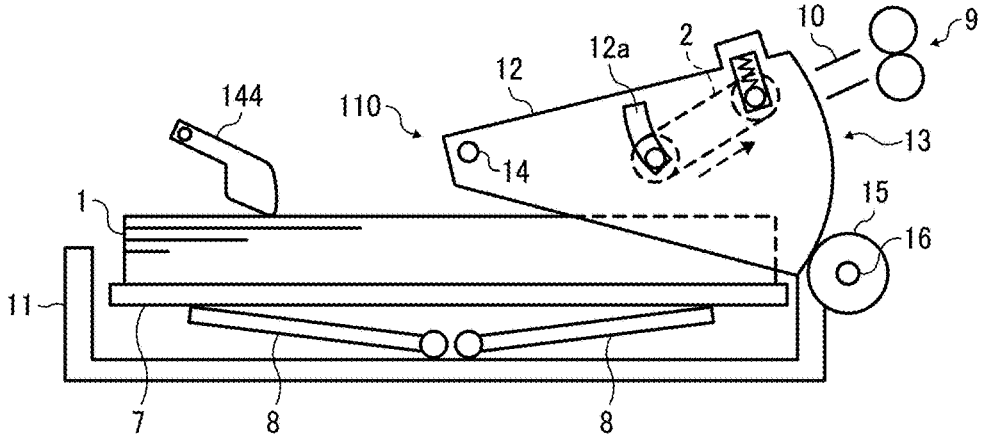

Then, as illustrated in FIG. 19B, the drive motor 24 is driven to rotate the attraction belt 2 in an endless loop to uniformly charge the surface of the attraction belt 2.

Figure 19C:
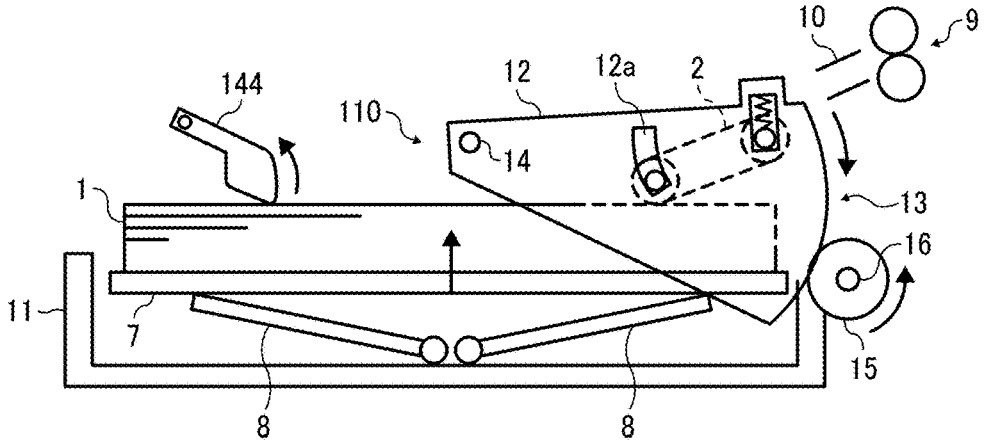

After completion of charging the surface of the attraction belt 2, as illustrated in FIG. 19C, rotation of the attraction belt 2 is stopped and elevation of the bottom plate 7 that has stood by at the lower position is started. About the same time as the actions above, the swing motor 30 is reversed to rotate the pinion gear 15 counterclockwise in FIG. 19C. By so doing, the sheet attraction/separation unit 110 pivots on the supporting shaft 14 clockwise in FIG. 19C (in a direction to approach the sheet stack 1).

As the bottom plate 7 elevates and the sheet attraction/separation unit 110 lowers, the uppermost sheet 1*a* of the sheet stack 1 contacts the upstream tension roller 6 via the attraction belt 2. As the bottom plate 7 elevates and the sheet attraction/separation unit 110 lowers further, the upstream tension roller 6 is pushed up by the sheet stack 1. Consequently, the upstream tension roller 6 in contact with the lower end surface 41*a* of the upstream slot 12*a* is lifted along the upstream slot 12*a*. Further, along with elevation of the bottom plate 7, the feeler 144 rotates counterclockwise in FIG. 19C. When the uppermost sheet 1*a* of the sheet stack 1 reaches a given position, the feeler 144 shields the light emitted by the light emitting element 143*b* of the thru-beam optical sensor 143. With this action, the sheet detector 140 detects that the uppermost sheet 1*a* of the sheet stack 1 has arrived at the given position, so that elevation of the bottom plate 7 stops.

Figure 19D:
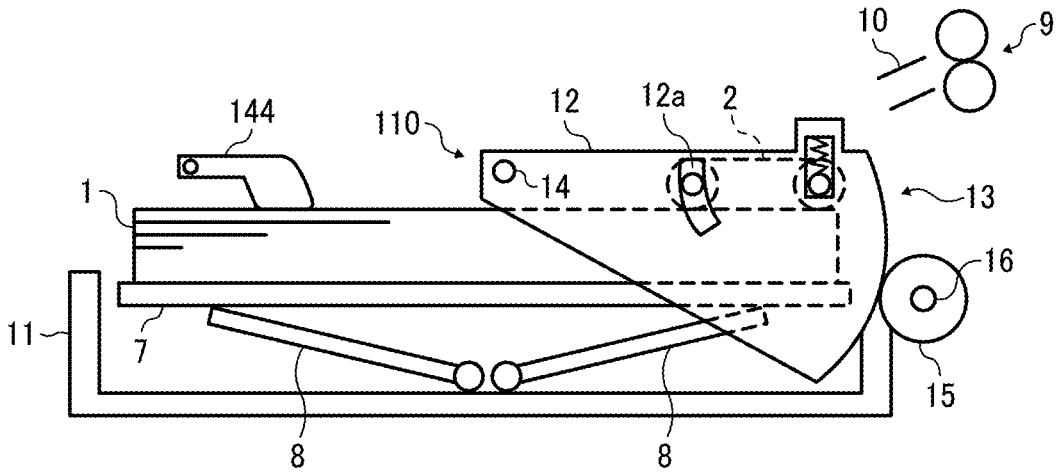

As the sheet attraction/separation unit 110 is further swung clockwise in FIG. 19C (the direction to approach the sheet stack 1), the downstream tension roller 5 contacts the uppermost sheet 1*a* of the sheet stack 1 via the attraction belt 2. As the sheet attraction/separation unit 110 is yet further swung clockwise in FIG. 19C (the direction to approach the sheet stack 1), the downstream tension roller 5 is pushed up by the sheet stack 1 against a biasing force of the spring 46, as illustrated in FIG. 19D. As a result, the downstream tension roller 5 in contact with the lower end surface of the downstream slot 45 is guided along the downstream slot 45 and moves upward. Accordingly, rotation of the swing motor 30 is stopped and swing of the sheet attraction/separation unit 110 is stopped.

As illustrated in FIG. 19D, as downward swing of the sheet attraction/separation unit 110 is stopped, the upstream tension roller 6 separates from the lower end surface 41*a* of the upstream slot 12*a* and the downstream tension roller 5 separates from the lower end surface of the downstream slot 45. With this action, the upstream tension roller 6 and the downstream tension roller 5 are released from the support by the slots 12*a* and 45 of the brackets 12 and are then placed on the sheet stack 1. That is, the supporter of the upstream tension roller 6 and the downstream tension roller 5 is shifted from the brackets 12 to the sheet stack 1. Accordingly, the attraction belt 2 that has been supported by the sheet attraction/separation unit 110 is now supported by the sheet stack 1. With this configuration, even when a vertical position of the uppermost sheet 1*a* of the sheet stack 1 in FIG. 19D is shifted or the sheet stack 1 is disposed in a slanted manner, a region on the attraction belt 2 facing the sheet stack 1 can contact the uppermost sheet 1*a* of the sheet stack 1 reliably. The region is herein after referred to as a sheet contact region.

As the attraction belt 2 thus comes into contact with the uppermost sheet 1*a*, Maxwell stress acts on the uppermost sheet 1*a*, which is a dielectric material, due to the electrical field generated by the charge patterns formed on the outer circumferential surface of the attraction belt 2. As a result, the uppermost sheet 1*a* of the sheet stack 1 is attracted to the attraction belt 2.

Substantially the same in the above description, after the sheet attraction/separation unit 110 stands by for a given time in the state illustrated in FIG. 19D, the uppermost sheet 1*a* is attracted to the attraction belt 2. Then, the swing motor 30 is driven to rotate the pinion gear 15 clockwise in FIG. 19D, so that the sheet attraction/separation unit 110 pivots on the supporting shaft 14 counterclockwise in FIG. 19D. Then, the downstream tension roller 5 contacts the lower end surface of the downstream slot 45 to be supported by the bracket 12 and moves together with the bracket 12 in a direction to separate from the sheet stack 1. By contrast, since the lower end surface 41*a* of the upstream slot 12*a* is located closer to the sheet stack 1 than the lower end surface of the downstream slot 45, the upstream tension roller 6 does not move from the upper surface of the sheet stack 1 due to the weight thereof, and moves away from the bracket 12 and toward the sheet stack 1. With this configuration, the attraction belt 2 moves to swing about the center of rotation of the upstream tension roller 6, and a part of the uppermost sheet 1*a* attracted to the surface of the attraction belt 2 is bent at a portion of the attraction belt 2 wound around the upstream tension roller 6. As a result, the restorative force acts on the sheet attracted to the attraction belt 2. Accordingly, only the uppermost sheet 1*a* is attracted to the attraction belt 2, and the subsequent sheet 1*b* is separated from the attraction belt 2 by the restorative force of the subsequent sheet 1*b*.

Figure 19E:
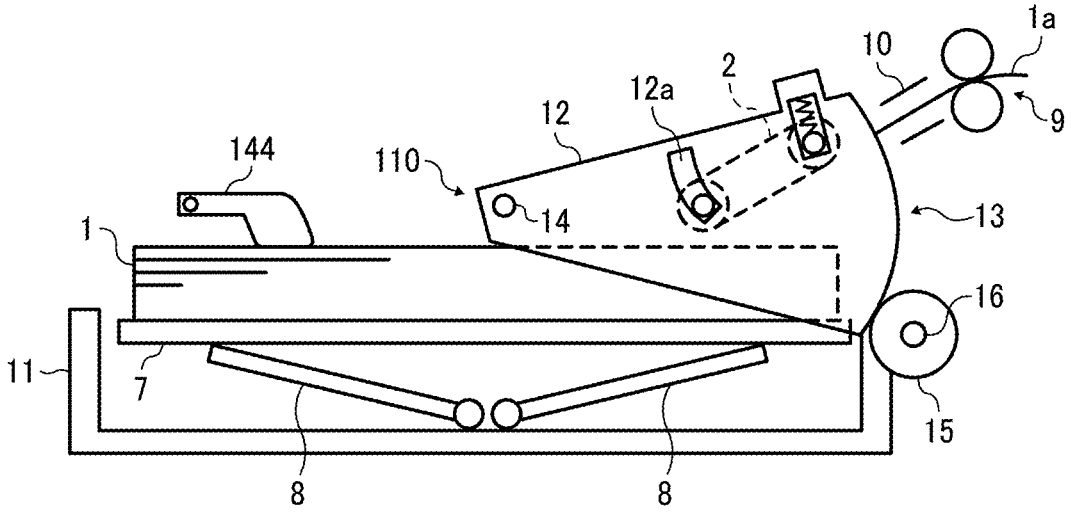

When the sheet attraction/separation unit 110 further pivots on the supporting shaft 14 counterclockwise in FIG. 19D, the upstream tension roller 6 abuts against the lower end surface 41*a* of the slot 12*a* on each bracket 12. When the sheet attraction/separation unit 110 is further rotated in this contact state of the upstream roller 6 with the lower end surface 41*a* of each slot 12*a*, the upstream tension roller 6 is also supported by the brackets 12. Then, the upstream tension roller 6 moves together with the bracket 12, so that the upstream tension roller 6 separates from the upper surface of the sheet stack 1 and therefore the upstream tension roller 6 separates from the upper surface of the sheet stack 1. When the sheet attraction/separation unit 110 reaches the sheet separation position to convey the uppermost sheet 1*a* further, rotation of the swing motor 30 is stopped, as illustrated in FIG. 19E. After the rotation of the swing motor 30 is stopped, the drive motor 24 is driven to rotate the attraction belt 2, and the uppermost sheet 1*a* attracted to the attraction belt 2 is conveyed toward the sheet conveying roller pair 9. As the leading edge of the uppermost sheet 1*a* electrostatically attracted to the attraction belt 2 reaches a corner where the inner circumferential surface of the attraction belt 2 contacts the downstream tension roller 5, the uppermost sheet 1*a* bends along the curvature of the arc about the outer circumference of the attraction belt 2 at or in the vicinity of the upstream tension roller 6, separates from the attraction belt 2 due to curvature separation, and moves toward the sheet conveying roller pair 9 while being guided by the guide member 10, as illustrated in FIG. 19E.

In the sheet feeder 200 illustrated in FIG. 18, the uppermost sheet 1*a* of the sheet stack 1 can be attracted to the attraction belt 2 while the attraction belt 2 is supported by the upper surface of the sheet stack 1. With this configuration, even when a position of the uppermost sheet 1*a* of the sheet stack 1 in the height or in the vertical direction of FIG. 18 is shifted or the sheet stack 1 is disposed in a slanted manner, the sheet contact region on the attraction belt 2 facing the sheet stack 1 can contact the uppermost sheet 1*a* of the sheet stack 1 reliably. Accordingly, the uppermost sheet 1*a* can be attracted to the attraction belt 2 while the sheet contact region on the attraction belt 2 facing the sheet stack 1 is in contact with the uppermost sheet 1*a* of the sheet stack 1 reliably. As a result, the uppermost sheet 1*a* is attracted to the attraction belt 2 reliably.

Further, since the downstream tension roller 5 is biased by the spring 46 toward the sheet stack 1, the downstream tension roller 5 can contact the uppermost sheet 1*a* of the sheet stack 1 with a given pressure. As a result, the uppermost sheet 1*a* is attracted to the attraction belt 2 more reliably.

Further, by shifting the sheet attraction/separation unit 110 by a given length from a position where the attraction belt 2 generally contact the uppermost sheet 1*a* of the sheet stack 1 toward the sheet stack 1 or clockwise in FIG. 18, the attraction belt 2 contacts the uppermost sheet 1*a* of the sheet stack 1 reliably. Accordingly, no detector for detecting that the attraction belt 2 comes to contact the uppermost sheet 1*a* of the sheet stack 1 is included in the configuration of the sheet feeder 200 to control swing of the sheet attraction/separation unit 110 based on detection results obtained by the detector. Consequently, the sheet contact region on the attraction belt 2 facing the sheet stack 1 can contact the uppermost sheet 1*a* of the sheet stack 1 with simple control. As a result, the number of components and units provided to the sheet feeder 200 can be reduced, a reduction in cost of the sheet feeder 200 can be achieved, and control of swinging the sheet attraction/separation unit 110 can be simplified.

As described above, the present embodiment describes the bracket 12 having the downstream slot 45 to support the shaft 5*a* of the downstream tension roller 5. However, the supporting configuration of the shaft 5*a* of the downstream tension roller 5 is not limited thereto. For example, a configuration in which the shaft 5*a* of the downstream tension roller 5 is supported while separating from the upper surface of the sheet stack 1 and the downstream tension roller 5 can shift in a vertical direction of the upper surface of the sheet stack 1 with respect to the bracket 12 can be applied to the present invention.

Figure 20:
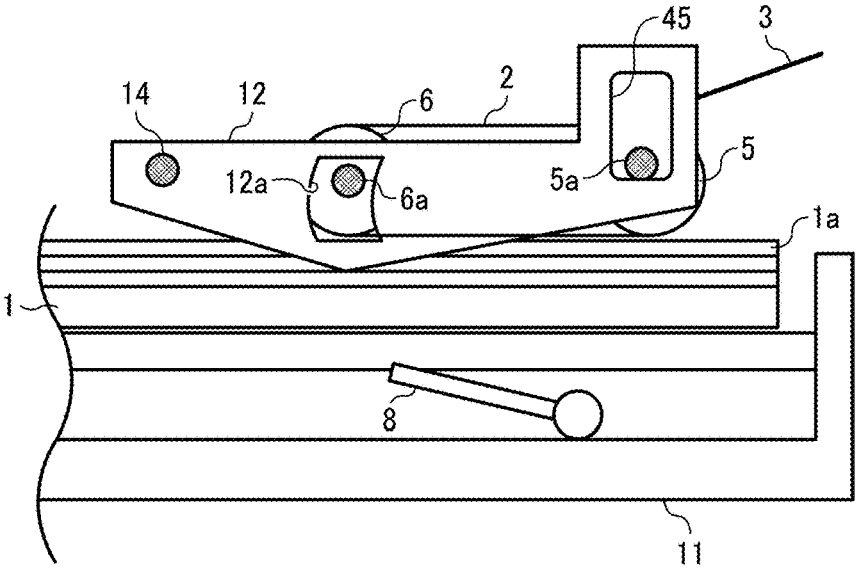
FIG. 20 is a diagram illustrating a first modification of the sheet feeder of FIG. 18.

Further, the downstream tension roller 5 is biased by the spring 46 toward the sheet stack 1 in the configuration illustrated in FIG. 18. However, the configuration is not limited thereto. For example, the spring 46 can be omitted, as illustrated in FIG. 20. With a configuration without the spring 46 as illustrated in FIG. 20, when the sheet attraction/separation unit 110 is at the sheet contact position, the attraction belt 2 is supported by the sheet stack 1 to contact the sheet contact region on the attraction belt 12 facing the sheet stack 1 to the uppermost sheet 1*a* of the sheet stack 1 reliably.

Figure 21:
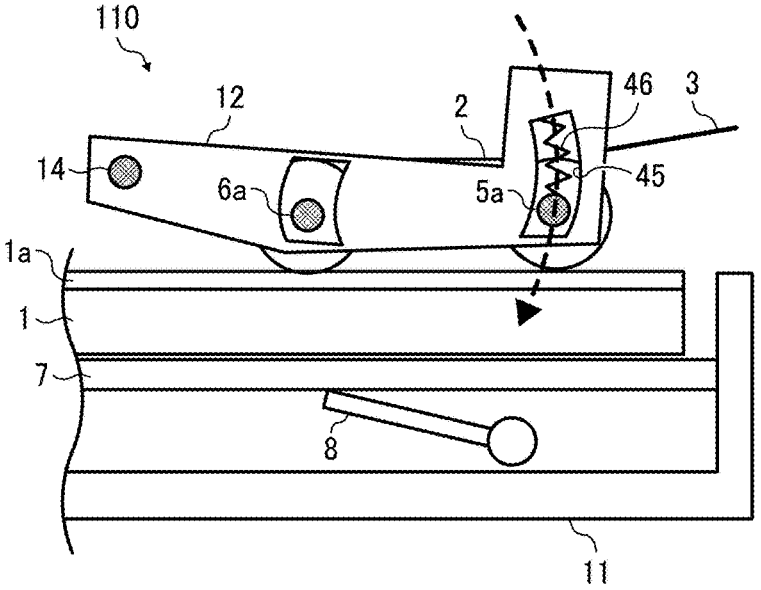
FIG. 21 is a diagram illustrating a second modification of the sheet feeder of FIG. 18.

Further, as illustrated in FIG. 21, the shape of the downstream slot 45 can be an arc shape having the same center of rotation with the sheet attraction/separation unit 110 that pivots on the supporting shaft 14. With the arc-shaped downstream slot 45, when the downstream tension roller 5 contacts the sheet stack 1 and moves in the direction to separate from the sheet stack 1 relative to the bracket 12, the shaft 5*a* of the downstream tension roller 5 is not caught by the downstream slot 45. Accordingly, the shaft 5*a* of the downstream tension roller 5 can move along the downstream slot 45.

Further, even when the bracket 12 swings clockwise in FIG. 21 in a state in which the downstream tension roller 5 remains in contact with the uppermost sheet 1*a* of the sheet stack 1, the shaft 5*a* of the downstream tension roller 5 is pressed against a lateral surface of the downstream slot 45. Therefore, the position of the downstream tension roller 5 in the sheet feeding direction cannot be shifted. Consequently, a constant positional relation of the shaft 5*a* of the downstream tension roller 5 and the supporting shaft 14 can be maintained, and therefore the driven timing belt 28 can be prevented from being bent or extended.

Figure 22:
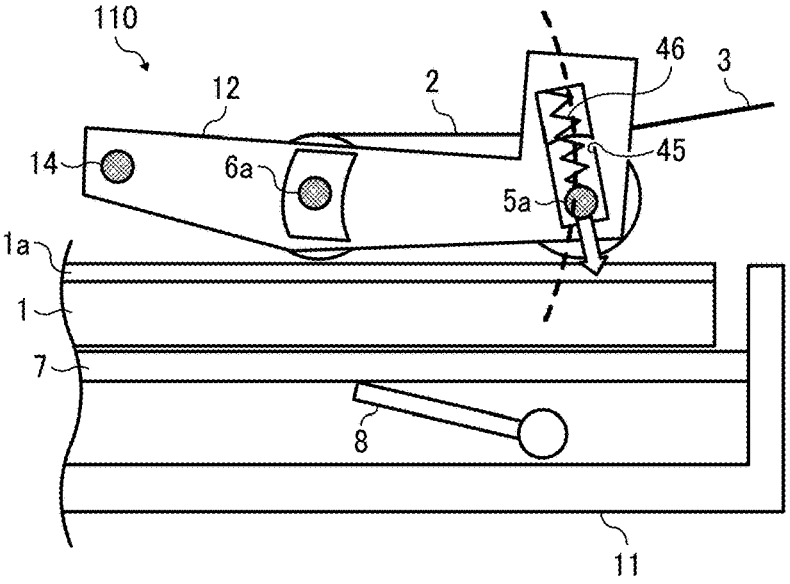
FIG. 22 is a diagram illustrating a third modification of the sheet feeder of FIG. 18.

Further, as illustrated in FIG. 22, the downstream slot 45 is obliquely formed so that an upper end of the downstream slot 45 is arranged upstream from the lower end surface thereof in the sheet feeding direction. With this configuration, a contact point of the shaft 5*a* of the downstream tension roller 5 and the lower end surface of the downstream slot 45 is arranged downstream from the center of the downstream tension roller 5. The shaft 5*a* of the downstream tension roller 5 is biased toward the lower end surface of the downstream slot 45. Therefore, when the sheet attraction/separation unit 110 swings from the sheet separation position to the sheet contact position, the downstream tension roller 5 is biased by a spring toward a downstream side in the sheet feeding direction. Swing of the sheet attraction/separation unit 110 adds a centrifugal force to the downstream tension roller 5 to move the downstream tension roller 5 toward a downstream side in the sheet feeding direction. However, the downstream tension roller 5 is biased by the spring so as to contact the lower end surface of the downstream slot 45 arranged downstream from the center of the downstream tension roller 5 in the conveying direction, and therefore remains at the same position without moving to the downstream side in the sheet feeding direction. As a result, even when the downstream tension roller 5 contacts the sheet stack 1 and is released from the support of the bracket 12 and from the centrifugal force applied to the downstream tension roller 5, the downstream tension roller 5 does not move toward an upstream side in the sheet feeding direction. Accordingly, the downstream tension roller 5 is prevented from vibration.

Figure 23:
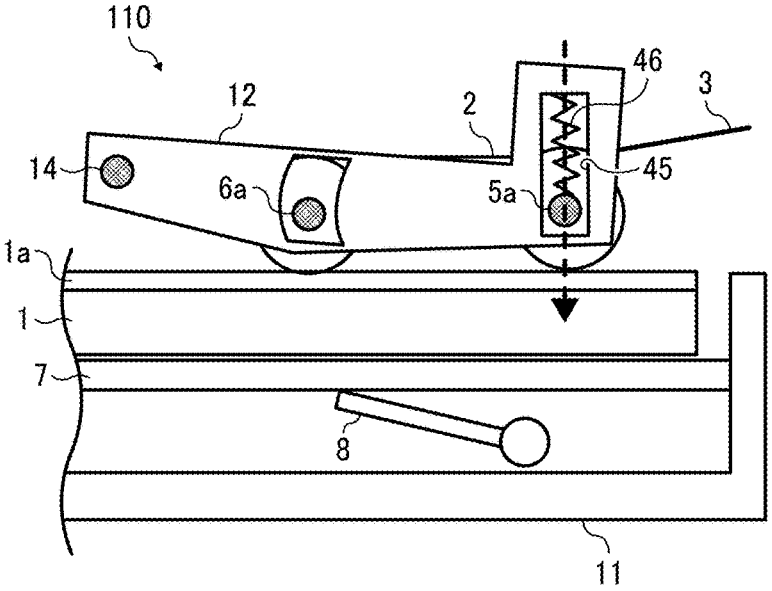
FIG. 23 is a diagram illustrating a fourth modification of the sheet feeder of FIG. 18.

Further, as illustrated in FIG. 23, when the sheet attraction/separation unit 110 is stopped at the sheet contact position, the downstream slot 45 can extend vertically with respect to the sheet stack 1. With this configuration, the downstream tension roller 5 is biased by the spring 46 in a substantially exactly vertical direction with respect to the upper surface of the sheet stack 1. Therefore, the attraction belt 2 can be well biased by the spring 46 toward the sheet stack 1 so as to attract the uppermost sheet 1*a* to the attraction belt 2 preferably.

As described above, the sheet feeder 200 has a configuration in which the upstream tension roller 6 contacts the low end 41*a* of the slot 12*a* to separate the attraction belt 2 from the sheet stack 1. Accordingly, the sheet feeder 200 provides a stable angle of inclination of the attraction belt 2 when the upstream tension roller 6 separates from the sheet stack 1. The angle of the attraction belt 2 represents an angle formed by the uppermost sheet 1*a* of the sheet stack 1 and a contact surface on which the attraction belt 2 contacts the uppermost sheet 1*a* of the sheet stack 1. Due to the angle of inclination of the attraction belt 2, the sheet feeder 200 may have difficulty to cope with various types of papers and ambient conditions. To address the inconvenience, the sheet feeder 200 according to the present embodiment is enhanced to change the angle of the attraction belt 2 according to sheet types and environmental conditions.

Figure 24:
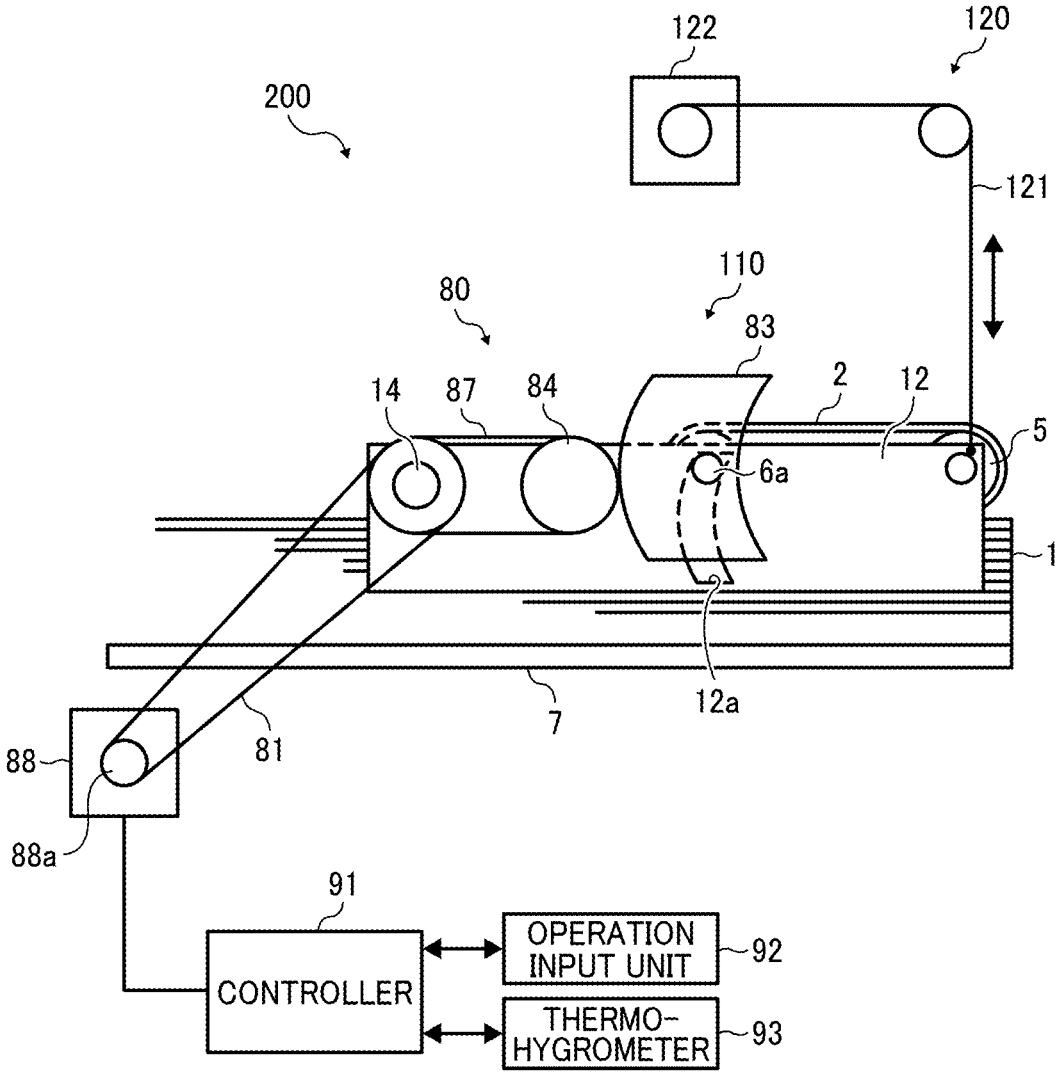
FIG. 24 is a diagram illustrating a detailed configuration of the sheet feeder.

FIG. 24 is a diagram illustrating a configuration of the sheet feeder 200.

As illustrated in FIG. 24, the sheet feeder 200 includes a swing unit 120 that includes a wire 121 and a wire drive unit 122. The wire 121 is engaged with a downstream end of the bracket 12. The wire drive unit 122 takes up the wire 121.

As illustrated in FIG. 24, the sheet feeder 200 further includes a swing range adjusting unit 80 that serves as a range (angle) adjuster to change or adjust the range of swing of the sheet attraction/separation unit 110 by changing the range of movement of the upstream tension roller 6 along the slots 12*a*.

The swing range adjusting unit 80 includes a rack 83 and a pinion gear 84. The rack 83 is fixedly attached via bearings at both ends of a shaft 6*a* of the upstream tension roller 6 that passes through the slots 12*a*. Specifically, the bearings have D-shaped outlines and the racks 83 have respective D-shaped openings so that the D-shaped outlines of the bearings are engaged with the respective D-shaped openings of the racks 83 and the racks 83 are screwed to the respective bearings. The pinion gear 84 that is engaged with the rack 83 is rotatably attached to the brackets 12. A first pulley is mounted to the 6*a* coaxially with the pinion gear 84. A second pulley 86 and a third pulley are rotatably mounted to the supporting shaft 14. A driven timing belt 87 is wound around the first pulley and the second pulley 86, and a drive timing belt 81 is wound around the third pulley and a driven shaft 88*a* of an adjuster drive unit 88. It is more preferable that the components constituting the swing range adjusting unit 80 other than the adjuster drive unit (that is, the components are the rack 83, the pinion gear 84, the first pulley, the second pulley 86, the third pulley, the driven timing belt 87, and the drive timing belt 81) are disposed outside the bracket 12 of the sheet attraction/separation unit 30, located symmetrically at opposite ends in the long axis thereof, and caused to operate at both sides.

The sheet attraction/separation unit 110 according to the present embodiment includes the second pulley 86 that serves as a drive transmission member and the third pulley attached to the rotary shaft 14 that serves as a pivot of the sheet attraction/separation unit 110, so that the drive force of the adjuster drive unit 88 can be transmitted to the pinion gear 84 via the second pulley 86 and the third pulley. With this configuration, even if the sheet attraction/separation unit 110 rotates, the distance between the first pulley that is mounted coaxially with the pinion gear 84 and the second pulley 86 that is mounted coaxially with the supporting shaft 14 can be maintained constant. Accordingly, the driven timing belt 87 that is wound around the first pulley and the second pulley 86 from being pulled or sagged. Similarly, the drive timing belt 81 that is wound around the third pulley mounted to the drive shaft 88*a* cannot be pulled or sagged even if the sheet attraction/separation unit 110 rotates. Accordingly, even if the sheet attraction/separation unit 110 moves or rotates, the drive force of the adjuster drive unit 88 can be transmitted to the pinion gear 84 reliably.

The adjuster drive unit 88 is connected to a controller 91. Further, the controller 91 is connected to an operation input unit 92 and a thermohygrometer 93 that serves as a humidity detector. The thermohygrometer 93 is embedded in the sheet tray 11 of the sheet supplying device 52. The controller 91 controls the adjuster drive unit 88 based on the detection results obtained by the thermohygrometer 93. Humidity can also be detected by a different humidity detector that is incorporated in the image forming apparatus 100. Further, the controller 91 can obtain such information as the material and thickness of sheets accommodated in the sheet tray 11 by input or selection operation by a user through the operation input unit 92. Specifically, the operation input unit 92 functions as a sheet information input unit. As one example, as information of rigidity and stiffness of sheet, values measured by Clark method ($cm^3/100$, JIS P 8143) or paper weight of sheet ($g/m^2$) are input in the operation input unit 92. Generally, a thick paper having a large paper weight ($g/m^2$) has a high rigidity of sheet, and a thin paper having a small paper weight ($g/m^2$) has a low rigidity of sheet. Therefore, the rigidity of sheets set in the sheet tray 11 can be obtained based on the paper weight ($g/m^2$).

Further, the above-described sheet information can be obtained from a label attached to a wrapping paper or package that wraps the sheet stack 1. For example, when the sheet stack 1 is set in the sheet tray 11, a screen is displayed for a user to input a product number printed on the label to a specific area of the operation input unit 92. The controller 91 has prestored therein a table associated with product numbers, rigidity of sheets (values and paper weights obtained by Clark method), electrical resistances, and so forth, and therefore can obtain the information (i.e., rigidity and electrical resistance) of the sheets set in the sheet tray 11 based on the product number inputted by the user. Then, the controller 91 controls the adjuster drive unit 88 based on the thus-obtained sheet information. Further, the controller 91 may control the pitch and voltage of the electrical charge and attraction time (a period of time the attraction belt 2 is held in contact with the sheet stack 1) of the attraction belt 2. With the above-described operations performed by the controller 91, the attraction belt 2 can attract the sheet stack 1 with a suitable type and environmental condition of the sheet to be separated and conveyed. For example, in a case in which a sheet having a relatively high electrical resistance is attracted, the attraction belt 2 may need a longer time to obtain a sufficient attractive force to attract the sheet. Therefore, the controller 91 causes the attraction belt 2 to attract the sheet for a longer period of time.

By driving the adjuster drive unit 88, the pinion gear 84 rotates, which moves the rack 83. Consequently, the shaft 6*a* of the upstream tension roller 6 moves within the range of the slot 12*a*. The controller 91 specifies a driving period of the adjuster drive unit 88 based on detection results obtained by the thermohygrometer 93 and sheet information. When the adjuster drive unit 88 drives for the driving period, the controller 91 stops the adjuster drive unit 88. By so doing, the shaft 6*a* of the upstream tension roller 6 stops at the given position in the slot 12*a*. Accordingly, with the aid of the pinion gear 84, the rack 83, and the adjuster drive unit 88, movement of the upstream tension roller 6 in the slot 12*a* can be optionally determined.

After the charging operation and the attraction operation have been performed as described above, the controller 91 drives the adjuster drive unit 88 in synchronization with the operation to drive the wire swing unit 120. With this operation, when the sheet attraction/separation unit 110 swings, the upstream tension roller 6 is moved due to the driving force exerted by the adjuster drive unit 88 to the sheet stack 1 relative to the bracket 12. With the above-described series of actions, similar to the above-described embodiments, the attraction belt 2 swings about the center of rotation of the upstream tension roller 6, and therefore the sheet attracted to the attraction belt 2 curves at a corner where the inner circumferential surface of the attraction belt 2 contacting the upstream tension roller 6 as a pivot. Accordingly, the restorative force is exerted to the sheet attracted to the attraction belt 2, which can attract only the uppermost sheet to the attraction belt 2 and separate the subsequent sheet 1*b* from the uppermost sheet 1*a*.

Figure 25:
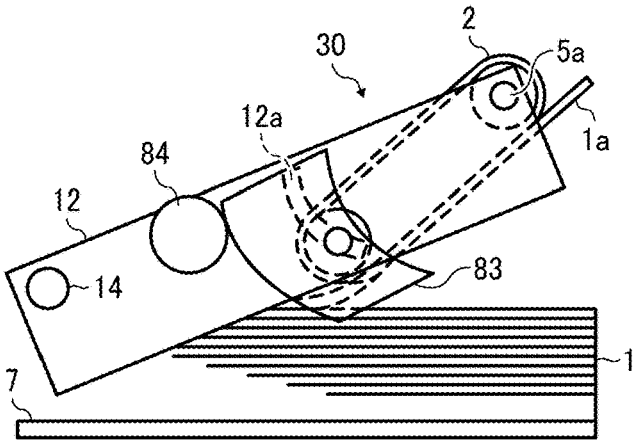
FIG. 25 is a diagram illustrating an example of a stop position in a slot of the upstream tension roller in the sheet feeder.

Then, when the period of time to drive the adjuster drive unit 88 reaches a given drive time determined based on sheet type information and environmental information, the controller 91 stops the driving of the adjuster drive unit 88. For example, when it is likely that the uppermost sheet 1*a* separates from the attraction belt 2 due to the large angle of inclination of the attraction belt 2 if thick papers or sheets having high rigidity are accommodated in the sheet tray 11 or under the high-humidity condition, the driving of the adjuster drive unit 88 is stopped before the shaft 6*a* of the upstream tension roller 6 comes into contact with the lower end surface 41*a* of the slot 12*a*. By contrast, even if the driving of the adjuster drive unit 88 is stopped, the swing unit 120 continues to drive to rotate the sheet attraction/separation unit 110. As a result, as illustrated in FIG. 25, the upstream tension roller 6 separates from the upper surface of the sheet stack 1 without reaching and contacting the low end 41*a* of the slot 12*a*. With this action, when compared with a configuration in which the upstream tension roller 6 separates from the upper surface of the sheet stack 1 after the upstream tension roller 6 has come into contact with and abutted against the lower end surface 41*a* of the slot 12*a*, the range of swing of the attraction belt 2 can be shorter, and therefore the angle of inclination of the attraction belt 2 formed when the upstream tension roller 6 separates from the upper surface of the sheet stack 1 can be reduced. As a result, when a sheet having a rigidity is separated and conveyed or under a condition of high humidity, the uppermost sheet 1*a* can be conveyed without separating from the attraction belt 2. Therefore, a sheet conveying failure can be prevented.

Further, when the sheets having a lower electrical resistance, that is, the sheets having a relatively small attractive force to the attraction belt 2 are accommodated in the sheet tray 11, the driving of the adjuster drive unit 88 is stopped before the upstream tension roller 6 comes into contact with the lower end surface 41*a* of the bracket 12*a* to make the angle of inclination of the attraction belt 2 small when the upstream tension roller 6 separates from the sheet stack 1. By so doing, even if the attractive force of the sheet is small, the restorative force of the sheet cannot be greater than the attractive force of the sheet, thereby preventing the separation of the uppermost sheet 1*a* from the attraction belt 2.

On the other hand, it is likely difficult for the subsequent sheet 1*b* to be separated from the attraction belt 2 at a small angle of inclination of the attraction belt 2 when thin papers having a relatively small rigidity are accommodated in the sheet tray 11 or when the sheets in the sheet tray 11 are stored in a low-humidity condition. In this case, the controller 91 can cause the adjuster drive unit 88 to continue to drive longer until the shaft 6*a* of the upstream tension roller 6 abuts against the low end 41*a* of the slot 12*a*. With this operation, the range of swing of the attraction belt 2 can become greater, and the angle of inclination of the attraction belt 2 can be set larger. Therefore, with separation and conveyance of a sheet having a small rigidity or under the low humidity condition, the second and subsequent sheets can be separated from the attraction belt 2 reliably. Accordingly, a multi-feed error in which multiple sheets are fed at one time can be prevented.

As described above, in the present embodiment, the range of swing of the sheet attraction/separation unit 110 is determined according to various conditions such as sheet thickness, so that the sheet separation position of the sheet attraction/separation unit 110 is different. Specifically, when conveying a sheet having a high rigidity such as a thick paper, the range of swing of the attraction belt 2 is reduced to bend the sheet lightly. By contrast, when conveying a sheet having a low rigidity such as a thin paper, the range of swing of the attraction belt 2 is increased to bend the sheet greatly.

However, even if the low-rigidity sheet is bent greatly, there were some cases that a second or subsequent sheet did not separate from the uppermost sheet. By earnest research of the above-described function, a curvature of the curved part of a sheet is recognized to influence significantly to separation performance. In addition, it is found that the leading edge of a sheet is a most separable part.

With the above-described results obtained by the research, the sheet feeder 200 according to the present embodiment provides a pressing unit 35 that functions as a sheet separator to bend the attraction belt 2 with an optimal curvature according to rigidity of each sheet, so that sheets except for the uppermost sheet 1*a* are separated from the attraction belt 2.

A detailed description is given of a configuration and functions of the pressing unit 35 with reference to FIGS. 26A through 30.

Figure 26A:
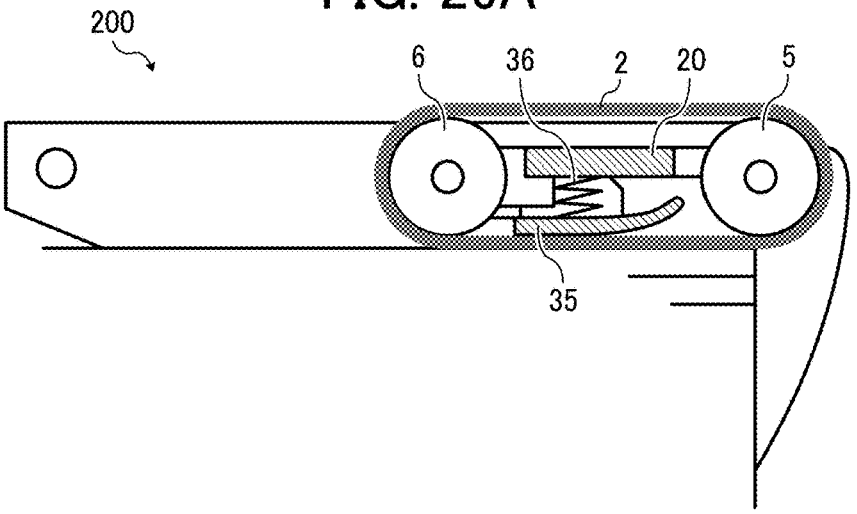
FIG. 26A is a diagram illustrating the attraction/separation unit at a sheet contact position.
Figure 26B:
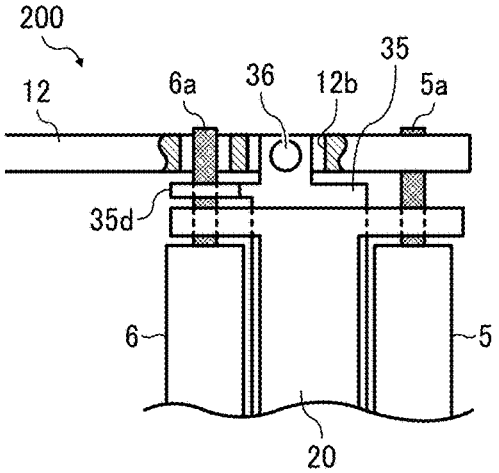
FIG. 26B is a top view illustrating one end of the sheet in the belt width direction that is a direction perpendicular to a sheet feeding direction of the attraction/separation unit.

FIG. 26A is a diagram illustrating a state in which the sheet attraction/separation unit 110 is at the sheet contact position. FIG. 26B is a top view illustrating one end of a sheet in the belt width direction that is a direction perpendicular to the sheet feeding direction of the sheet attraction/separation unit 110.

As illustrated in FIGS. 26A and 26B, the sheet feeder 200 includes the pressing unit 35 inside the end loop of the attraction belt 2 to press the attraction belt 2 toward the sheet stack 1.

Figure 27:
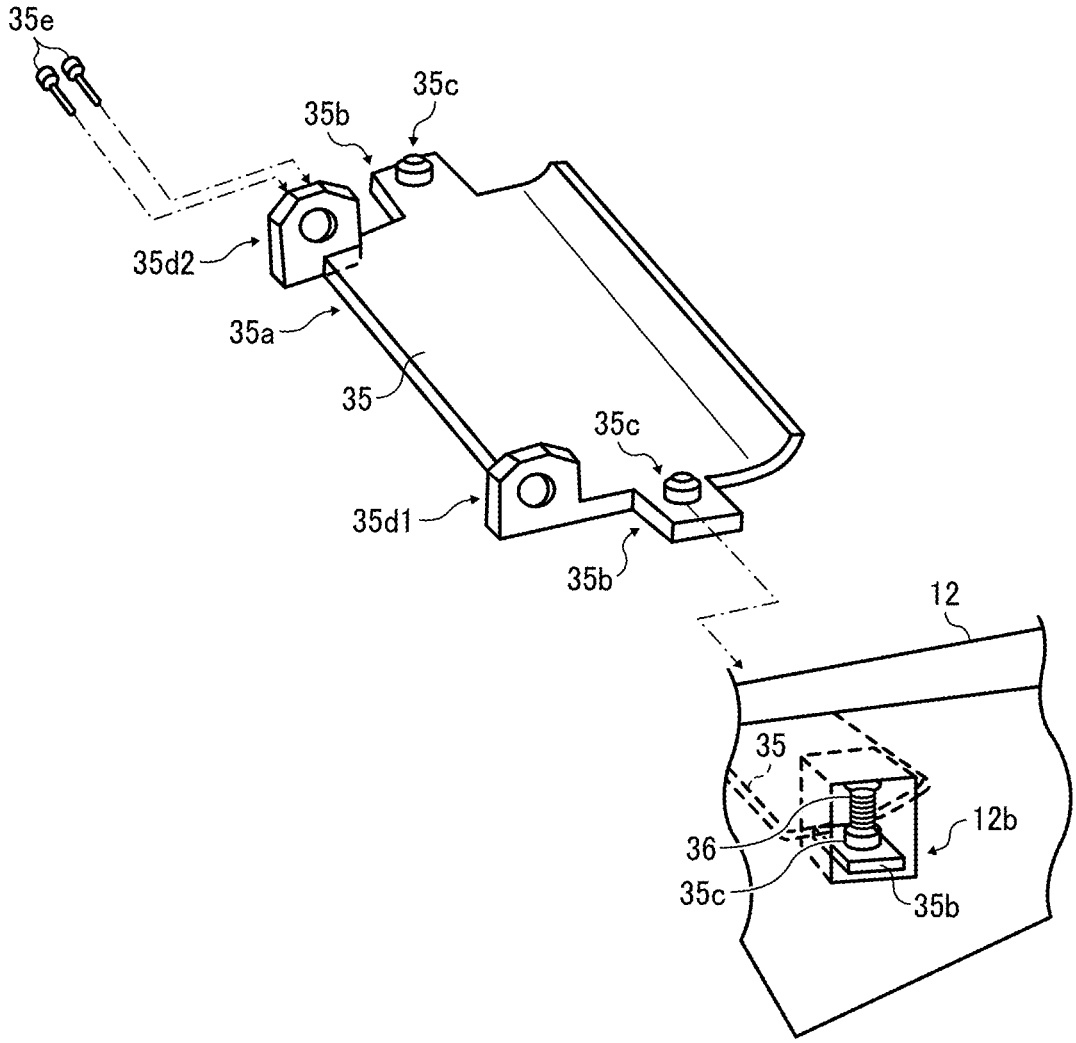
FIG. 27 is a perspective view illustrating a pressing unit.

FIG. 27 is a perspective view illustrating the pressing unit 35.

As illustrated in FIG. 27, the pressing unit 35 includes a pressing unit body 35*a*, two holder parts 35*b*, compression spring setting portions 35*c*, shaft holes 35*d*1 and 35*d*2, and fixing screws 35*e*.

The pressing unit body 35*a* is a planar member that contacts the attraction belt 2. The holder parts 35*b* are mounted on both ends in a sheet width direction of the pressing unit body 35*a*. The holder parts 35*b* are supported by the respective slots 12*b* of the brackets 12. The compression spring setting portions 35*c* are projection-shaped and disposed on the respective surfaces of the holder parts 35*b*. The compression springs 36, each of which functions as an elastic member to bias the pressing unit 35, are mounted on the respective compression spring setting portions 35*c*. The shaft holes 35*d*1 and 35*d*2 are disposed on a downstream side of the pressing unit body 35*a* in the sheet feeding direction. Each of the shaft holes 35*d*1 and 35*d*2 is provided with a shaft opening through which the shaft 5*a* of the downstream tension roller 5 passes.

The shaft hole 35*b*2 is provided on a separable body that is detachably attached to the pressing unit body 35*a*. The shaft hole 35*b*2 formed on the separable body is attached with the fixing screws 35*e* to the pressing unit body 35*a* on which the shaft hole 35*b*1 is formed.

When assembling the pressing unit 35 to the shaft 6*a* of the upstream tension roller 6, after the separable body having the shaft hole 35*b*2 thereon is detached from the pressing unit body 35*a*, the shaft 6*a* of the upstream tension roller 6 is inserted into the shaft hole 35*b*1 on the pressing unit body 35*a*, so that the shaft 6*a* of the upstream tension roller 6 is rotatably supported. Then, while the shaft 6*a* of the upstream tension roller 6 is being inserted into the shaft hole 35*b*2 of the separable body that is detached from the pressing unit body 35*a*, the shaft hole 35*b*2 is fixed to the pressing unit body 35*a* with the fixing screws 35*e*.

Figure 28:
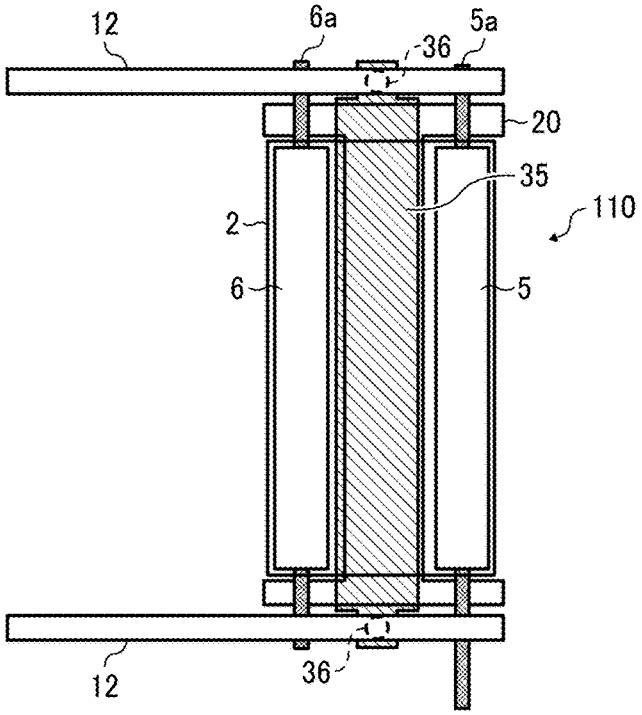
FIG. 28 is a top view illustrating the attraction/separation unit with a compression spring provided on the bracket.

One end of the compression spring 36 is fitted into and connected to the projecting compression spring setting portion 35*c* of the pressing unit 35, and an opposite end of the compression spring 36 is connected to an upper end of the slot 12*b* formed on the bracket 12 of the sheet attraction/separation unit 110. In this configuration as illustrated in FIG. 28, the pressing unit 35 is pressed against the attraction belt 2 with the compression springs 36 disposed at both ends in the sheet width direction of the sheet attraction/separation unit 110, in other words, disposed on the brackets 12.

Further, as illustrated in FIG. 26B, the pressing unit 35 is rotatably attached to the shaft 6*a* of the upstream tension roller 6 via the shaft holes 35*d*. During a sheet attraction operation, the pressing unit 35 presses the attraction belt 2 from the inner circumferential surface of the attraction belt 2 to the outer circumferential surface of the attraction belt 2 due to the weight of the pressing unit 35 itself and a biasing force applied by the compression spring 36. By so doing, the attraction belt 2 is pressed against an upper surface of the uppermost sheet 1*a*. This pressing of the attraction belt 2 against the uppermost sheet 1*a* prevents gaps or space formed by twist of the attraction belt 2 and/or the uppermost sheet 1*a* from occurring between the attraction belt 2 and the uppermost sheet 1*a*. As a result, a good contact performance between the attraction belt 2 and the uppermost sheet 1*a* can be achieved.

The length in the sheet width direction of the pressing unit 35 is preferably greater than the length of the sheet width direction. Therefore, in the present embodiment, the width in the sheet width direction of the pressing unit 35 is made greater than the maximum sheet width that can be operated by the sheet feeder 200. By setting the width in the sheet width direction of the pressing unit 35 greater than the maximum sheet width acceptable by the sheet feeder 200, the pressing unit 35 can handle every acceptable sheet size of the sheet feeder 200 effectively.

Further, it is preferable that the pressing unit 35 has a pressing width as wide as possible with respect to the attraction belt 2 in the sheet feeding direction. Specifically, the pressing width of the pressing unit 35 to press the attraction belt 2 in the sheet feeding direction is preferably from about 70 percent (%) to about 80 percent (%) with respect to a tensioned area of the attraction belt 2 wound by the downstream tension roller 5 and the upstream tension roller 6.

In the present embodiment, the pressing unit 35 is a planar member. Compared to a roller-type pressing unit, the pressing unit 35 having a planar shape can obtain the pressing width of the pressing unit 35 to press the attraction belt 2 to be about 70 percent to 80 percent of the tensioned area of the attraction belt 2.

Figure 29:
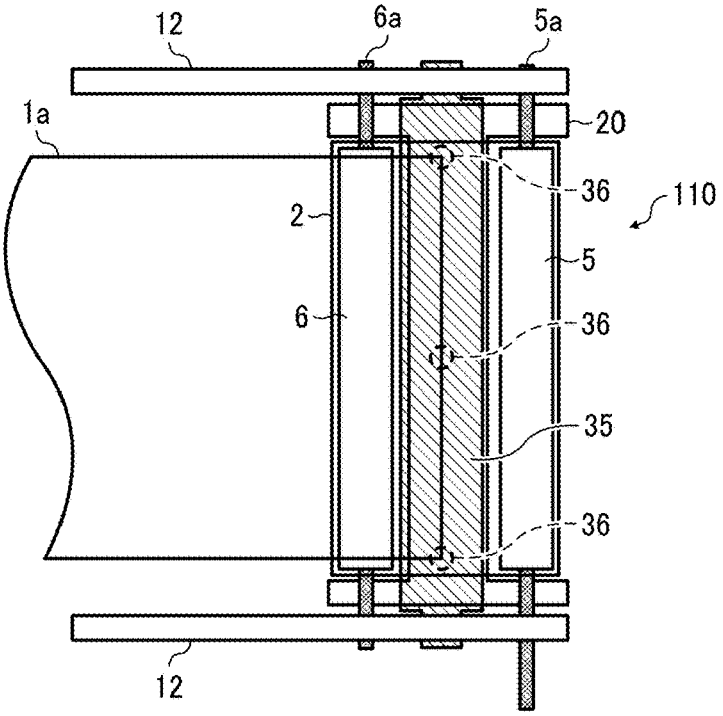
FIG. 29 is a top view illustrating the attraction/separation unit with a compression spring provided to the attraction belt inside from the bracket in a range within the belt width direction of the sheet.

FIG. 29 illustrates the sheet attraction/separation unit 110 having the compression springs 36. The compression springs 36 are disposed at the inner circumferential surface in the sheet width direction of the area between the brackets 12 and mounted on the housing 20 disposed at the inner circumferential surface of the attraction belt 2, so that the compression springs 36 press the pressing unit 35 against the attraction belt 2.

As illustrated in FIG. 28, it is most preferable for assembly and replacement that the compression springs 36 are mounted on the brackets 12 of the sheet attraction/separation unit 110. In that case, however, the compression springs 36 may be disposed at the outer circumferential surface of both ends in the sheet width direction of the area between the brackets 12. When attracting a cut sheet having a width of 297 mm such as an A4-size sheet in a landscape direction and an A4-size sheet in a portrait direction, it is preferable to locate the compression springs 36 to press on or about both ends in the sheet width direction of the cut sheet. Therefore, as illustrated in FIG. 29, the compression springs 36 are mounted on the housing 20 that is disposed at the inner circumferential surface of the attraction belt 2. Consequently, this configuration can enhance effectiveness to obtain better sheet attraction performance compared to a configuration in which the compression springs 36 are disposed on the brackets 12 arranged at both ends in the sheet width direction of the sheet attraction/separation unit 110.

Figure 30:
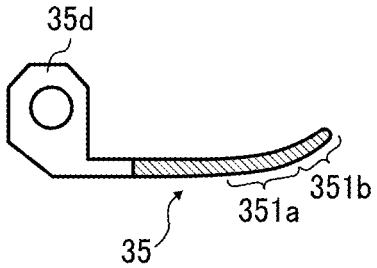
FIG. 30 is a cross-sectional view of the pressing unit.

FIG. 30 is a cross-sectional view of the pressing unit 35.

As illustrated in FIG. 30, the pressing unit 35 has two different curved parts 351*a* and 351*b* at the leading edge thereof. The first curved part 351*a* that functions as a pressing part is supported at an upstream side by the upstream tension roller 6 and has a radius of curvature R1. The second curved part 351*b* that also functions as a pressing part is disposed downstream from and adjacent to the first curved part 351*a* in the sheet feeding direction and has a radius of curvature R2. The relation of the radius of curvature R1 and the radius of curvature R2 is expressed as R2<R1. That is, the second curved part 351*b* that is formed at the distal part of the leading edge of the pressing unit 35 has a greater curvature than the first curved part 351*a* that is formed at the proximal part of the leading edge of the pressing unit 35. The curvature of the first curved part 351*a* is set so that the uppermost sheet 1*a* does not separate from the attraction belt 2 when bending a thick paper or a sheet having a high rigidity as the uppermost sheet 1*a* attracted to the attraction belt 2. By contrast, the curvature of the second curved part 351*b* is set so that the second or subsequent sheet separates from the uppermost sheet 1*a* when bending a thin paper or a sheet having a low rigidity as the uppermost sheet 1*a* attached to the attraction belt 2.

Figure 31A:
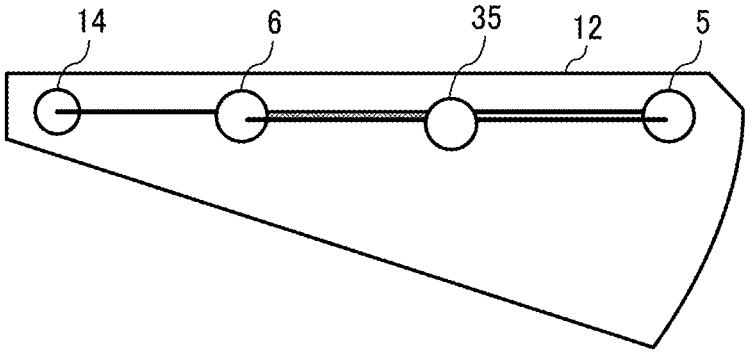
FIG. 31A is a diagram illustrating respective positions of the units and components when the attraction belt is at the sheet contact position.
Figure 31B:
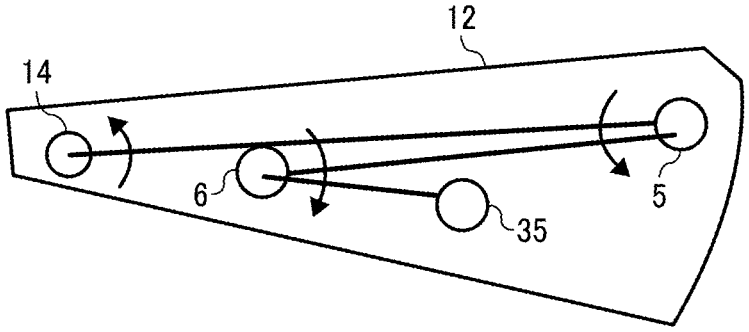
FIG. 31B is a diagram illustrating respective positions of the units and components when the attraction belt is at the sheet separation position.

FIGS. 31A and 31B are diagrams illustrating respective movements of the parts and units when the attraction belt 2 moves from the sheet contact position to the sheet separation position. It is to be noted that, for convenience of drawing, each part or unit is illustrated in a round shape.

When the attraction belt 2 is located at the sheet contact position at which the attraction belt 2 contacts the uppermost sheet 1*a* of the sheet stack 1, the downstream tension roller 5, the pressing unit 35, and the upstream tension roller 6 are aligned in a substantially straight line as illustrated in FIG. 31A.

As the bracket 12 is rotated about the supporting shaft 14 counterclockwise in FIG. 31A, the downstream tension roller 5 moves about the supporting shaft 14 counterclockwise as illustrated in FIG. 31B. Then, the upstream tension roller 6 moves about the downstream tension roller 5 counterclockwise as illustrated in FIG. 31B, and the pressing unit 35 rotates about the upstream tension roller 6 clockwise.

Figure 32A:
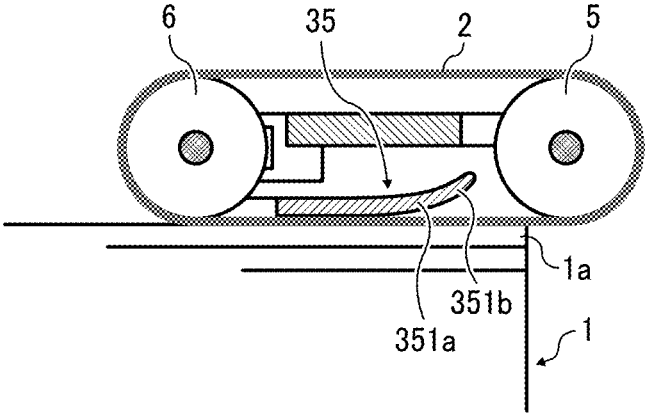
FIGS. 32A and 32B are diagrams illustrating a series of a sheet separating operation when a stack of thick papers is loaded.
Figure 32B:
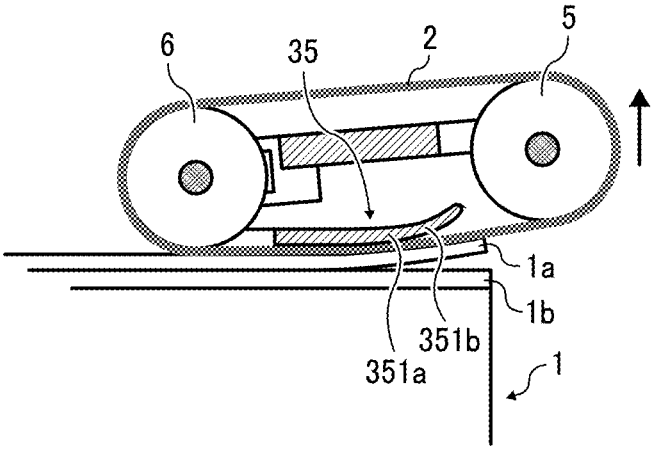

A description is given of operations of separating thick papers with reference to FIGS. 32A and 32B.

As illustrated in FIG. 32A, when the attraction belt 2 is at the sheet contact position, the pressing unit 35 causes the attraction belt 2 to press against the uppermost sheet 1*a*. At this time, the holder parts 35*b* of the pressing unit 35 are separated from the lower end surface of the slot 12*b* of each bracket 12. Further, a portion upstream from the first curved part 351*a* of the pressing unit 35 in the sheet feeding direction contacts the attraction belt 2, and therefore the first curved part 351*a* and the second curved part 351*b* are separated from the attraction belt 2.

As the sheet attraction/separation unit 110 swings to elevate the attraction belt 2 from the sheet contact position to the sheet separation position, the downstream tension roller 5 is lifted to separate from the upper surface of the sheet stack 1.

By contrast, the shaft 6*a* of the upstream tension roller 6 and the holder parts 35*b* of the pressing unit 35 move downward along the respective slots 12*a* and 12*b*. According to the movement, the attraction belt 2 is pressed by the pressing unit 35 toward the sheet stack 1, and therefore an upstream portion from the pressing portion of the attraction belt 2 by the pressing unit 35 remains in contact with the upper surface of the sheet stack 1. By contrast, a downstream portion from the pressing portion of the attraction belt 2 by the pressing unit 35 is lifted and separated from the upper surface of the sheet stack 1. With this action, the uppermost sheet 1*a* attracted to the attraction belt 2 is while the upstream portion from the pressing portion of the uppermost sheet 1*a* attracted to the attraction belt 2 is pressed by the attraction belt 2, the downstream portion from the pressing portion of the uppermost sheet 1*a* (the leading edge of the uppermost sheet 1*a*) is lifted by the attraction force of the attraction belt 2. Then, when the attraction belt 2 is inclined to form the angle of inclination for the thick paper, driving of the adjuster drive unit 88 of the swing range adjusting unit 80 is stopped and the movement of the shaft 6*a* of the upstream tension roller 6 in the slot 12*a* is stopped. Before stopping the driving of the adjuster drive unit 88, the attraction belt 2 is further lifted by the downstream tension roller 5. Thereafter, as illustrated in FIG. 32B, the attraction belt 2 contacts the first curved part 351*a* of the pressing unit 35. By so doing, the attraction belt 2 bends at the curvature of the first curved part 351*a*, and the uppermost sheet 1*a* attracted to the attraction belt 2 bends along with the bending of the attraction belt 2. Accordingly, the uppermost sheet 1*a* attracted to the attraction belt 2 bends at the curvature of the first curved part 351*a*. When the uppermost sheet 1*a* is belt, the curvature of the first curved part 351*a* is arranged not to separate from the attraction belt 2. Consequently, as illustrated in FIG. 32B, the subsequent sheet 1*b* can be separated from the uppermost sheet 1*a* without separating the uppermost sheet 1*a* from the attraction belt 2. Thereafter, the upstream tension roller 6 separates from the sheet stack 1 and the attraction belt 2 moves to the sheet separation position.

Further, the sheet feeder 200 further includes a unit to restrict rotation of the pressing unit 35 when the adjuster drive unit 88 stops driving. According to this configuration, after the driving of the adjuster drive unit 88 has been stopped, the pressing unit 35 rotates no more. Therefore, when the attraction belt 2 is moved to the sheet separation position from the state illustrated in FIG. 32B, the pressing unit 35 does not further bend the attraction belt 2 by rotating about the shaft 6*a* of the upstream tension roller 6. Accordingly, the uppermost sheet 1*a* does not separate from the attraction belt 2.

As described above, in the present embodiment, the thick paper can be bent by the curvature of the first curved part 351*a* of the pressing unit 35. Accordingly, the thick paper can be bent reliably with the curvature by which the uppermost sheet 1*a* does not separate from the attraction belt 2 and the uppermost sheet 1*a* can be well prevented from separating from the attraction belt 2.

Figure 33A:
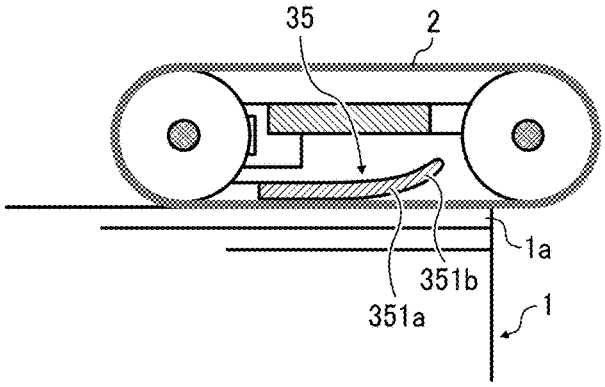
FIGS. 33A through 33C are diagrams illustrating a sheet separating operation when a stack of thin papers is loaded.
Figure 33B:
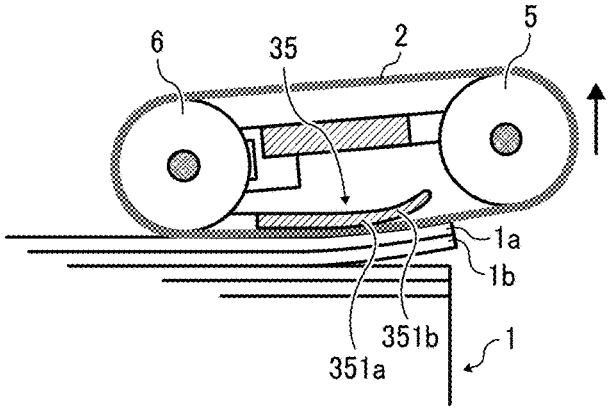
Figure 33C:
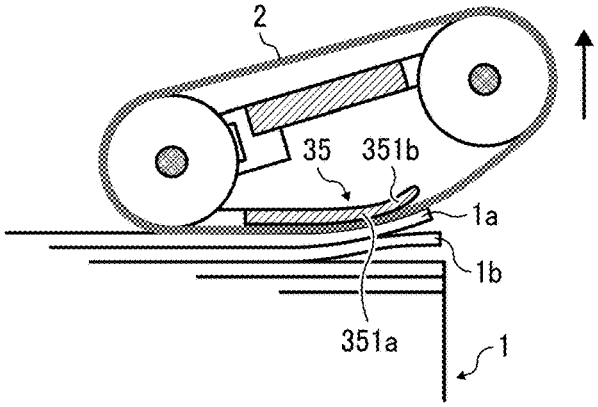

A description is given of operations of separating thin papers with reference to FIGS. 33A through 33C.

Similar to the description about the thick papers, when the attraction belt 2 is lifted from the sheet contact position illustrated in FIG. 33A to a position illustrated in FIG. 33B, the attraction belt 2 contacts the first curved part 351*a* of the pressing unit 35. Consequently, the uppermost sheet 1*a* attracted to the attraction belt 2 bends due to the curvature of the first curved part 351*a*. At this time, however, the uppermost sheet 1*a* attracted to the attraction belt 2 is a thin paper having a low rigidity. Therefore, even if the uppermost sheet 1*a* bends with the aid of the curvature of the first curved part 351*a*, the subsequent sheet 1*b* does not separate from the uppermost sheet 1*a*. When handling thin papers, the adjuster drive unit 88 of the swing range adjusting unit 80 does not stop driving until the shaft 6*a* of the upstream tension roller 6 contacts the lower end surface 41*a* of the slot 12*a*. Therefore, as the sheet attraction/separation unit 110 is further swung from the state in FIG. 33B, the shaft 6*a* of the upstream tension roller 6 and the holder parts 35*b* of the pressing unit 35 move downwardly in the slots 12*a* and 12*b*, respectively. When the shaft 6*a* of the upstream tension roller 6 and the holder parts 35*b* of the pressing unit 35 abut against the lower end surfaces of the slots 12*a* and 12*b*, the adjuster drive unit 88 of the swing range adjusting unit 80 stops driving. At this time, as illustrated in FIG. 33C, the downstream portion of the attraction belt 2 is further lifted, so that the attraction belt 2 contacts the second curved part 351*b*. As a result, a portion of the attraction belt 2 bends due to the curvature of the second curved part 351*b*.

As described above, the curvature of the second curved part 351*b* is greater than the curvature of the first curved part 351*a*. Further, the second curved part 351*b* is disposed downstream from the first curved part 351*a* in the sheet feeding direction. Therefore, the sheets having a low rigidity such as thin papers are bent with the curvature greater than the thick paper at the leading edge of the thin paper that is closer to the tip of the paper than the leading edge of the thick paper. Consequently, for the sheet having a low rigidity, the subsequent sheet 1*b* can be well separated from the uppermost sheet 1*a*. Thereafter, the upstream tension roller 6 separates from the sheet stack 1 and the attraction belt 2 moves to the sheet separation position.

Further, in the present embodiment, by disposing the pressing unit 35, the uppermost sheet 1*a* can be belt at or about the leading edge thereof. As the pressing unit 35 is disposed closer to the leading edge of the uppermost sheet 1*a*, the area to separate the subsequent sheet 1*b* from the uppermost sheet 1*a* is reduced. Therefore, a smaller force (rigidity of the subsequent sheet 1*b*) is required for the subsequent sheet 1*b* to separate from the uppermost sheet 1*a*. Consequently, the subsequent sheet 1*b* can be separated from the uppermost sheet 1*a* without bending the uppermost sheet 1*a* greatly. As a result, the angle of inclination of the attraction belt 2 with respect to the sheet stack 1 can be reduced, and therefore the amount of swing of the sheet attraction/separation unit 110 can also be reduced.

Further, by disposing the pressing unit 35, the attraction belt 2 can be bent about the downstream tension roller 5. With this configuration, a slope at the downstream side from the pressing portion of the attraction belt 2 pressed by the pressing unit 35 can be formed more easily than the pressing portion of the attraction belt 2. As a result, the amount of movement of the downstream tension roller 5 from the sheet stack 1 to a portion that the attraction belt 2 reaches to form the given angle of inclination can be reduced, when compared with the amount thereof by rotating about the upstream tension roller 6 to bend the uppermost sheet 1*a*.

Accordingly, the amount of swing of the sheet attraction/separation unit 110 can be further reduced.

As described above, by disposing the pressing unit 35, the amount of swing of the sheet attraction/separation unit 110 can be reduced, a time of movement of the attraction belt 2 between the sheet contact position and the sheet separation position, and production performance (i.e., the number of sheets conveyed per unit time) can be enhanced.

EXEMPLARY VARIATION 1.

Next, a description is given of a sheet feeder 200A as Exemplary Variation 1 having a different configuration of the sheet feeder 200, with reference to FIGS. 34 through 37.

Figure 34:
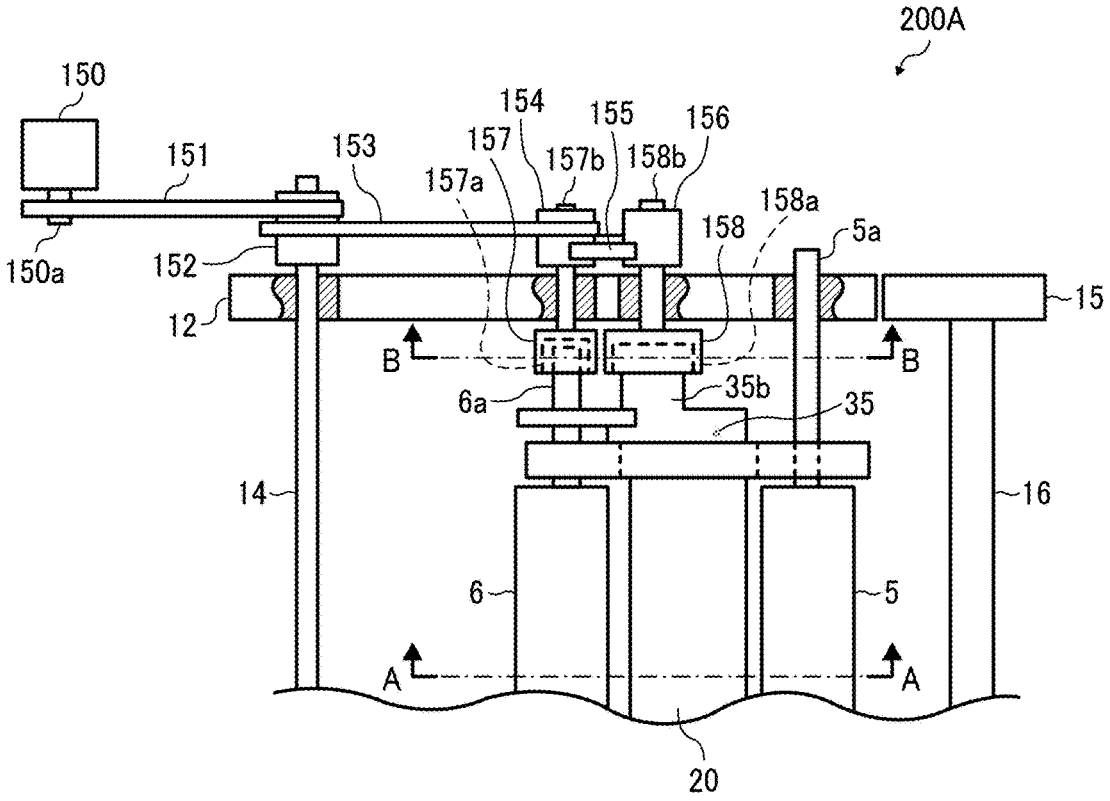
FIG. 34 is a plan view illustrating a configuration of a rear side of the sheet feeder as another example.
Figure 35:
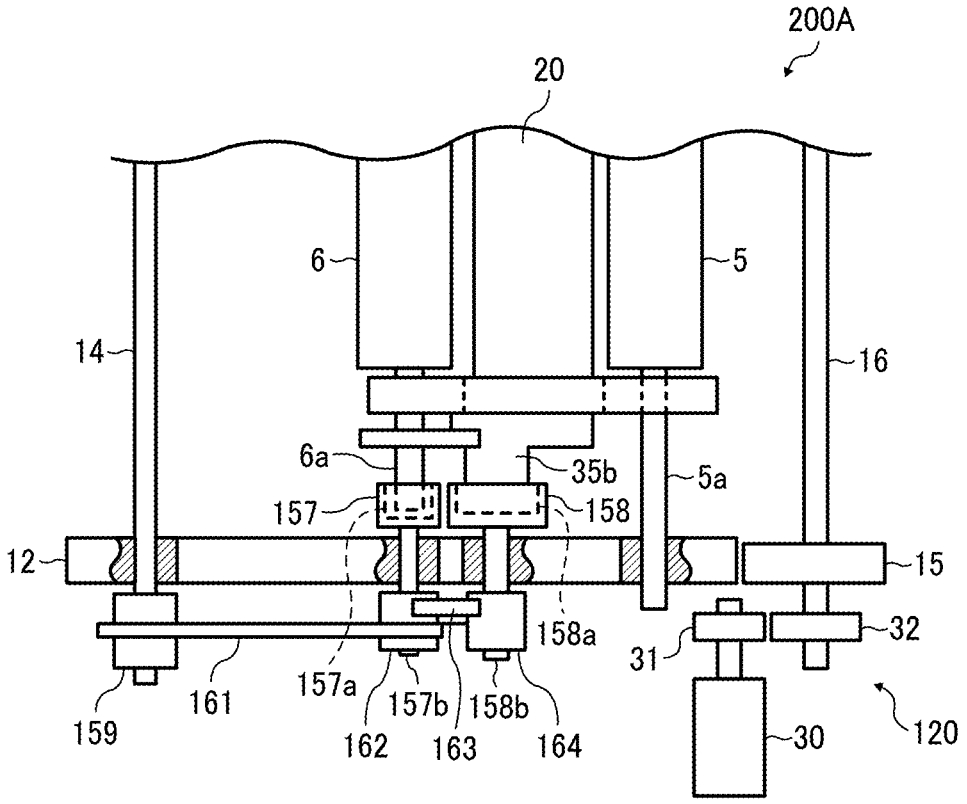
FIG. 35 is a plan view illustrating a configuration of a front side of the sheet feeder of FIG. 34.
Figure 36:
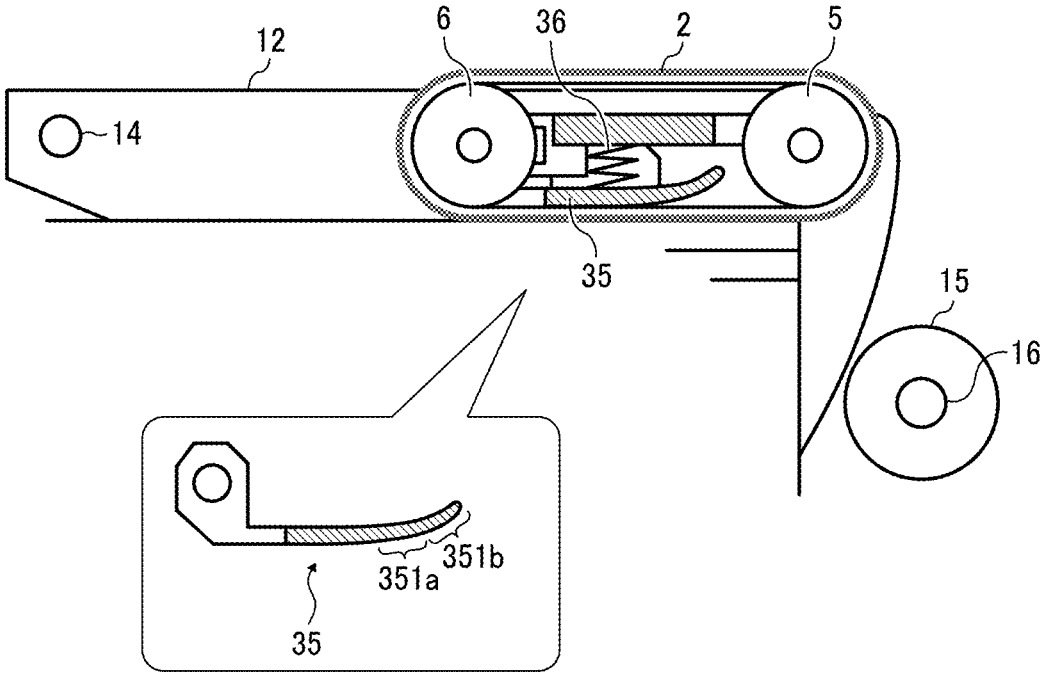
FIG. 36 is a cross sectional view illustrating the sheet feeder of FIG. 34 along a line A-A.
Figure 37:
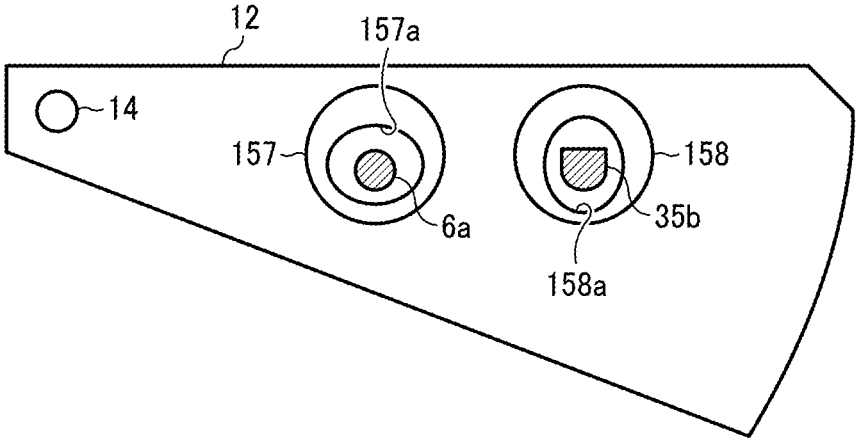
FIG. 37 is a cross sectional view illustrating the sheet feeder of FIG. 34 along a line B-B.

FIG. 34 is a plan view illustrating a rear side of the sheet feeder 200A. FIG. 35 is a plan view illustrating a front side of the sheet feeder 200A. FIG. 36 is a cross sectional view illustrating the sheet feeder 200A along a line A-A of FIG. 34. FIG. 37 is a cross sectional view illustrating the sheet feeder 200A along a line B-B of FIG. 34.

The sheet feeder 200A changes the swing angle of the attraction belt 2 according to rigidity of sheet and adjusts the rotation range of the pressing unit 35. By so doing, the curved part to be contacted to the attraction belt is changed.

Except for the above-described functions, units and components used in the sheet feeder 200A according to Exemplary Variation 1 are basically identical to the units and components used in the sheet feeder 200. Therefore, detailed descriptions of the configuration and functions are omitted.

As illustrated in FIGS. 34 and 35, the sheet feeder 200A according to Exemplary Variation 1 has roller holders 157, each of which is rotatably attached to each bracket 12 to hold the upstream tension roller 6. Hereinafter, the roller holders 157 are described in a singular form. As illustrated in FIG. 37, the roller holder 157 that functions as an angle range adjuster has an elliptical-shaped roller hold opening 157*a* that functions as a roller hold opening. The roller hold opening 157*a* supports the shaft 6*a* of the upstream tension roller 6. Further, the rotation center of the roller hold opening 157*a* is shifted to be eccentric with respect to the rotation center of the roller holder 157.

Further, as illustrated in FIGS. 34 and 35, the sheet feeder 200A according to Exemplary Variation 1 has pressing unit holders 158, each of which is rotatably attached to each bracket 12 to hold the pressing unit 35. Hereinafter, the pressing unit holders 158 are described in a singular form. The pressing unit holder 158 functions as a rotation range adjuster. Similar to the roller holder 157, as illustrated in FIG. 37, the pressing unit holder 158 has an elliptical-shaped pressing unit hold opening 158*a* that functions as a separator hold opening. The pressing unit hold opening 158*a* supports the holder part 35*b* of the pressing unit 35.

In the present Exemplary Variation 1, the elliptical shape of the pressing unit hold opening 158*a* is a different shape from that of the roller hold opening 157*a*. However, the elliptical shape of the pressing unit hold opening 158*a* may be the same as that of the roller hold opening 157*a*. Further, similar to the roller hold opening 157*a*, the rotation center of the pressing unit hold opening 158*a* is shifted to be eccentric with respect to the rotation center of the pressing unit holder 158.

The pressing unit holder 158 and the roller holder 157 are driven to rotate by a switching motor 150. As illustrated in FIG. 34, a drive timing belt 151 is wound around a drive pulley of a motor shaft 150*a* of the switching motor 150 and a multi-stage pulley 152 that is fixed to a rear side end of the supporting shaft 14. A first drive transmission member 154 that has a pulley part and a gear part is fixed at a rear side end of a rotary shaft 157*b* of the roller holder 157. A rear side timing belt 153 is wound around the pulley part of the first drive transmission member 154 and the multi-stage pulley 152. A rear side idler gear 155 is meshed with the gear part of the first drive transmission member 154. The rear side idler gear 155 is meshed with a rear side driven gear 156 that is fixed to a rotary shaft 158*b* of the pressing unit holder 158 disposed at the rear side of the sheet feeder 200A.

Further, as illustrated in FIG. 35, a pulley 159 is fixed at a front side end of the supporting shaft 14. A second drive transmission member 162 that has a pulley part and a gear part is fixed at a front side of the rotary shaft 157*b* of the roller holder 157 disposed at the front side of the sheet feeder 200A. A front side timing belt 161 is wound around he pulley part of the second drive transmission member 162 and a pulley 159. A front side idler gear 163 is meshed with the gear part of the second drive transmission member 162. The front side idler gear 163 is meshed with a front side driven gear 164 that is fixed to the rotary shaft 158*b* of the pressing unit holder 158 disposed at the front side of the sheet feeder 200A.

As illustrated in FIG. 36, the pressing unit 35 according to Exemplary Variation 1 has an identical configuration to the pressing unit 35 according to the above-described embodiment and includes two different curved parts 351*a* and 351*b* at the leading end thereof. Further, as illustrated in FIG. 29, the sheet feeder 200A according to Exemplary Variation 1, there are the compression springs 36 at respective positions on the housing 20 that is disposed inside the loop of the attraction belt 2.

Figure 38A:
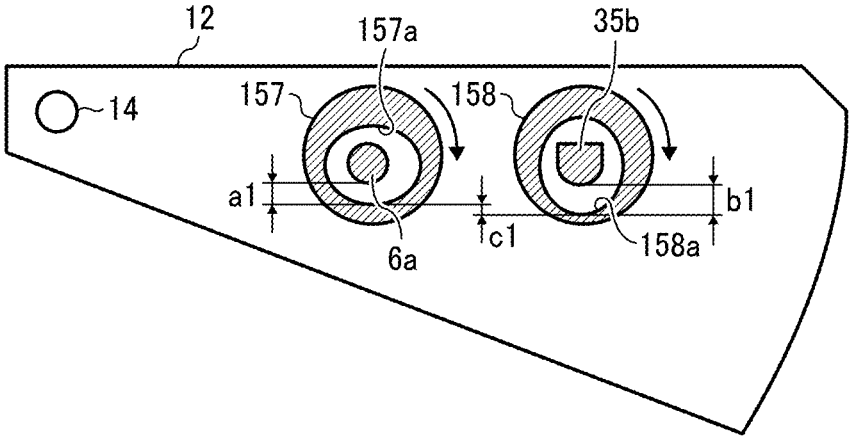
FIG. 38A is a diagram illustrating a setting of a swing angle of the attraction belt and a range of rotation the pressing unit when feeding thin papers.
Figure 38B:
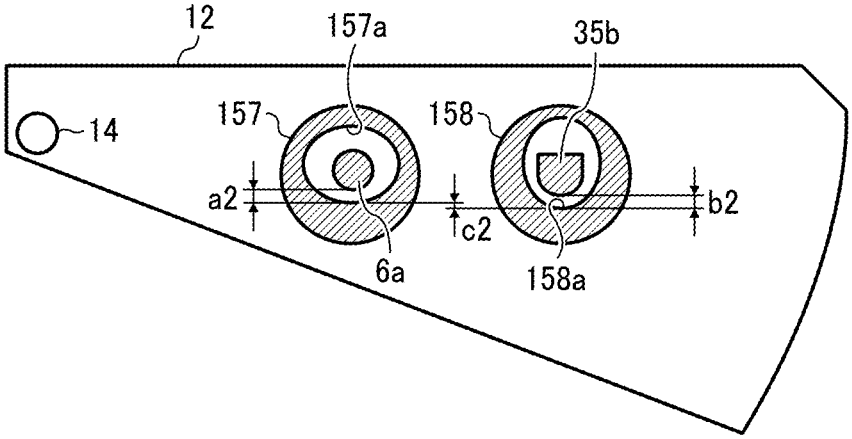
FIG. 38B is a diagram illustrating a setting of a swing angle of the attraction belt and a range of rotation the pressing unit when feeding thick papers.

FIGS. 38A and 38B illustrate diagrams for explaining respective settings of the swing angle of the attraction belt 2 and the range of rotation of the pressing unit 35. FIG. 38A is a diagram illustrating the positions of the roller holder 157 and the pressing unit holder 158 when feeding thin papers and FIG. 38B is a diagram illustrating the positions of the roller holder 157 and the pressing unit holder 158 when feeding thick papers. Both FIGS. 38A and 38B illustrate a state in which the attraction belt 2 is at the sheet contact position at which the attraction belt 2 contacts the uppermost sheet 1*a* of the sheet stack 1.

As illustrated in FIG. 38A, when a thin paper is fed, a distance between the lower end of the roller hold opening 157*a* and the shaft 6*a* of the upstream tension roller 6 is represented as a distance "a1" and a distance between the lower end of the pressing unit hold opening 158*a* and the holder part 35*b* of the pressing unit 35 is represented as a distance "b1". Specifically, in handling the thin paper, the range of movement of the upstream tension roller 6 in a vertical direction when the attraction belt 2 moves from the sheet contact position to the sheet separation position is the distance "a1" and the range of movement of the pressing unit 35 when the attraction belt 2 moves from the sheet contact position to the sheet separation position is the distance "b1". Further, a distance between the lower end of the roller hold opening 157*a* and the lower end of the pressing unit hold opening 158*a* is represented as a distance "c1".

By setting the distance between the lower end of the roller hold opening 157*a* and the lower end of the pressing unit hold opening 158*a* as the distance "c1", when feeding the thin paper, the pressing unit 35 and the upstream tension roller 6 can separate from the sheet stack 1 simultaneously. Specifically, the holder part 35*b* of the pressing unit 35 contacts the lower end of the pressing unit hold opening 158*a*, and at the same time the shaft 6*a* of the upstream tension roller 6 contacts the lower end of the roller hold opening 157*a*. The above-described operations are performed because the bracket 12 rotates about the supporting shaft 14 and the amount of elevation of the bracket 12 varies according to a distance from the supporting shaft 14. Specifically, since a distance between the supporting shaft 14 and the pressing unit holder 158 is longer than a distance between the supporting shaft 14 and the roller holder 157, the pressing unit holder 158 moves more than the roller holder 157 when the bracket 12 is rotated. Accordingly, when the attraction belt 2 is at the sheet contact position, the lower end of the pressing unit hold opening 158*a* is disposed lower by the distance "c1" than the lower end of the roller hold opening 157*a*. By so doing, the holder part 35*b* of the pressing unit 35 and the shaft 6*a* of the upstream tension roller 6 can simultaneously contact the lower end of the roller hold opening 157*a* and the lower end of the pressing unit hold opening 158*a*, respectively.

The switching motor 150 illustrated in FIG. 34 is driven when setting the swing angle of the attraction belt 2 and the rotation range of the pressing unit 35 for feeding thick papers as illustrated in FIG. 38B. When the switching motor 150 is driven, a driving force exerted by the switching motor 150 is transmitted to the multi-stage pulley 152 via the drive timing belt 151. The driving force is further transmitted from the multi-stage pulley 152 to the first drive transmission member 154 via the rear side timing belt 153. Consequently, the roller holder 157 disposed on the rear side of the image forming apparatus 100 rotates clockwise as illustrated in FIG. 37. Further, the driving force is further transmitted from the first drive transmission member 154 to the rear side driven gear 158 via the rear side idler gear 155. As a result, the pressing unit holder 158 disposed on the rear side of the image forming apparatus 100 rotates clockwise as illustrated in FIG. 37.

Further, the driving force transmitted to the multi-stage pulley 152 via the drive timing belt 151 rotates the supporting shaft 14. According to this operation, the pulley 159 that is fixed to the front side end of the supporting shaft 14 illustrated in FIG. 35 is rotated and the driving force of the switching motor 150 is transmitted to the second drive transmission member 162 via the front side timing belt 161 so as to rotate the roller holder 157 disposed on the front side of the sheet feeder 200A. Further, the driving force transmitted to the second drive transmission member 162 is transmitted to the front side driven gear 164 via the front side idler gear 163 so as to rotate the pressing unit holder 158 on the front side of the sheet feeder 200A clockwise in FIG. 35.

When the roller holder 157 and the pressing unit holder 158 perform a half turn rotation or rotate by half of one cycle of the respective rotations, the switching motor 150 stops its driving so as to stop the roller holder 157 and the pressing unit holder 158 in the positions illustrated in FIG. 38B.

As illustrated in FIG. 38B, when a thick paper is fed, a distance between the lower end of the roller hold opening 157*a* and the shaft 6*a* of the upstream tension roller 6 is represented as a distance "a2" that is shorter or smaller than the distance "a1", so that the range of movement of the upstream tension roller 6 in a vertical direction is changed.

Further, a distance between the lower end of the pressing unit hold opening 158*a* and the holder part 35*b* of the pressing unit 35 is represented as a distance "b2" that is shorter or smaller than the distance "b1", so that the range of rotation of the pressing unit 35 is changed. In addition, a distance between the lower end of the roller hold opening 157*a* and the lower end of the pressing unit hold opening 158*a* for feeding the thick paper is represented as a distance "c2" that is shorter or smaller than the distance "c1" for feeding the thin paper.

The angle of movement of the attraction belt 2 in handling the thick paper is smaller than that in handling the thin paper. Therefore, when handling the thick paper, the upstream tension roller 6 is separated from the sheet stack 1 at an earlier timing than when handling the thin paper. For this reason, the distance "a2" is set shorter than the distance "a1".

Further, the first curved part 351*a* of the pressing unit 35 contacts the attraction belt 2 when the thick paper is fed. Therefore, when handling the thick paper, the pressing unit 35 rotates by a less amount than when handling the thin paper. For this reason, the distance "b2" is shorter than the distance "b1".

Further, the distances "a2" and "b2" in handling the thick paper are shorter than the distances "a1" and "b1" in handling the thin paper. Therefore, when handling the thick paper, the pressing unit 35 and the upstream tension roller 6 are separated from the sheet stack 1 at an earlier timing than when handling the thin paper. As the amount of movement of the bracket 12 increases, the difference between the amount of movement of the roller holder 157 and the amount of movement of the pressing unit holder 158 increases. For this reason, the distance "c2" is shorter than the distance "c1".

Further, as described above, the amounts of elevation of the roller holder 157 and the pressing unit holder 158 are different from each other. Since the shapes of the roller hold opening 157*a* and the pressing unit hold opening 158*a* are determined to be different according to the amounts of elevation of the roller holder 157 and the pressing unit holder 158, respectively.

FIGS. 39A through 39D are diagrams illustrating a series of sheet separating operations in handling the thick paper in the configuration according to Exemplary Variation 1. FIGS. 40A through 40C are diagrams illustrating respective movements of units and components in the sheet separating operations in the configuration according to Exemplary Variation 1.

Figure 39A:
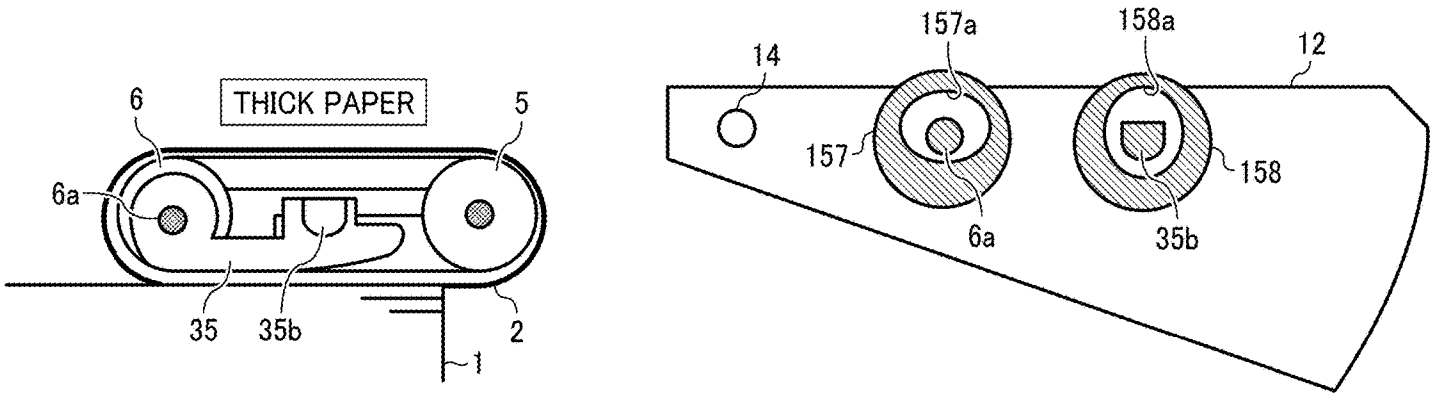
Figure 39B:
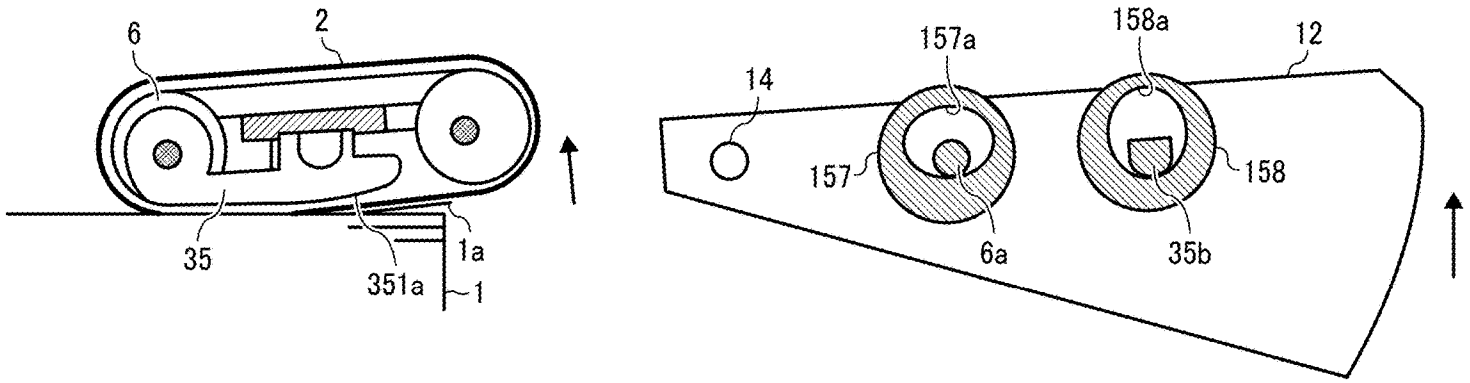
Figure 40A:
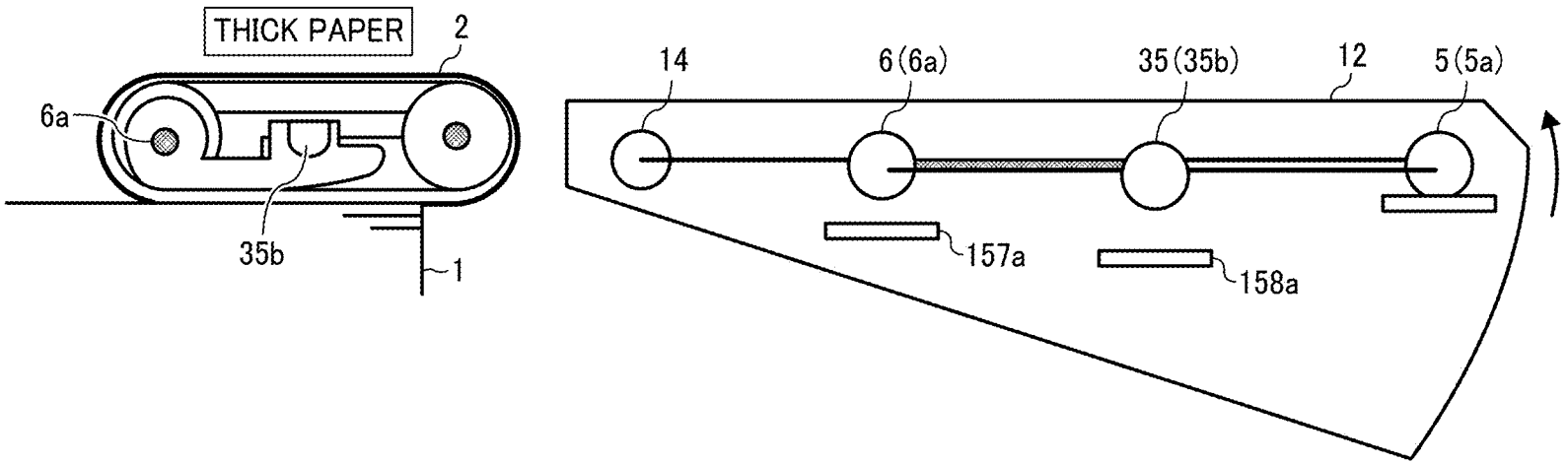
FIGS. 40A through 40C are diagrams illustrating respective movements of units and components in the sheet separating operations.
Figure 40B:
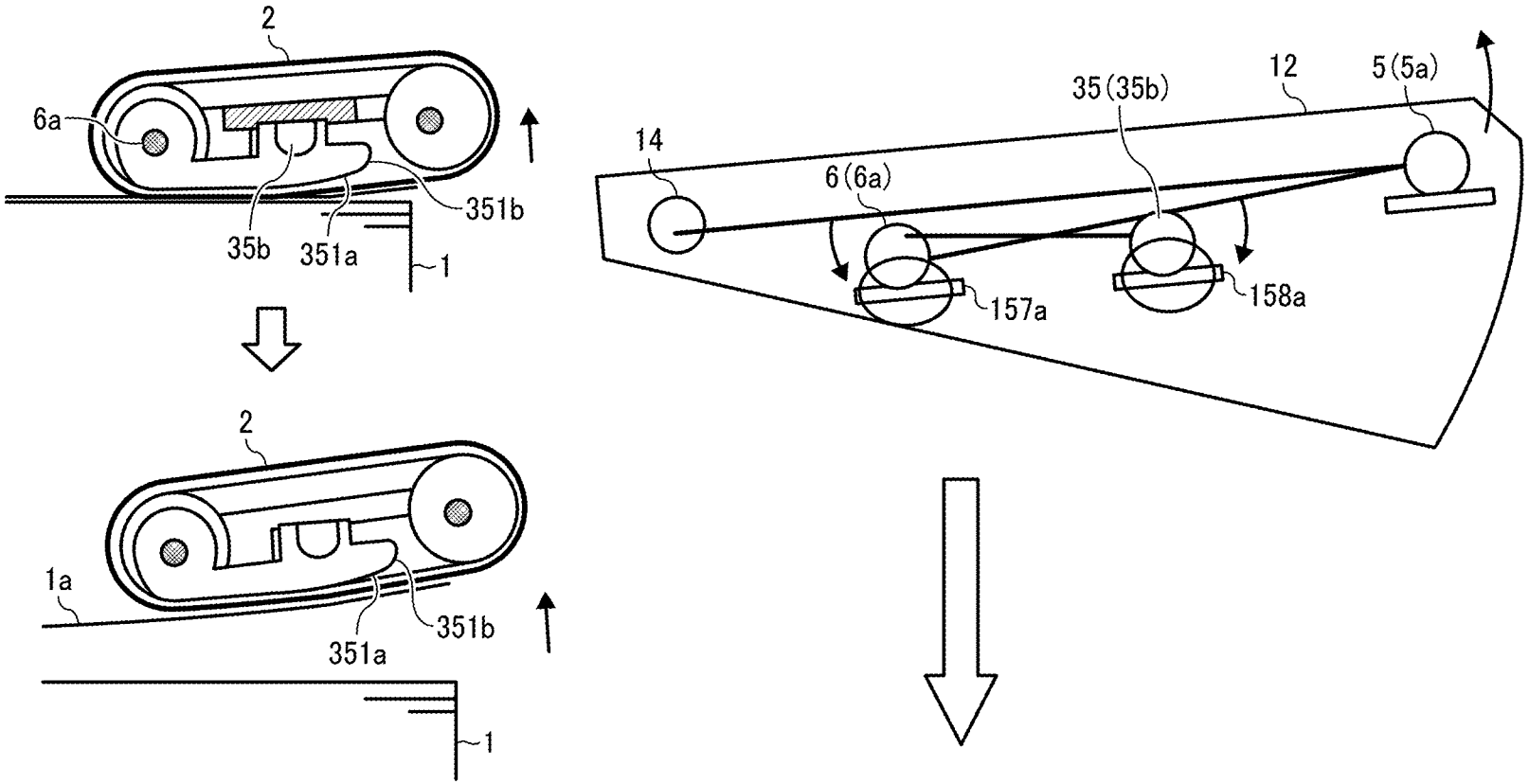
Figure 40C:
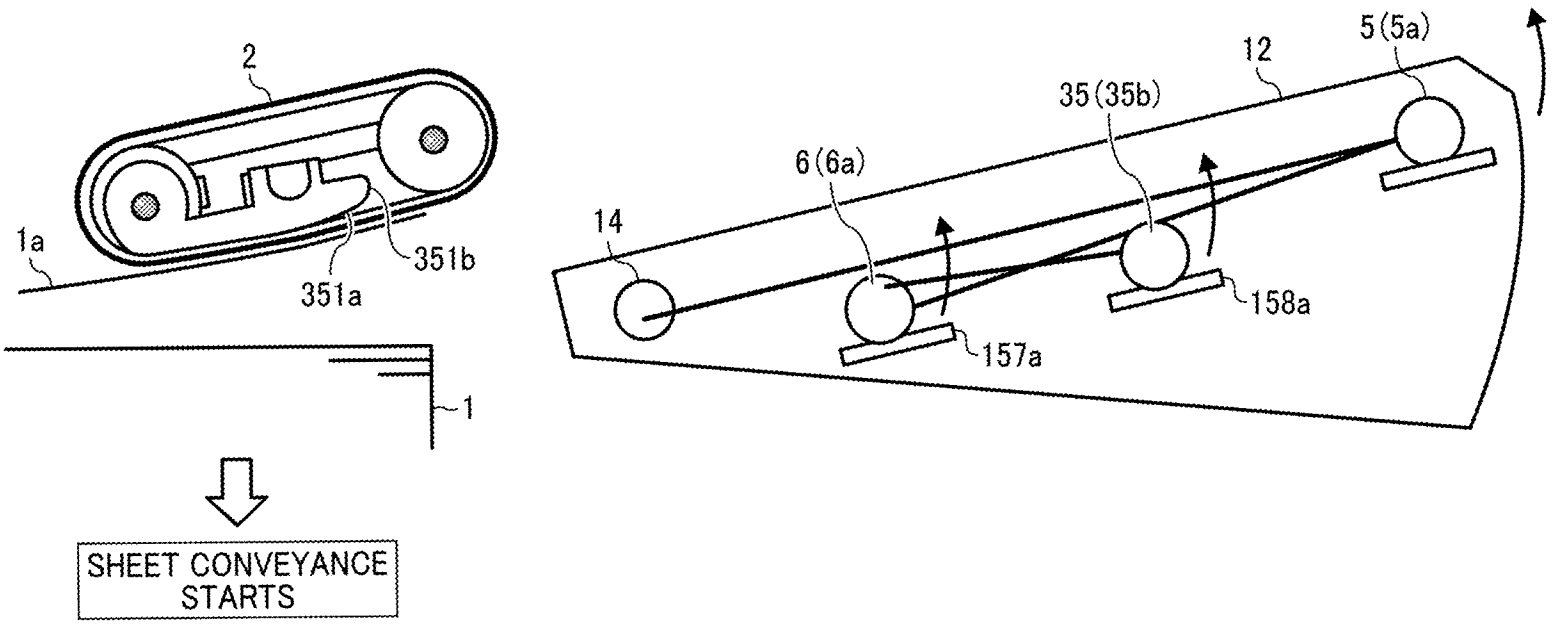

As the attraction belt 2 is lifted from the sheet contact position as illustrated in FIG. 39A, the roller holder 157 and the pressing unit holder 158, both of which are rotatably supported by the bracket 12, are elevated as illustrated in FIG. 39B. As a result, the shaft 6*a* of the upstream tension roller 6 in the roller hold opening 157*a* moves downwardly relative to the roller hold opening 157*a*. Similarly, the holder part 35*b* of the pressing unit 35 in the pressing unit hold opening 158*a* moves downwardly relative to the pressing unit hold opening 158*a*. Consequently, the attraction belt 2 is pressed toward the sheet stack 1 by the pressing unit 35, so that an upstream area of the attraction belt 2 that is upstream from a pressing position where the pressing unit 35 presses the attraction belt 2 in the sheet feeding direction maintains in contact with the top surface of the sheet stack 1. By contrast, a downstream area of the attraction belt 2 that is downstream from the pressing position where the pressing unit 35 presses the attraction belt 2 in the sheet feeding direction is separated from the top surface of the sheet stack 1. Consequently, while an upstream area of the uppermost sheet 1*a* from the pressing position of the pressing unit 35 is being pressed by the attraction belt 2, a downstream area of the uppermost sheet 1*a* (the leading side of the uppermost sheet 1*a*) from the pressing position of the pressing unit 35 is lifted by an attraction force of the attraction belt 2.

Details of the operations illustrated in FIGS. 39A and 39B are described with reference to FIGS. 40A and 40B.

In FIGS. 40A and 40B, the downstream tension roller 5 rotates about the supporting shaft 14 counterclockwise. The upstream tension roller 6 rotates about the downstream tension roller 5 counterclockwise. The pressing member 35 rotates about the upstream tension roller 6 clockwise.

When the first curved part 351*a* of the pressing unit 35 contacts the attraction belt 2, the attraction belt 2 bends according to the curvature of the first curved part 351*a*. Consequently, the holder part 35*b* of the pressing unit 35 contacts the lower end of the pressing unit hold opening 158*a*. At the same time, the shaft 6*a* of the upstream tension roller 6 contacts the lower end of the roller hold opening 157*a*. By bending the attraction belt 2 according to the curvature of the first curved part 351*a*, the uppermost sheet 1*a* that is attracted to the attraction belt 2 bends following the bend of the attraction belt 2 by the curvature of the first curved part 351*a*. Consequently, the subsequent sheet 1*b* (also referred to as the second sheet 1*b*) separates form the uppermost sheet 1*a* without separating the uppermost sheet 1*a* from the attraction belt 2.

As the bracket 12 further rotates about the supporting shaft 14 counterclockwise as illustrated in FIG. 39C at the above-described position, the upstream tension roller 6 is lifted by the roller hold opening 157*a*. Further, the pressing unit 35 is lifted by the pressing unit hold opening 158*a*. Consequently, the attraction belt 2 separates from the sheet stack 1 at the given angle while maintaining the bend with the curvature of the first curved part 351*a* of the pressing unit 35. Accordingly, the second sheet 1*b* can separates from the uppermost sheet 1*a*. Furthermore, the attraction belt 2 is elevated at the given angle toward the sheet separation position. On reaching the sheet separation position as illustrated in FIG. 39D, the attraction belt 2 stops its elevation.

In Exemplary Variation 1, the upstream tension roller 6 and the pressing unit 35 separate from the sheet stack 1 at the same time to achieve the following effects. Specifically, when the holder part 35*b* of the pressing unit 35 contacts the lower end of the pressing unit hold opening 158*a* and separates from the sheet stack 1 prior to the upstream tension roller 6, the uppermost sheet 1*a* bends according to the curvature of the upstream tension roller 6 after the pressing unit 35 is separated. As a result, when the uppermost sheet 1*a* is a thick paper having a high rigidity, it is likely that the uppermost sheet 1*a* separates by the curvature of the upstream tension roller 6. When the curvature of the upstream tension roller 6 is greater than the curvature of the first curved part 351*a* of the pressing unit 35, it is highly likely that the uppermost sheet 1*a* separates from the attraction belt 2. By contrast, by separating the upstream tension roller 6 and the pressing unit 35 from the sheet stack 1 at the same time, the uppermost sheet 1*a* that is attracted to the attraction belt 2 can be prevented from being bent by a curvature other than the curvature of the pressing unit 35. As a result, the uppermost sheet 1*a* that is attracted to the attraction belt 2 is prevented from being separated from the attraction belt 2.

Details of the operations illustrated in FIGS. 39C and 39D are described with reference to FIG. 40C.

In FIG. 40C, the downstream tension roller 5, the upstream tension roller 6, and the pressing unit 35 rotate about the supporting shaft 14 counterclockwise.

In Exemplary Variation 1, the attraction belt 2 moves to the sheet separation position at the given angle while maintaining the bend with the curvature of the first curved part 351*a* of the pressing unit 35. By so doing, the uppermost sheet 1*a* that is the thick paper attracted to the attraction belt 2 is prevented from separating from the attraction belt 2 until the attraction belt 2 reaches the sheet separation position.

In Exemplary Variation 1, a drive mechanism including the pressing unit holder 158 and the units and components for driving the pressing unit holder 158 functions as a rotation range adjuster to change the range of rotation of the pressing unit 35. Specifically, the drive mechanism includes, for example, the pressing unit holder 158, the switching motor 150, the drive timing belt 151, the multi-stage pulley 152, the rear side timing belt 153, the first drive transmission member 154, the rear side idler gear 155, the rear side driven gear 156 and so forth.

Further, in Exemplary Variation 1, a drive mechanism including the roller holder 157 and the units and components for driving the roller holder 157 functions as an angle range adjuster to change the angle of the attraction belt 2. Specifically, the drive mechanism includes, for example, the roller holder 157, the switching motor 150, the drive timing belt 151, the multi-stage pulley 152, the rear side timing belt 153, the first drive transmission member 154 and so forth.

Furthermore, in Exemplary Variation 1, the rotation range adjuster and the angle range adjuster function as a range adjuster to change the curved parts of the pressing unit 35 to be pressed against the inner circumferential surface of the attraction belt 2.

By contrast, when feeding the thin paper, even when the angle of the attraction belt 2 is set to be the same as when feeding the thick paper, the shaft 6*a* of the upstream tension roller 6 does not contact the lower end of the roller hold opening 157*a*. In addition, even when the attraction belt 2 contacts the first curved part 351*a* of the pressing unit 35 to be bent according to the curvature of the first curved part 351*a*, the holder part 35*b* of the pressing unit 35 does not contact the lower end of the pressing unit hold opening 158*a*. As the bracket 12 is elevated from this state, the downstream side of the attraction belt 2 is further lifted, and then the attraction belt 2 contacts the second curved part 351*b*. Consequently, the uppermost sheet 1*a* that functions as the thin paper attracted to the attraction belt 2 is bent with the curvature of the second curved part 351*b* of the pressing unit 35, and then the second sheet 1*b* that is a thin paper of the sheet stack 1 is separated from the uppermost sheet 1*a*.

Further, when the attraction belt 2 contacts the second curved part 351*b*, the shaft 6*a* of the upstream tension roller 6 contacts the lower end of the roller hold opening 157*a*. In addition, similar to the thick paper, when the attraction belt 2 contacts the second curved part 351*b*, the shaft 6*a* of the upstream tension roller 6 contacts the lower end of the roller hold opening 157*a*. At the same time the shaft 6*a* of the upstream tension roller 6 contacts the lower end of the roller hold opening 157*a*, the holder part 35*b* of the pressing unit 35 contacts the lower end of the pressing unit hold opening 158*a*. Accordingly, the upstream tension roller 6 and the pressing unit 35 are separated from the sheet stack 1 simultaneously. Consequently, while maintaining the bend with the curvature of the second curved part 351*b* and the angle greater than that when feeding the thick paper, the attraction belt 2 separates from the sheet stack 1 and is elevated to the sheet separation position.

In Exemplary Variation 1, the switching motor 150 drives to rotate the roller holder 157 and the pressing unit holder 158. However, a drive motor to rotate the roller holder 157 and the pressing unit holder 158 is not limited thereto. For example, a drive motor to endlessly rotate the attraction belt 2 can also be applied to rotate the roller holder 157 and the pressing unit holder 158.

Figure 41:
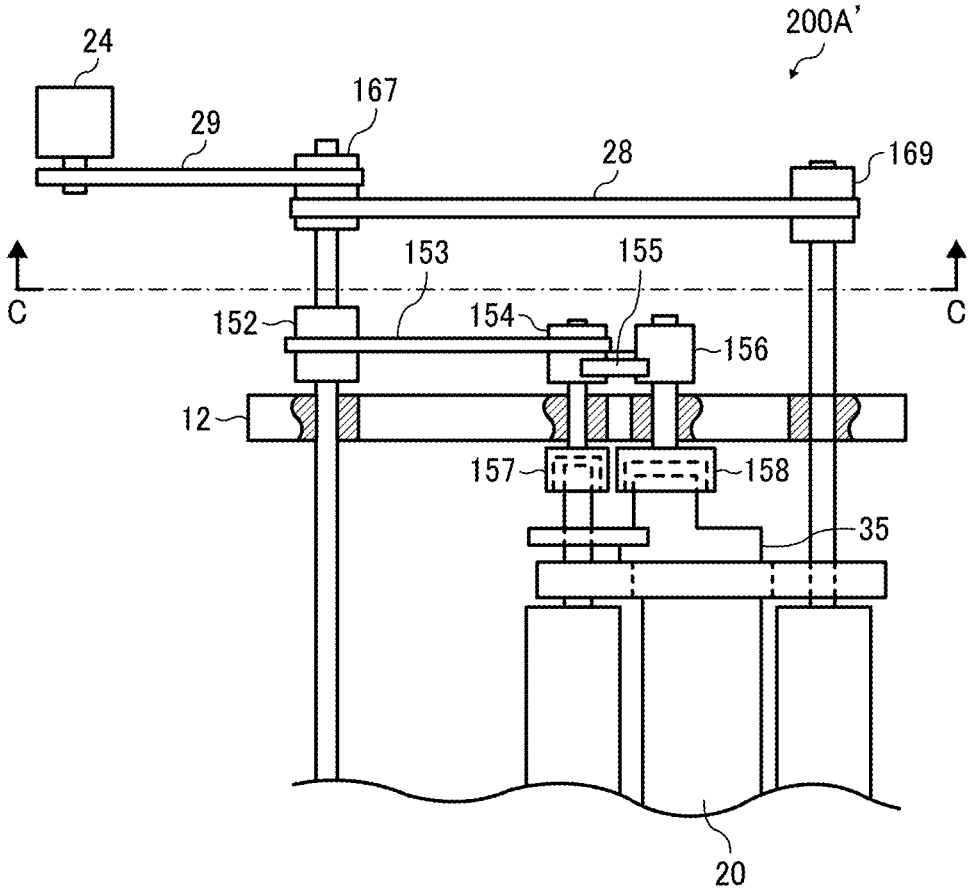
FIG. 41 is a diagram illustrating a schematic configuration in which a drive motor rotates a roller holder and a pressing unit holder.

FIG. 41 is a diagram illustrating a schematic configuration of a sheet feeder 200A' in which the drive motor 24 rotates the roller holder 157 and the pressing unit holder 158.

The sheet feeder 200A' illustrated in FIG. 41 has a configuration basically identical to the configuration of the sheet feeder 200 illustrated in FIG. 6, except that the pulleys 26*a* and 26*b* fixed to the supporting shaft 14 are replaced by a multi-stage pulley 167 having a one-way clutch and the pulley 25 fixed to the shaft 5*a* of the downstream tension roller 5 is replaced by a pulley 169 having a one-way clutch. Further, the drive mechanisms to rotate the roller holder 157 and the pressing unit holder 158 is basically the same as the drive mechanism on the rear side of the sheet feeder 200, except that the pulley fixed to the supporting shaft 14 is changed from a multi-stage pulley to a single-stage pulley.

Figure 42A:
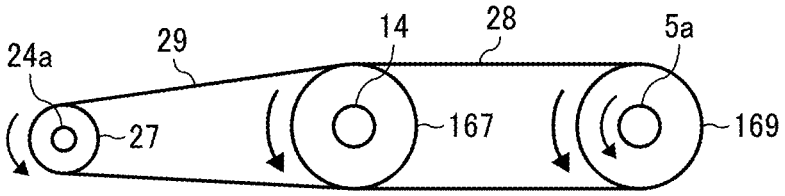
FIG. 42A is a diagram illustrating driving of the attraction belt in the configuration illustrated in FIGS. 40A through 40C.
Figure 42B:
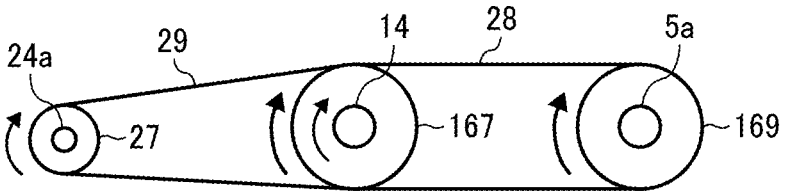
FIG. 42B is a diagram illustrating driving of the roller holder and the pressing unit holder in the configuration illustrated in FIGS. 40A through 40C.

FIG. 42A is a diagram illustrating driving of the attraction belt 2 in the configuration illustrated in FIGS. 40A through 40C. FIG. 42B is a diagram illustrating driving of the roller holder 157 and the pressing unit holder 158 in the configuration illustrated in FIGS. 40A through 40C.

To rotate the attraction belt 2, the drive motor 24 is driven to rotate counterclockwise as illustrated in FIG. 42A, so that a multi-stage pulley 167 having a one-way clutch rotates via the drive timing belt 29 counterclockwise. At this time, the one-way clutch of the multi-stage pulley 167 is not connected to the supporting shaft 14, therefore the multi-state pulley 167 idles with respect to the supporting shaft 14. As a result, the pulleys 152 and 159 fixed to the supporting shaft 14 do not rotate. Therefore, the roller holder 157 and the pressing unit holder 158 remain unrotated. By contrast, a driving force applied by the drive motor 24 and transmitted to the multi-stage pulley 167 is transmitted to the pulley 169 having the one-way clutch via the driven timing belt 28, so that the pulley 169 rotates counterclockwise in FIG. 42A. At this time, the one-way clutch of the pulley 169 is connected to the shaft 5*a* of the downstream tension roller 5, and therefore the downstream tension roller 5 rotates counterclockwise in FIG. 42A. As a result, the attraction belt 2 moves in a form of an endless loop.

By contrast, to rotate the roller holder 157 and the pressing unit holder 158, the drive motor 24 is driven to rotate clockwise as illustrated in FIG. 42B, so that a multi-stage pulley 167 rotates via the drive timing belt 29 clockwise. At this time, the one-way clutch of the multi-stage pulley 167 is connected to the supporting shaft 14, and therefore rotates the supporting shaft 14. As a result, the pulleys 152 and 159 fixed to the supporting shaft 14 rotate, and therefore the roller holder 157 and the pressing unit holder 158 also rotate.

By contrast, the driving force applied by the drive motor 24 and transmitted to the multi-stage pulley 167 is transmitted to the pulley 169 having the one-way clutch via the driven timing belt 28, so that the pulley 169 rotates clockwise in FIG. 42B. At this time, the one-way clutch of the pulley 169 is not connected to the shaft 5*a* of the downstream tension roller 5, and therefore the downstream tension roller 5 idles with respect to the shaft 5*a* of the downstream tension roller 5. As a result, the downstream tension roller 5 does not rotate and the attraction belt 2 remains unrotated.

As described in the configuration of the sheet feeder 200A illustrated in FIGS. 42A and 42B, by causing the drive motor 24 to rotate the roller holder 157 and the pressing unit holder 158, this configuration can reduce the number of parts and components when compared with the configuration including a motor dedicated to the roller holder 157 and the pressing unit holder 158. Accordingly, an increase of cost of the image forming apparatus 100 can be prevented.

EXEMPLARY VARIATION 2.

Figure 43:
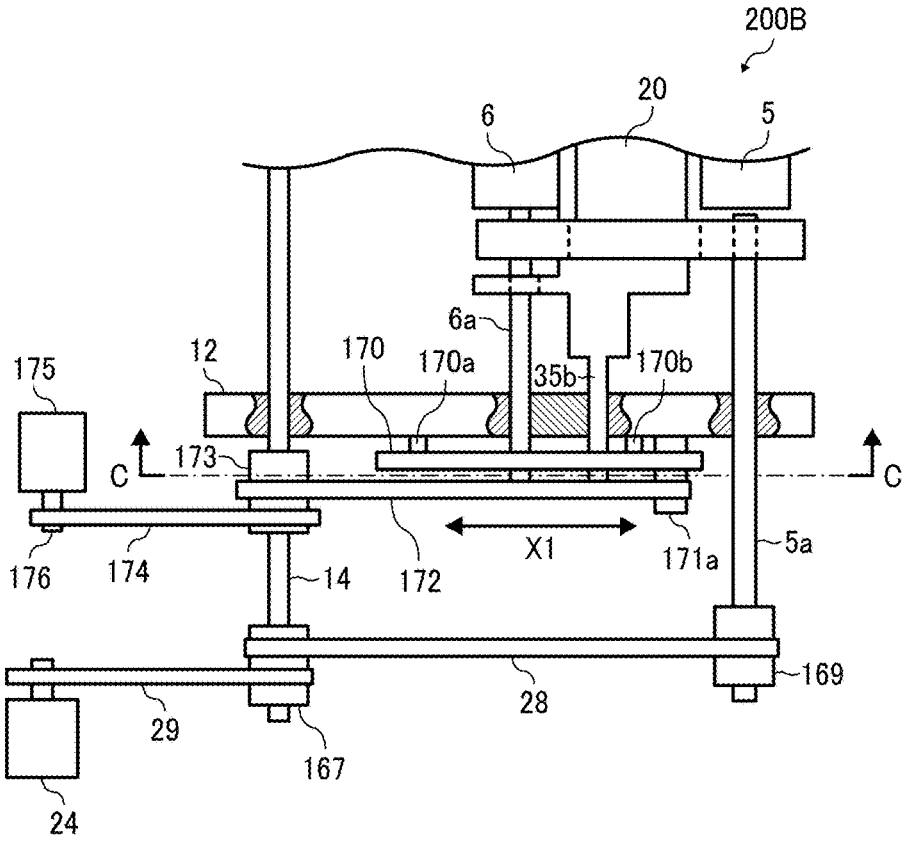
FIG. 43 is a plan view illustrating a configuration of a front side of the sheet feeder as yet another example.
Figure 44:
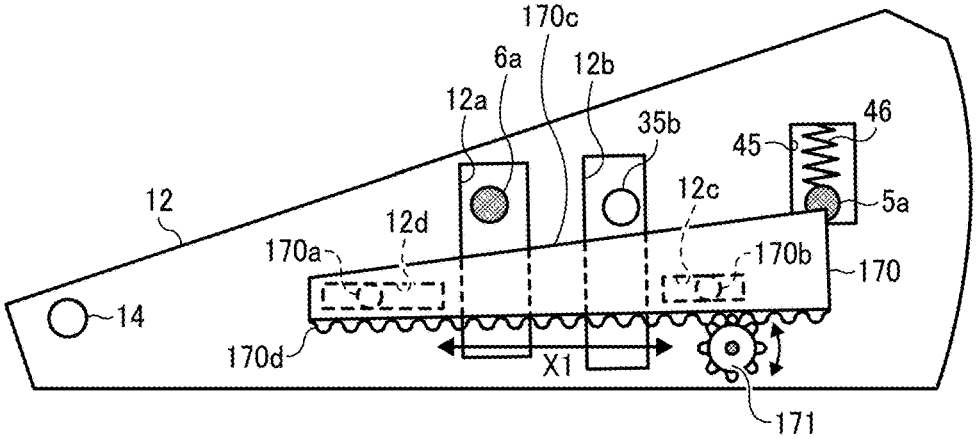
FIG. 44 is a cross sectional view illustrating the sheet feeder of FIG. 43 along a line C-C.

A description is given of a sheet feeder 200B according to Exemplary Variation 2 with reference to FIGS. 43 and 44.

FIG. 43 is a schematic diagram illustrating a configuration of the sheet feeder 200B and FIG. 44 is a cross sectional view illustrating the sheet feeder 200B of FIG. 43 along a line C-C.

The sheet feeder 200B according to Exemplary Variation 2 slides a slide member by using a rack and pinion mechanism to change the swing angle of the attraction belt 2 and the range of rotation of the pressing unit 35.

Except for the above-described functions, units and components used in the sheet feeder 200B according to Exemplary Variation 2 are basically identical to the units and components used in the sheet feeder 200. Therefore, detailed descriptions of the configuration and functions are omitted.

As illustrated in FIGS. 43 and 44, the sheet feeder 200B according to Exemplary Variation 2 has slide members 170, each of which functions as a (separator) slide member. The slide members 170 are attached to the respective brackets 12 of the sheet attraction/separation unit 110. Hereinafter, the slide members 170 are described in a singular form. Support projections 170*a* and 170*b* are provided at both ends of the slide member 170 in the sheet feeding direction. Slide support openings 12*c* and 12*d* are provided on the bracket 12, extending in the sheet feeding direction. The support projections 170*a* and 170*b* are inserted into the slide support openings 12*c* and 12*d*, respectively. According to this configuration, the slide member 170 is slidably attached with respect to the bracket 12 in the sheet feeding direction.

The slide member 170 is attached to the bracket 12 across the slot 12*a* that holds the upstream tension roller 6 set to the bracket 12 and the slot 12*b* that holds the holder pat 35*b* of the pressing unit 35. The shaft 6*a* of the upstream tension roller 6 held by the slot 12*a* and the holder part 35*b* of the pressing unit 35 held by the slot 12*a* are disposed higher than an upper part 170*c* that functions as a (separator) regulating part of the slide member 170. The shaft 6*a* and the holder part 35*b* protrude from the bracket 12 to abut against the upper part 170*c*. This abutment of the shaft 6*a* and the holder part 35*b* against the upper part 170*c* regulates ranges of the shaft 6*a* and the holder part 35*b* in the slots 12*a* and 12*b*, respectively. The upper part 170*c* has a slope that increases its height towards a downward side of the slide member 170.

A rack gear 170*d* is disposed at a lower part of the slide member 170 to mesh with a pinion gear 171 that is rotatably attached to the bracket 12.

As illustrated in FIG. 43, the pinion gear 171 includes a shaft 171*a* having a pulley. A first timing belt 172 is wound around the pulley of the shaft 171*a* and a driven pulley 173 that is rotatably attached to the supporting shaft 14. Further, a second timing belt 174 is wound around the driven pulley 173 and a drive pulley that is fixed to a drive shaft 176 of a slide member drive motor 175.

The slide member drive motor 175 is driven when setting or changing the swing angle of the attraction belt 2 and the range of rotation of the pressing unit 35. As the slide member drive motor 175 is driven, a driving force exerted by the slide member drive motor 175 is transmitted to the driven pulley 173 via the second timing belt 174. The driving force is further transmitted from the driven pulley 173 to the pinion gear 171 via the first timing belt 172. Consequently, the slide member 170 slides in a direction indicated by arrow X1 in FIG. 43.

When the swing angle of the attraction belt 2 and the range of rotation of the pressing unit 35 are set or changed for feeding the thick paper, the pinion gear 171 is rotated counterclockwise in FIG. 44, so as to move the slide member 170 toward the upstream side in the sheet feeding direction in FIG. 44. Due to the operations, the position at which the shaft 6*a* of the upstream tension roller 6 abuts against the upper part 170*c* of the slide member 170 is changed to an upward position. This change of the abutment position reduces the range of movement of the upstream tension roller 6 in a vertical direction. As a result, when feeding the thick paper, the shaft 6*a* of the upstream tension roller 6 abuts the upper part 170*c* of the slide member 170 at an earlier timing than when feeding the thin paper, and therefore the upstream tension roller 6 separates from the sheet stack 1 at an earlier timing than when feeding the thin paper. Accordingly, when handling the thick paper, the angle of the attraction belt 2 can be more reduced than when handling the thin paper.

Further, as the slide member 170 moves toward the upstream side in the sheet feeding direction in FIG. 44, the position at which the holder part 35*b* of the pressing unit 35 abuts against the upper part 170*c* of the slide member 170 is changed to a higher position. Accordingly, the range of movement of the holder part 35*b* of the pressing unit 35 is reduced when handling the thick paper, and therefore the amount of rotation of the pressing unit 35 can be reduced. As a result, the first curved part 351*a* of the pressing unit 35 contacts the attraction belt 2. Accordingly, when handling the thick paper, a trailing end of the uppermost sheet 1*a* can be bent with a smaller curvature than when handling the thin paper.

Figure 46:
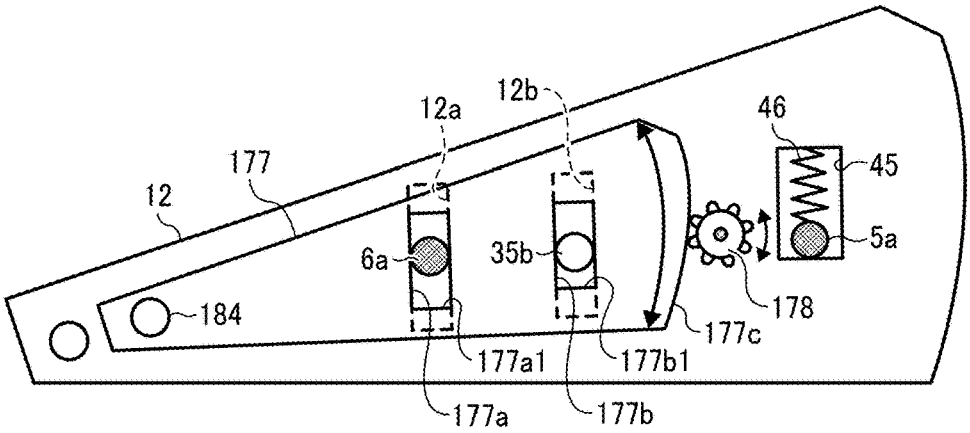
FIG. 46 is a cross sectional view illustrating the sheet feeder of FIG. 45 along a line C-C.

By contrast, when the swing angle of the attraction belt 2 and the range of rotation of the pressing unit 35 are set or changed for feeding the thin paper, the pinion gear 171 is rotated clockwise in FIG. 46, so as to move the slide member 170 toward the downstream side in the sheet feeding direction in FIG. 44. By so doing, a position at which the shaft 6*a* of the upstream tension roller 6 abuts against the upper part 170*c* of the slide member 170 is changed to a lower position. This change increases the range of movement of the upstream tension roller 6 in the vertical direction. As a result, when feeding the thin paper, the shaft 6*a* of the upstream tension roller 6 abuts the upper part 170*c* of the slide member 170 at a later timing than when feeding the thick paper, and therefore the upstream tension roller 6 separates from the sheet stack 1 at a later timing than when feeding the thick paper. Accordingly, when handling the thin paper, the angle of the attraction belt 2 can be more increased than when handling the thick paper.

Further, as the slide member 170 moves in the downstream side in the sheet feeding direction in FIG. 44, the position at which the holder part 35*b* of the pressing unit 35 abuts against the upper part 170*c* of the slide member 170 is also changed to a lower position. Therefore, when the thin paper is handled, the range of movement of the holder part 35*b* increases and the amount of rotation of the pressing unit 35 can be increased. As a result, the second curved part 351*b* of the pressing unit 35 contacts the attraction belt 2. Accordingly, when handling the thin paper, a leading end of the uppermost sheet 1*a* can be bent with a greater curvature than when handling the thick paper.

The upper part 170*c* of the slide member 170 has a slide part provided to separate the upstream tension roller 6 and the pressing unit 35 from the sheet stack 1 simultaneously.

Further, in Exemplary Variation 2, a slide member for changing the swing angle of the attraction belt 2 and a different slide member for changing the range of rotation of the pressing unit 35 can be provided respectively.

EXEMPLARY VARIATION 3.

Figure 45:
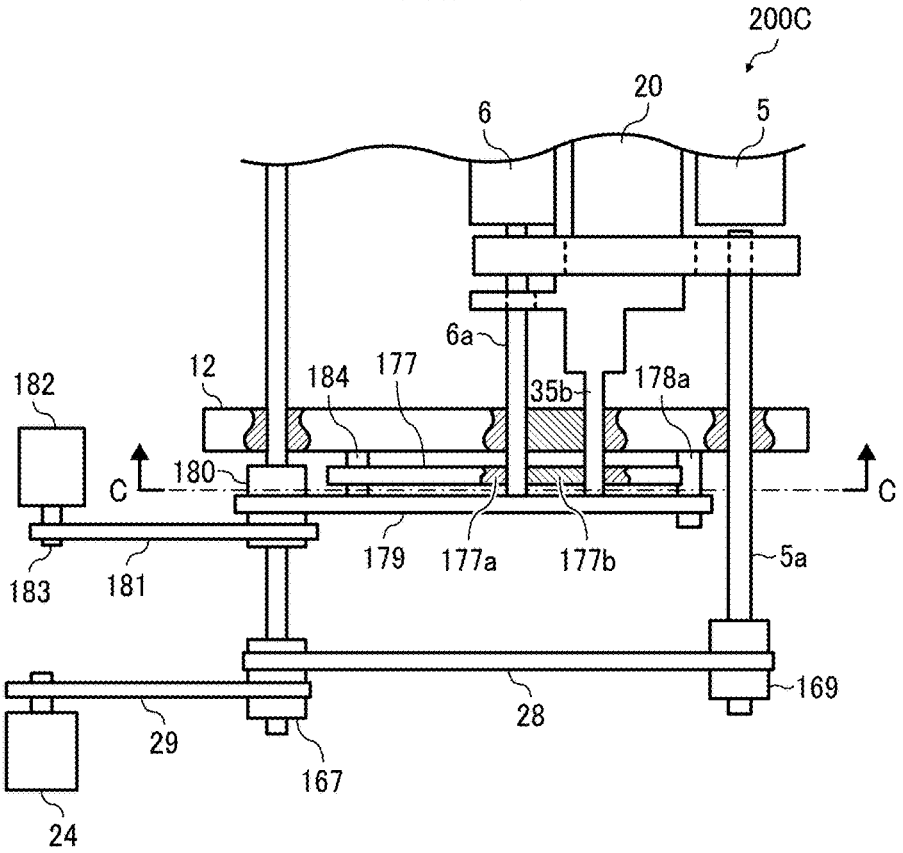
FIG. 45 is a plan view illustrating a configuration of a front side of the sheet feeder as yet another example.

A description is given of a sheet feeder 200C according to Exemplary Variation 3 with reference to FIGS. 45 and 46.

FIG. 45 is a plan view illustrating a schematic configuration of the sheet feeder 200C according to Exemplary Variation 3. FIG. 46 is a cross sectional view illustrating the sheet feeder 200C along a line C-C of FIG. 45.

The sheet feeder 200C changes the swing angle of the attraction belt 2 and the rotation range of the pressing unit 35 by rotating a rotary member by a rack and pinion mechanism.

Except for the above-described functions, units and components used in the sheet feeder 200C according to Exemplary Variation 3 are basically identical to the units and components used in the sheet feeder 200. Therefore, detailed descriptions of the configuration and functions are omitted.

As illustrated in FIGS. 45 and 46, the sheet feeder 200C includes rotary members 177, each of which is rotatably attached to each bracket 12 of the sheet attraction/separation unit 110. Hereinafter, the rotary members 177 are described in a singular form. The rotary member 177 that functions as a (separator) rotary member has a support 184 at an upstream end thereof. The support 184 is rotarably attached to the bracket 12.

The rotary member 177 includes a shaft regulation opening 177*a* that is provided to overlay the slot 12*a* that holds the upstream tension roller 6 of the bracket 12. The shaft 6*a* of the upstream tension roller 6 penetrates the bracket 12 so as to be inserted into the shaft regulation opening 177*a*. The shaft 6*a* of the upstream tension roller 6 abuts against a lower part 177*a*1 of the shaft regulation opening 177*a*, the movement of the shaft 6*a* in the downward direction is regulated.

Further, the rotary member 177 includes a holder regulation opening 177*b* that is provided to overlay the slot 12*b* that holds the holder part 35*b* of the pressing unit 35 of the bracket 12. The holder part 35*b* of the pressing unit 35 penetrates the bracket 12 so as to be inserted into the holder regulation opening 177*b*. The holder part 35*b* of the pressing unit 35 abuts against a lower part 177*b*1 of the holder regulation opening 177*b*, the movement of the holder part 35*b* in the downward direction is regulated.

Further, the rotary member 177 further includes a rack gear 177*c* that is disposed at a downstream end thereof in the sheet feeding direction. The rack gear 177*c* is meshed with a pinion gear 178 that is rotatably attached to the bracket 12.

As illustrated in FIG. 46, a mechanism to rotate the pinion gear 178 is the same as the mechanism described in Exemplary Variation 2. Specifically, the pinion gear 178 includes a shaft 178*a* having a pulley attached thereto. A first timing belt 179 is wound around the pulley attached to the shaft 178*a* and a driven pulley 180 that is rotatably attached to the supporting shaft 14. Further, a drive motor 182 includes a drive shaft 183 having a pulley attached thereto. A second timing belt 181 is wound around the driven pulley 180 and the pulley attached to the shaft 183.

To change the swing angle of the attraction belt 2 and the range of rotation of the pressing unit 35, the drive motor 182 is driven to rotate the pinion gear 178. Consequently, the rotary member 177 rotates about a support 184.

When the swing angle of the attraction belt 2 and the range of rotation of the pressing unit 35 are set or changed for feeding the thick paper, the pinion gear 178 is rotated clockwise in FIG. 46, so as to rotate the rotary member 177 counterclockwise in FIG. 46. Due to the operations, the shaft regulation opening 177*a* and the holder regulation opening 177*b* are lifted. According to the elevation of the shaft regulation opening 177*a*, a position of the lower part 177*a*1 of the shaft regulation opening 177*a* against which the shaft 6*a* of the upstream tension roller 6 abuts is changed to an upward position. This positional change of the lower part 177*a*1 of the shaft regulation opening 177*a* reduces the range of movement of the upstream tension roller 6 in the vertical direction. As a result, when feeding the thick paper, the shaft 6*a* of the upstream tension roller 6 abuts the lower part 177*a*1 of the shaft regulation opening 177*a* at an earlier timing than when feeding the thin paper, and therefore the upstream tension roller 6 separates from the sheet stack 1 at an earlier timing than when feeding the thin paper. Accordingly, when handling the thick paper, the angle of the attraction belt 2 can be more reduced than when handling the thin paper.

Further, as the rotary member 177 rotates counterclockwise in FIG. 46, the holder regulation opening 177*b* is provided at a higher position. Accordingly, the position of the lower part 177*b*1 of the holder regulation opening 177*b* against which the holder part 35*b* of the pressing unit 35 abuts is changed to a higher position. Therefore, the amount of rotation of the pressing unit 35 can be reduced. As a result, the first curved part 351*a* of the pressing unit 35 contacts the attraction belt 2. Accordingly, when handling the thick paper, a trailing end of the uppermost sheet 1*a* can be bent with a smaller curvature than when handling the thin paper.

By contrast, when the swing angle of the attraction belt 2 and the range of rotation of the pressing unit 35 are set or changed for feeding the thin paper, the pinion gear 171 is rotated counterclockwise in FIG. 46, so as to rotate the rotary member 177 clockwise in FIG. 46. Due to the operations, the shaft regulation opening 177*a* and the holder regulation opening 177*b* are descended or lowered. According to the descent of the shaft regulation opening 177*a*, the position of the lower part 177*a*1 of the shaft regulation opening 177*a* against which the shaft 6*a* of the upstream tension roller 6 abuts is changed to a lower position. This positional change of the lower part 177*a*1 of the shaft regulation opening 177*a* increases the range of movement of the upstream tension roller 6 in the vertical direction. As a result, when feeding the thin paper, the shaft 6*a* of the upstream tension roller 6 abuts the lower part 177*a*1 of the shaft regulation opening 177*a* at a later timing than when feeding the thick paper, and therefore the upstream tension roller 6 separates from the sheet stack 1 at a later timing than when feeding the thick paper. Accordingly, when handling the thin paper, the angle of the attraction belt 2 can be more increased than when handling the thick paper.

Further, as the rotary member 177 rotates clockwise in FIG. 46, the holder regulation opening 177*b* is provided at a lower position. Accordingly, the position of the lower part 177*b*1 of the holder regulation opening 177*b* against which the holder part 35*b* of the pressing unit 35 abuts is changed to a lower position. Therefore, the amount of rotation of the pressing unit 35 can be increased. As a result, the second curved part 351*b* of the pressing unit 35 contacts the attraction belt 2. Accordingly, when handling the thin paper, a leading end of the uppermost sheet 1*a* can be bent with a greater curvature than when handling the thick paper.

Further, in Exemplary Variation 3, a rotary member for changing the swing angle of the attraction belt 2 and a different rotary member for changing the range of rotation of the pressing unit 35 can be provided respectively.

Figure 47A:
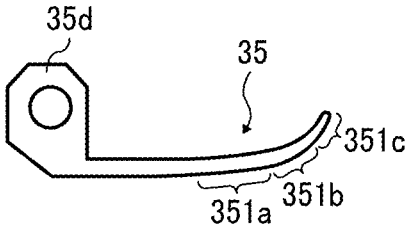
FIGS. 47A through 47C are diagrams illustrating variations of the pressing unit.
Figure 47B:
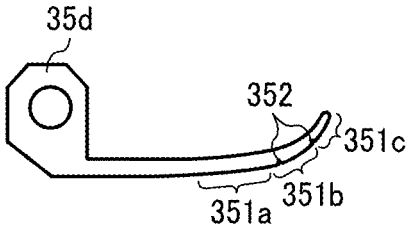
Figure 47C:
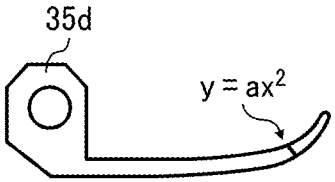

Next, a description is given of configurations of a pressing unit 35', which are variations of the pressing unit 35, with reference to FIGS. 47A through 47C.

The pressing unit 35' illustrated in FIG. 47A includes three curved parts, which are a first curved part 351*a*', a second curved part 351*b*', and a third curved part 351*c*. In this configuration, the first curved part 351*a*' that functions as a pressing part separates the uppermost sheet 1*a* when handling thick papers, the second curved part 351*b*' that functions as a pressing part separates the uppermost sheet 1*a* when handling regular papers, and the third curved part 351*c* that functions as a pressing part separates the uppermost sheet 1*a* when handling thin papers.

As illustrated in FIG. 47B, the pressing unit 35' can have gutters 352 to divide the first curved part 351*a*', the second curved part 351*b*', and the third curved part 351*c* into sections. The position of each curved part may need to be formed with accuracy so that a selective curved part that fits to the sheet thickness contacts the attraction belt 2 when the attraction belt 2 forms the angle of inclination corresponding to the sheet thickness.

To provide a good separation performance according to the sheet thickness corresponding to each curvature forming portion, each curved part may need to be formed with accuracy. However, in a case in which multiple curved parts 351*a*, 351*b*, and 351*c* are aligned in a formation of a continuous curve as illustrated in FIG. 47A, each curved part may not be formed accurately due to design reasons. In such a case, by dividing the curved parts into sections by the gutters 352 as illustrated in FIG. 47B, the position and curvature of each curved part can be formed relatively accurate.

Further, as illustrated in FIG. 47C, the pressing unit 35 has the curvature of the leading edge to be greater at a distal end than at a proximal end. For example, by forming a radiating surface at the leading edge of the pressing unit 35 to contact the attraction belt 2, the curvature gradually increase as the leading edge of the pressing unit 35 becomes closer to the distal end thereof. According to this configuration, the sheet can be bent by an optional curvature according to the angle of inclination of the attraction belt 2, and various sheets can be handled.

Figure 48:
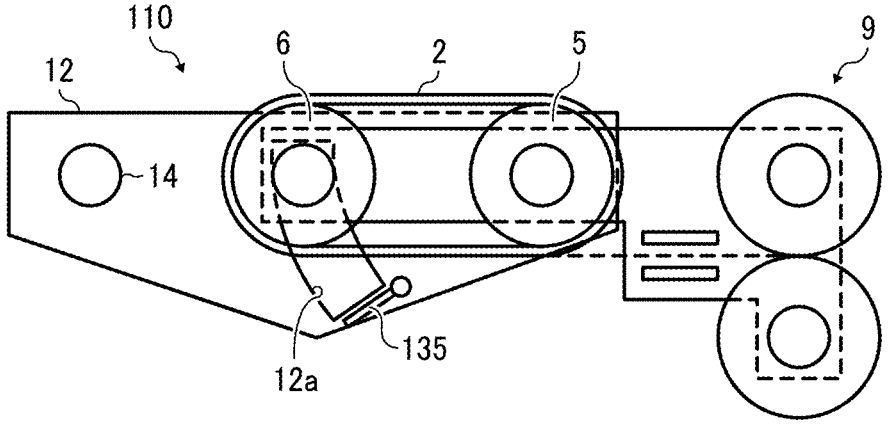
FIG. 48 is a diagram illustrating a modification of the attraction/separation unit with a different swing range.

Further, as illustrated in FIG. 48, the angle of inclination of the attraction belt 2 can be changed according to the sheet thickness. In the example configuration illustrated in FIG. 48, an abutment unit 135 is rotatably disposed to the brackets 12 to restrict movement of the slot 12*a* of the upstream tension roller 6.

Specifically, when conveying sheets having a high rigidity, the abutment unit 135 is rotated clockwise in FIG. 48 by a given angle. By so doing, when the attraction belt 2 is moved from the sheet contact position to the sheet separation position, the upstream tension roller 6 does not move to the lower end surface 41*a* of the slot 12*a* and abuts against the pressing unit 35. Accordingly, the upstream tension roller 6 can be separated from the sheet stack 1 at a smaller angle of inclination of the attraction belt 2 and the amount of bend of the uppermost sheet 1*a* can be reduced.

By contrast, conveying sheets having a low rigidity, the abutment unit 135 is not rotated to remain stopped at a position illustrated in FIG. 48 by a given angle. By so doing, when the uppermost sheet 1*a* has a low rigidity, the upstream tension roller 6 moves to and contacts the lower end surface 41*a* of the slot 12*a*, so that the upstream tension roller 6 is lifted by the lower end surface 41*a* of the slot 21*a*. Accordingly, when the uppermost sheet 1*a* has a high rigidity, the angle of inclination of the attraction belt 2 can be increased and the amount of bend can also be increased.

Figure 49:
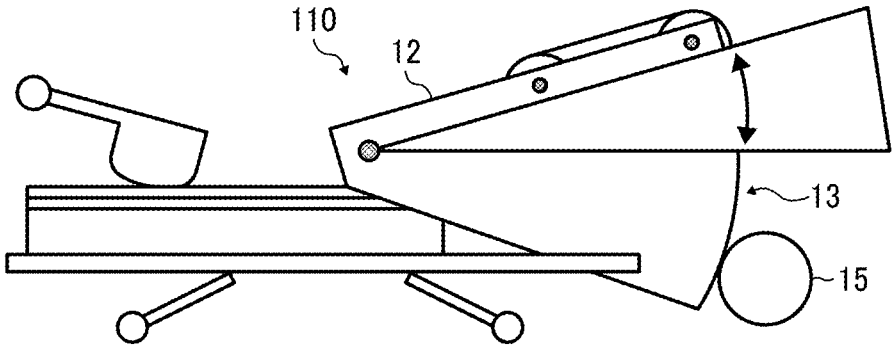
FIG. 49 is a diagram illustrating another modification of the attraction/separation unit with a different swing range.

Further, the sheet attraction/separation unit 110 can have a configuration as illustrated in FIG. 49 to change the angle of inclination of the attraction belt 2 according to sheet thickness. In this configuration, the upstream tension roller 6 is fixed with respect to the bracket 12 and the amount of swing of the sheet attraction/separation unit 110 according to the sheet thickness.

Further, when the attraction belt 2 separates from the upper surface of the sheet stack 1, the pressing unit 35 can bend the attraction belt 2 to separate the subsequent sheet 1*b* from the uppermost sheet 1*a*. In this case, for example, after the attraction belt 2 has reached the sheet separation position, the pressing unit 35 is rotated to press a sheet attraction portion of the attraction belt 2, so that the attraction belt 2 is bent. At this time, by controlling the amount of rotation of the pressing unit 35', the amount of bend of the attraction belt 2 and the curved part to contact the attraction belt 2 can be changed. By so doing, the curvature and the amount of bend according to rigidity of the uppermost sheet 1*a* can bend the uppermost sheet 1*a*, and thereby obtaining a good separation performance.

Further, the present invention can be applied to a sheet feeder having a configuration in which the uppermost sheet of the sheet stack is attracted to the attraction belt by an air suction force.

The configurations according to the above-described embodiment are examples. The present invention can achieve the following aspects effectively.

Aspect 1.

In Aspect 1, a sheet feeder (for example, the sheet feeders 200) includes an endless attraction belt (for example, the attraction belt 2) that is rotatably disposed facing a top surface of a sheet stack (for example, the sheet stack 1), a belt charger (for example, the belt charger 3) to attract an uppermost sheet (for example, the uppermost sheet 1*a*) of the sheet stack, and a sheet separator (for example, the pressing unit 35) to press the attraction belt against the sheet stack, bend a contact region to which the uppermost sheet is attracted and contacted to the attraction belt, and separate the uppermost sheet from a subsequent sheet (for example, the subsequent sheet 1*b*) or other sheet of the sheet stack. In this configuration, a curvature of a contact surface of the sheet separator with respect to the attraction belt is changeable.

According to this configuration, as described in the above-described embodiments, the curvature of the sheet separator on the contact region of the attracting belt can be changed. When the attraction belt 2 is bent by the sheet separator, an arc of the attraction belt 2 bends along the curvature of the contact surface of the sheet separator with respect to the attraction belt. Further, the sheet attracted to the attraction belt bends along the curved arc of the attraction belt, and therefore the sheet is also bent along the curvature of the contact surface of the sheet separator with respect to the attraction belt. Accordingly, by changing the curvature of the contact surface of the sheet separator with respect to the attraction belt according to rigidity of sheet, the sheet can be bent with an appropriate curvature according to rigidity of sheet. Consequently, as the rigidity of sheet is lower, the sheet can be bent more tightly at the arc of the attraction belt by pressing the contact surface having a greater curvature against the attraction belt. With this function, compared with a comparative sheet feeder that has a configuration in which a sheet having a lower rigidity is bent with the curvature of a fixed roller such as an upstream tension roller, the sheet feeder according to the above-described embodiments and variations can separate the subsequent sheet from the uppermost sheet preferably when separating a sheet with a lower rigidity.

Aspect 2.

In Aspect 1, the sheet separator (for example, the pressing unit 35) includes multiple pressing parts (for example, the curved parts 351*a*, 351*a*', 351*b*, 351*b*', and 351*c*) having different curvatures. The sheet feeder (for example, the sheet feeder 200) further includes a range adjuster (for example, the swing range adjusting unit 80, the pressing unit holder 158 and the related components, and the roller holder 157 and the related components) to change the multiple pressing parts selectively pressed against an inner circumferential surface of the attraction belt (for example, the attraction belt 2).

According to this configuration, as described in the above-described embodiments, the sheet separator can change the curvature of the contact surface thereof with respect to the attraction belt.

Aspect 3.

In Aspect 2, the range adjuster (for example, the swing range adjusting unit 80, the switching motor 150, the pressing unit holder 158 and the related components, and the roller holder 157 and the related components) changes the multiple pressing parts (for example, the curved parts 351*a*, 351*a*', 351*b*, 351*b*', and 351*c*) selectively pressed against the inner circumferential surface of the attraction belt (for example, the attraction belt 2) according to rigidity of sheet that is attracted to the attraction belt.

According to this configuration, the sheet can be bent with an optimal curvature according to rigidity of the sheet, and therefore the sheet feeder (for example, the sheet feeder 200) can obtain good separation regardless of rigidity of sheet.

Aspect 4.

In Aspect 3, the range adjuster (for example, the swing range adjusting unit 80, the switching motor 150, the pressing unit holder 158 and the related components, and the roller holder 157 and the related components) changes the multiple pressing parts (for example, the curved parts 351*a*, 351*a*', 351*b*, 351*b*', and 351*c*) to have a greater curvature when the sheet has a smaller rigidity.

According to this configuration, as described in the above-described embodiments, the sheet feeder (for example, the sheet feeder 200) can obtain good separation regardless of rigidity of sheet.

Aspect 5.

In any one of Aspects 2 through 4, the attraction belt (for example, the attraction belt 2) contacts the sheet stack (for example, the sheet stack 1) at a sheet contact position to attract the uppermost sheet (for example, the uppermost sheet 1*a*) of the sheet stack to the attraction belt and the attraction belt separates from the sheet stack at a sheet separation position to convey the uppermost sheet attached to the attraction belt. The sheet feeder (for example, the sheet feeder 200) further includes a movable unit (for example, the swing unit 120) to move the attraction belt from the sheet contact position to the sheet separation position while slanting the attraction belt with respect to the top surface of the sheet stack. The range adjuster (for example, the swing range adjusting unit 80, the switching motor 150, the pressing unit holder 158 and the related components, and the roller holder 157 and the related components) further includes an angle range adjuster (for example, the swing range adjusting unit 80) to change an angle of the attraction belt with respect to the top surface of the sheet stack at the sheet separation position according the rigidity of sheet. The sheet separator (for example, the pressing unit 35) changes the multiple pressing parts (for example, the curved parts 351*a*, 351*a*', 351*b*, 351*b*', and 351*c*) selectively pressed against the inner circumferential surface of the attraction belt according to the angle of the attraction belt.

According to this configuration, as described in the above-described embodiments, the sheet feeder (for example, the sheet feeder 200) can obtain good separation regardless of rigidity of sheet.

Aspect 6.

In Aspect 5, the angle range adjuster (for example, the swing range adjusting unit 80) changes the angle of the attraction belt (for example, the attraction belt 2) with respect to the top surface of the sheet stack (for example, the sheet stack 1) to be greater as the rigidity of sheet becomes smaller. When the angle of the attraction belt becomes greater, a pressing part having a greater curvature is selected from the pressing parts (for example, the curved parts 351*a*, 351*a*', 351*b*, 351*b*', and 351*c*) to be pressed against the attraction belt.

According to this configuration, as described in the above-described embodiments, the sheet feeder (for example, the sheet feeder 200) can obtain good separation regardless of rigidity of sheet.

Aspect 7.

In any one of Aspect 5 or Aspect 6, the sheet feeder (for example, the sheet feeder 200) includes a sheet attraction/separation belt unit (for example, the sheet attraction/separation unit 110) that includes a first tension roller (for example, the downstream tension roller 5) to tension and support the attraction belt (for example, the attraction belt 2) and a second tension roller (for example, the upstream tension roller 6) disposed upstream from the first tension roller in the sheet feeding direction to tension the attraction belt. The sheet attraction/separation belt unit is rotatably support the second tension roller in a given range in a vertical direction with respect to the top surface of the sheet stack (for example, the sheet stack 1). The movable unit (for example, the swing unit 120) moves the attraction belt from the sheet contact position to the sheet separation position while the attraction belt is being slanted with respect to the top surface of the sheet stack by rotating the sheet attraction/separation belt unit about a point disposed upstream from the second tension roller in the sheet feeding direction. The range adjuster (for example, the swing range adjusting unit 80) changes a range of rotation of the second tension roller so as to change the angle of the attraction belt.

According to this configuration, as described in the above-described embodiments, the angle of the attraction belt can be changed.

Aspect 8.

In Aspect 7, the angle range adjuster includes a roller holder (for example, the roller holder 157) that is rotatably supported thereby. The roller holder includes an elliptical-shaped roller hold opening (for example, the roller hold opening 157*a*) to hold a shaft (for example, the shaft 6*a*) of a second tension roller (for example, the upstream tension roller 6). The angle range adjuster changes the range of rotation of the second tension roller.

According to this configuration, as described in Exemplary Variation 1, the range of movement of the second tension roller can be changed, so that the angle of the attraction belt with respect to the sheet stack can be changed.

Aspect 9.

In Aspect 7, the angle range adjuster includes a slide member (for example, the slide member 170) that is slidable with respect to a sheet attraction/separation belt unit (for example, the sheet attraction/separation unit 110) in the sheet feeding direction. The slide member includes a regulating part (for example, the upper part 170*c*) against which the shaft (for example, the shaft 6*a*) of the second tension roller (for example, the upstream tension roller 6) abuts so as to regulate range of rotation of the second tension roller in a vertically downward direction. By sliding the slide member, the position of the regulating part in the vertical direction is changed, and therefore the range of rotation of the second tension roller is changed.

According to Aspect 9, as described in Exemplary Variation 2, when the position of the regulating part is changed upwardly, as the sheet attraction/separation belt unit (for example, the sheet attraction/separation unit 110) is swung from the sheet contact position, the shaft of the second tension roller abuts against the regulating part at an early stage. As a result, the range of rotation of the second tension roller with respect to the sheet attraction/separation belt unit can be reduced, and therefore the angle of the attraction belt (for example, the attraction belt 2) with respect to the top surface of the sheet stack (for example, the sheet stack 1) at the sheet separation position can be reduced.

By contrast, when the position of the regulating part is changed downwardly, the sheet attraction/separation belt unit swings more until the shaft of the second tension roller abuts against the regulating part. As a result, the range of rotation of the second tension roller with respect to the sheet attraction/separation belt unit can be greater, and the angle of the attraction belt with respect to the top surface of the sheet stack at the sheet separation position can be increased.

Aspect 10.

In Aspect 7, the angle range adjuster includes a rotary member (for example, the rotary member 177) that is rotatable with respect to the sheet attraction/separation belt unit (for example, the sheet attraction/separation unit 110). The rotary member includes a regulating part (for example, the lower part 177*a*1) of a shaft regulation opening (for example, the shaft regulation opening 177*a*) against which the shaft (for example, the shaft 6*a*) of the second tension roller (for example, the upstream tension roller 6) abuts so as to regulate a range of rotation of the second tension roller in a vertically downward direction. By rotating the rotary member, the position of the regulating part in the vertical direction is changed, and therefore the range of rotation of the second tension roller is changed.

According to Aspect 10, as described in Exemplary Variation 3, when the position of the regulating part is changed upwardly by rotating the rotary member, the range of rotation of the second tension roller with respect to the sheet attraction/separation belt unit can be reduced, and therefore the angle of the attraction belt (for example, the attraction belt 2) with respect to the top surface of the sheet stack (for example, the sheet stack 1) at the sheet separation position can be reduced.

By contrast, when the position of the regulating member is changed downwardly by rotating the rotary member, the range of rotation of the second tension roller with respect to the sheet attraction/separation belt unit can be greater, and the angle of the attraction belt with respect to the top surface of the sheet stack at the sheet separation position can be increased.

Aspect 11.

In any one of Aspects 5 through 10, the sheet separator (for example, the pressing unit 35) is rotatably supported at an upstream end in the sheet feeding direction, the multiple pressing parts (for example, the curved parts 351*a*, 351*a*', 351*b*, 351*b*', and 351*c*) are aligned from the downstream end to the upstream end of the sheet separator in the sheet feeding direction, and a pressing part disposed at a further downstream side has a greater curvature.

According to this configuration, as described in the above-described embodiments, as a greater angle of the attraction belt (for example, the attraction belt 2) is greater, the pressing part having a greater curvature can be pressed against the attraction belt.

Aspect 12.

In Aspect 11, the multiple pressing parts (for example, the curved parts 351*a*, 351*a*', 351*b*, 351*b*', and 351*c*) are aligned in a formation of a continuous curve.

According to this configuration, as described above with reference to FIG. 47A, the uppermost sheet (for example, the uppermost sheet 1*a*) can be bent with an appropriate curvature according to the angles of the attraction belt (for example, the attraction belt 2), and therefore the sheet feeder (for example, the sheet feeder 200) can be applied to various types of sheets.

Aspect 13.

In Aspect 11, the multiple pressing parts (for example, the curved parts 351*a*, 351*a*', 351*b*, 351*b*', and 351*c*) are divided into sections.

According to this configuration, as described above with reference to FIG. 47B, the multiple pressing parts can be formed with accuracy.

Aspect 14.

In any one of Aspects 11 through 13, the range adjuster includes a rotation range adjuster (for example, the pressing unit holder 158 and the related components driving the pressing unit holder 158) to change a range of rotation of the sheet separator (for example, the pressing unit 35).

According to Aspect 10, as described in Exemplary Variation 1, a greater range of rotation of the sheet separator can contact a pressing part having a greater curvature at a downstream side of the sheet separator in the sheet feeding direction against the attraction belt 2. Thus, the uppermost sheet (for example, the uppermost sheet 1*a*) can be bent with an appropriate curvature, and therefore the sheet feeder (for example, the sheet feeder 200) can be applied to various types of sheets. Further, the sheet separator and the second tension roller (for example, the upstream tension roller 6) can separate from the sheet stack (for example, the sheet stack 1) simultaneously. Accordingly, it can prevent that, after the sheet separator separates the subsequent sheet (for example, the subsequent sheet 1*b*) from the uppermost sheet, separation of the uppermost sheet from the attraction belt (for example, the attraction belt 2) due to the curvature of the second tension roller.

Aspect 15.

In Aspect 14, the rotation range adjuster includes a separator holder (for example, the pressing unit holder 158) that is rotatably supported thereby. The separator holder includes an elliptical-shaped separator hold opening (for example, the pressing unit hold opening 158*a*) to hold a holder part (for example, the holder part 35*b*) disposed at both ends of the sheet separator (for example, the pressing unit 35) in the sheet width direction. By rotating the separator holder, the rotation range adjuster changes the range of rotation of the sheet separator.

According to Aspect 10, as described in Exemplary Variation 1, the range of movement of the sheet separator can be changed.

Aspect 16.

In Aspect 14, the rotation range adjuster includes a separator slide member (for example, the slide member 170) that is slidable with respect to the sheet attraction/separation belt unit (for example, the sheet attraction/separation unit 110) in the sheet feeding direction. The separator slide member includes a separator regulating part (for example, the upper part 170*c*) against which a separating member (for example, the holder part 35*b*) of the sheet separator (for example, the pressing unit 35) abuts so as to regulate the range of rotation of the sheet separator. By sliding the separator slide member, the position of the separator regulating part in the vertical direction is changed, and therefore the range of rotation of the sheet separator is changed.

According to Aspect 14, as described in Exemplary Variation 2, when the separator slide member is moved to change the position of the separator regulating part upwardly, as the sheet attraction/separation belt unit is swung from the sheet contact position, the separating member of the sheet separator abuts against the separator regulating part at an early stage. By so doing, the sheet separator stops rotating, and thereby reducing the range of rotation of the sheet separator.

By contrast, when the position of the separator regulating part is changed downwardly by rotating the separator slide member, as the sheet attraction/separation belt unit is swung from the sheet contact position, a timing that the sheet separator contacts the separator regulating part becomes slower. As a result, the range of rotation of the sheet separator can be greater.

Aspect 17.

In Aspect 14, the rotation range adjuster includes a separator rotary member (for example, the rotary member 177) that is rotatable with respect to the sheet attraction/separation belt unit (for example, the sheet attraction/separation unit 110). The separator rotary member includes a separator regulating part (for example, the lower part 177*b*1) of a holder regulation opening (for example, the holder regulation opening 177*b*) against which a separating member (for example, the holder part 35*b*) of the sheet separator (for example, the pressing unit 35) abuts so as to regulate the range of rotation of the sheet separator. By rotating the separator rotary member, the position of the separator regulating part in the vertical direction is changed, and therefore the range of rotation of the sheet separator is changed.

According to Aspect 17, as described in Exemplary Variation 3, when the separator slide member is moved to change the position of the separator regulating part upwardly, as the sheet attraction/separation belt unit is swung from the sheet contact position, the separating member of the sheet separator abuts against the separator regulating part at an early stage. By so doing, the sheet separator stops rotating, and therefore the range of rotation of the sheet separator can be reduced.

By contrast, when the position of the separator regulating part is changed downwardly by rotating the separator rotary member, as the sheet attraction/separation belt unit is swung from the sheet contact position, a timing that the sheet separator contacts the separator regulating part becomes slower. As a result, the range of rotation of the sheet separator can be greater.

Aspect 18.

In any one of Aspects 1 through 17, a drive source that drives a unit or component other than the range adjuster (for example, the swing range adjusting unit 80, the pressing unit holder 158 and the related components, and the roller holder 157 and the related components) is used as a drive source for the range adjuster.

According to this configuration, in comparison to a configuration provided with the drive source dedicated to the range adjuster, the number of drive sources can be reduced, and therefore an increase in cost of manufacturing the image forming apparatus (for example, the image forming apparatus 100) can be prevented.

Aspect 19.

In Aspect 18, a drive source (for example, the drive source 24) that drives to rotate the attraction belt (for example, the attraction belt 2) is used as a drive source for the range adjuster (for example, the swing range adjusting unit 80, the pressing unit holder 158 and the related components, and the roller holder 157 and the related components).

According to this configuration, as described with reference to FIG. 40, the number of drive sources can be reduced, and therefore an increase in cost of manufacturing the image forming apparatus (for example, the image forming apparatus 100) can be prevented.

Aspect 20.

In Aspect 20, an image forming apparatus (for example, the image forming apparatus 100) includes an image forming unit (for example, the image forming device 50) and the sheet feeder (for example, the sheet feeder 200) according to Aspects 1 through 19 that separates the uppermost sheet (for example, the uppermost sheet 1*a*) from the sheet stack (for example, the sheet stack 1) and feeds the uppermost sheet to the image forming unit.

Accordingly, as described in the above-described embodiments, the image forming apparatus can prevent or reduce separation of the uppermost sheet attracted to the attraction belt when the uppermost sheet has a high rigidity, and therefore can form an image in a preferable sheet conveying operation. Further, the image forming apparatus can prevent or reduce occurrence of multiple sheet feeding even when the uppermost sheet has a low rigidity, and therefore can prevent or reduce occurrence of paper jam.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A sheet feeder comprising:

an endless attraction belt that is configured to be rotatably provided to face a top surface of a sheet stack;

a first tension roller configured to tension and support the endless attraction belt;

a second tension roller, upstream from the first tension roller in a sheet feeding direction, configured to tension the endless attraction belt;

a belt charger configured to attract an uppermost sheet of the sheet stack; and a pressing unit between the first tension roller and the second tension roller inside a loop of the endless attraction belt to press a portion of the endless attraction belt between the first tension roller and the second tension roller toward the sheet stack, the pressing unit configured press the portion of the endless attraction belt toward the sheet stack, the pressing unit including a curved portion, the curved portion having a first curved part and a second curved part aligned in a continuous curve, the first curved part being formed at a proximal part of a leading edge and the second curved part being formed at a distal part of the leading edge, the second curved part having a greater curvature than the first curved part such that the first curved part is configured to press against the portion of the endless attraction belt before the second curved part presses against same when the pressing unit presses against the portion of the endless attraction belt to press the portion of the endless attraction belt towards the sheet stack.

2. The sheet feeder according to claim 1, further comprising:

a range adjuster configured to adjust a pressing part of the pressing unit pressed against the endless attraction belt according to a type of at least the uppermost sheet that is attracted to the endless attraction belt.

3. The sheet feeder according to claim 2, wherein the range adjuster is configured to change the first and second curved parts selectively pressed against an inner circumferential surface of the endless attraction belt according to a rigidity of at least the uppermost sheet that is attracted to the endless attraction belt.

4. The sheet feeder according to claim 2 wherein the endless attraction belt is configured to contact the sheet stack at a sheet contact position to attract the uppermost sheet of the sheet stack to the endless attraction belt and the endless attraction belt separates from the sheet stack at a sheet separation position to convey the uppermost sheet attracted to the endless attraction belt, the sheet feeder further includes a movable unit configured to move the endless attraction belt from the sheet contact position to the sheet separation position while slanting the endless attraction belt with respect to the top surface of the sheet stack, the range adjuster further includes an angle range adjuster configured to change an angle of the endless attraction belt with respect to the top surface of the sheet stack at the sheet separation position according to a rigidity of at least the uppermost sheet, and a sheet separator is configured to change the first and second curved parts selectively pressed against an inner circumferential surface of the endless attraction belt according to the angle of the endless attraction belt.

5. The sheet feeder according to claim 4, wherein the angle range adjuster is configured to adjust the angle of the endless attraction belt with respect to the top surface of the sheet stack to be greater as the rigidity of at least the uppermost sheet becomes smaller, and when the angle of the endless attraction belt becomes greater, the second curved part having a greater curvature is selected from the first and second curved parts to be pressed against the endless attraction belt.

6. The sheet feeder according to claim 4, wherein the movable unit is configured to move the endless attraction belt from the sheet contact position to the sheet separation position while the endless attraction belt is slanted with respect to the top surface of the sheet stack by rotating a sheet attraction/separation belt unit about a point located upstream from the second tension roller in the sheet feeding direction, and the range adjuster is configured to change a range of rotation of the second tension roller so as to change the angle of the endless attraction belt.

7. The sheet feeder according to claim 6, wherein the angle range adjuster includes a slide member configured to be slidable with respect to the sheet attraction/separation belt unit in the sheet feeding direction, the slide member includes a regulating part against which a shaft of the second tension roller abuts so as to regulate the range of rotation of the second tension roller in a vertically downward direction, and by sliding the slide member, a position of the regulating part in the vertical downward direction is changed and the range of rotation of the second tension roller is changed.

8. The sheet feeder according to claim 4, wherein the first and second curved parts are divided into sections.

9. The sheet feeder according to claim 4, wherein the range adjuster includes a rotation range adjuster configured to change a range of rotation of the sheet separator.

10. The sheet feeder according to claim 9, wherein the rotation range adjuster includes a separator slide member that is configured to be slidable with respect to a sheet attraction/separation belt unit in the sheet feeding direction, the separator slide member includes a separator regulating part against which a separating member of the sheet separator abuts so as to regulate the range of rotation of the sheet separator, and by sliding the separator slide member, a position of the separator regulating part in a vertical direction is changed, and therefore the range of rotation of the sheet separator is changed.

11. The sheet feeder according to claim 9, wherein the rotation range adjuster includes a separator rotary member that is configured to be rotatable with respect to a sheet attraction/ separation belt unit, the separator rotary member includes a separator regulating part of a holder regulation opening against which a separating member of the sheet separator abuts so as to regulate the range of rotation of the sheet separator, and by rotating the separator rotary member, a position of the separator regulating part in a vertical direction is changed, and therefore, the range of rotation of the sheet separator is changed.

12. The sheet feeder according to claim 2, wherein a drive source that drives a unit or component other than the range adjuster is used as a drive source for the range adjuster.

13. The sheet feeder according to claim 12, wherein a drive source that drives to rotate the endless attraction belt is used as the drive source for the range adjuster.

14. An image forming apparatus comprising:

an image forming unit; and the sheet feeder according to claim 1, wherein the sheet feeder is configured to separate the uppermost sheet from the sheet stack and configured to feed the uppermost sheet to the image forming unit.

15. The sheet feeder according to claim 1, further comprising:

a biasing member, one end of the biasing member being connected to the pressing unit and an opposite end of the biasing member being connected to a housing provided at the inside of the loop of the endless attraction belt.

* * * * *